US012649612B2

(12) United States Patent
Hui et al.

(10) Patent No.: US 12,649,612 B2
(45) Date of Patent: Jun. 9, 2026

(54) DRINKING CONTAINER WITH MULTI-POSITION VALVE

(71) Applicant: MUNCHKIN, INC., Van Nuys, CA (US)

(72) Inventors: Lucy Hui, Los Angeles, CA (US); Sung Yun Chan, Pasadena, CA (US)

(73) Assignee: MUNCHKIN, INC., Van Nuys, CA (US)

( * ) Notice: Subject to any disclaimer, the term of this patent is extended or adjusted under 35 U.S.C. 154(b) by 0 days.

(21) Appl. No.: 19/078,184

(22) Filed: Mar. 12, 2025

(65) Prior Publication Data

US 2025/0289628 A1 Sep. 18, 2025

Related U.S. Application Data

(60) Provisional application No. 63/766,339, filed on Mar. 3, 2025, provisional application No. 63/679,563, filed on Aug. 5, 2024, provisional application No. 63/564,407, filed on Mar. 12, 2024.

(51) Int. Cl.
*B65D 47/08* (2006.01)
*A47G 19/22* (2006.01)

(52) U.S. Cl.
CPC ..... *B65D 47/0866* (2013.01); *A47G 19/2272* (2013.01)

(58) Field of Classification Search
CPC ..... B65D 47/0838; B65D 47/0866; B65D 47/0857; B65D 47/08; B65D 55/16; B65D 43/165; B65D 43/164; B65D 43/16; A47G 19/2272; A47G 19/2266; A47G 19/2205
USPC ..... 215/243, 237, 235, 315, 311, 307; 220/848, 847, 844, 843, 836, 810, 715, 220/714, 711, 369, 367.1; 251/226, 215, 251/303, 298
See application file for complete search history.

(56) References Cited

U.S. PATENT DOCUMENTS

2018/0042415 A1* 2/2018 Dunn ..... A47G 19/2272

* cited by examiner

*Primary Examiner* — Robert J Hicks
(74) *Attorney, Agent, or Firm* — Robert Z. Evora; ArentFox Schiff LLP

(57) ABSTRACT

The present technology discloses a multi-position valve for use with a container. The valve can have a frustoconical structure having apertures thereon, and a concentric flap attached to the frustoconical structure by a hinge, wherein the concentric flap pivots from a first closed position to a second open position. When the concentric flap of the interior valve is in the first closed position, the concentric flap abuts against the frustoconical structure and blocks fluid flow through the apertures. When the concentric flap of the interior valve is in the second open position, the concentric flap is pivoted upward at the hinge and away from the frustoconical structure and permits fluid flow through the apertures.

20 Claims, 58 Drawing Sheets

DRINKING CONTAINER WITH MULTI-POSITION VALVE

CROSS-REFERENCE TO RELATED APPLICATIONS

This patent application claims the benefit of and priority to U.S. Provisional Patent Application No. 63/564,407, filed on Mar. 12, 2024, entitled "DRINKING CONTAINER WITH A MULTI-POSITION VALVE," and U.S. Provisional Patent Application No. 63/679,563, filed on Aug. 5, 2024, entitled "DRINKING CONTAINER WITH A MULTI-POSITION VALVE," and U.S. Provisional Patent Application No. 63/766,339, filed on Mar. 3, 2025, entitled "DRINKING CONTAINER WITH A MULTI-POSITION VALVE," all of which are expressly incorporated by reference herein in its entirety.

TECHNICAL FIELD

The subject disclosure relates to a drinking container. More particularly, to a drinking container assembly having a 360 degree lip enclosure from which a user can drink along any peripheral edge of the container and withdraw drinking fluid from within the container assembly in a first spill-proof position, and a second pour position in which a second interior valve is opened to allow the free flow pouring of the drinking fluid.

BACKGROUND

Various types of 360 degree spill-proof containers are known which control the amount of fluid that can be drawn from the lip surrounding the 360 degree spill-proof container. The fluid flow rate is restricted based on the design of the container and an allotted flow rate. Spill-proof containers are reasonably good for preventing spillage, such as when an individual knocks over the cup which would otherwise cause substantial leakage onto the ground, themselves or elsewhere in the vicinity of the fall.

These traditional 360 degree spill-proof containers do not provide a method of allowing more fluid to free flow beyond the constraints of their restricting design. Accordingly, there is a need for the development of a cup which does not easily spill when knocked over, albeit is capable of providing a pour mode when desired.

SUMMARY

The present subject disclosure presents a simplified summary of the subject disclosure in order to provide a basic understanding of some aspects thereof. This summary is not an extensive overview of the various embodiments of the subject disclosure. It is intended to neither identify key or critical elements of the subject disclosure nor delineate any scope thereof. The sole purpose of the subject summary is to present some concepts in a simplified form as a prelude to the more detailed description that is presented hereinafter.

In one exemplary embodiment, the present subject disclosure is a multi-position valve. The multi-position valve can include a frustoconical structure having apertures thereon and a concentric flap attached to the frustoconical structure by a hinge, wherein the concentric flap pivots from a first closed position to a second open position. When the concentric flap of the interior valve is in the first closed position, the concentric flap abuts against the frustoconical structure and blocks fluid flow through the apertures. When the concentric flap of the interior valve is in the second open position, the concentric flap is pivoted upward at the hinge and away from the frustoconical structure and permits fluid flow through the apertures.

BRIEF DESCRIPTION OF THE DRAWINGS

Various exemplary embodiments of this disclosure will be described in detail. The accompanying drawings, which are incorporated in and constitute a part of this specification, illustrate embodiments of the subject disclosure and technical data supporting those embodiments, and together with the written description, serve to explain certain principles of the subject disclosure. With reference to the following figures, wherein.

DETAILED DESCRIPTION

Particular embodiments of the present invention will now be described in greater detail with reference to the figures.

Figure 1:
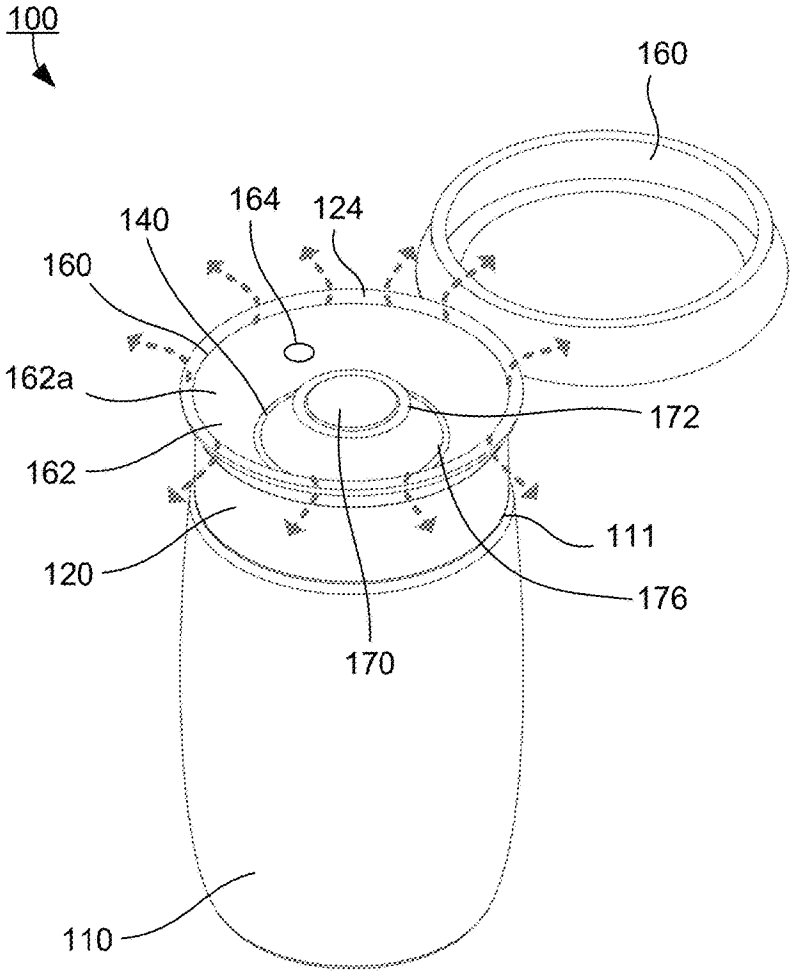
FIG. 1 depicts a perspective view of an exemplary drinking container assembly in a closed valve position according to the subject disclosure.

FIG. 1 shows an exemplary embodiment of a drinking container assembly 100 with a valve structure 140 having an outer valve 160 and an inner valve 170. FIG. 1 illustrates the inner valve 170 in a closed position. When the inner valve 170 is in the closed position, the drinking container assembly 100 is used as a non-spill drinking container and fluid is only drawn by a suction force being applied by a user to an upper end 124 of the collar and the outer valve 160 of valve structure 140. Under the suction force, the user is able to sip from anywhere around the rim or upper end 124 where the suction force is applied. That is, the fluid can flow through the outer edge between the collar 120 and the valve structure 140 anywhere the suction force is applied. As will be discussed in further detail below, when the inner valve 170 is in this closed position and a user 5 presses their top lip against sealing edge 162 to cause sealing edge 162 to lift away from upper end 124, a drinking fluid can flow between a sealing edge 162 of outer valve 160 and upper end 124 of collar 120.

Figure 2:
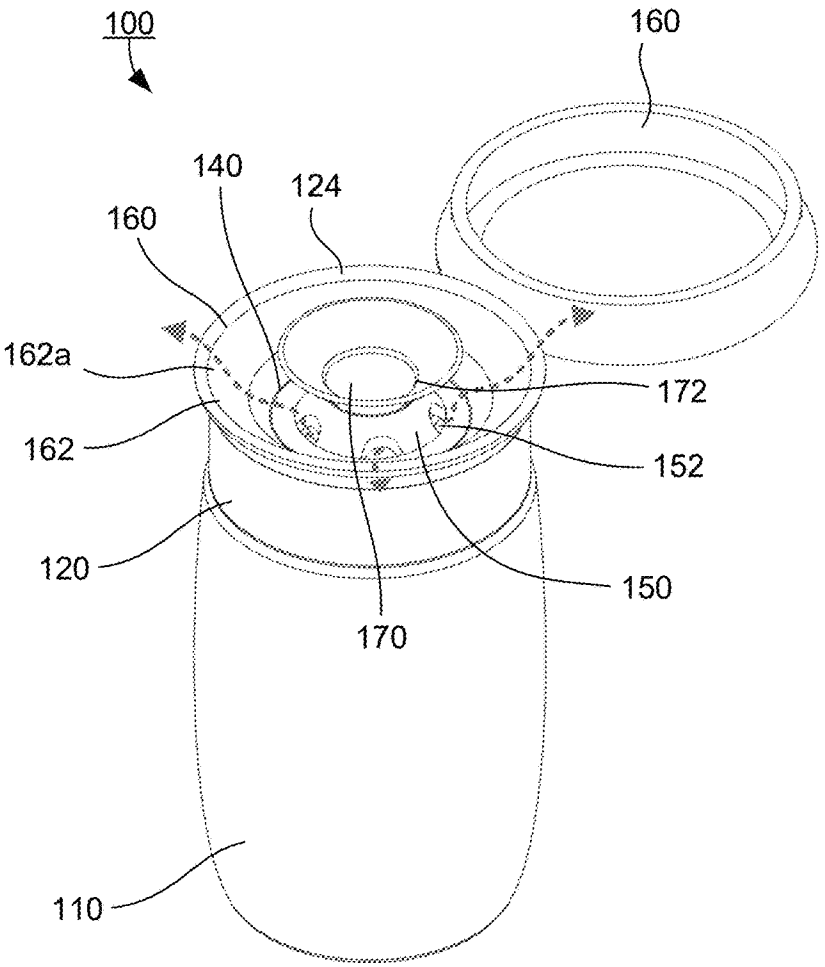
FIG. 2 depicts a perspective view of the drinking container assembly in an open valve position.

FIG. 2 depicts the drinking container assembly 100 having inner valve 170 in an open position. More specifically, the valve structure 140 is also adapted for faster unimpeded fluid flow rate when the inner valve 170 is open such that the drinking container assembly 100 can be used as a pour container and the user is able to take larger gulps without having to initiate the fluid flow. In this second open position, the user is also able to rapidly drink from anywhere around the upper end 124 with ease simply by tilting the lower end of the container upright to initiate flow under the natural force of gravity. In other words, the drinking container assembly 100 is adapted for use as a pour container when the inner valve 170 is in the open position. For example, when the drinking container assembly 100 is tipped over, the fluid flows from a cavity 119 of the container 110 through apertures 152 of valve structure 140 unimpeded by the inner valve 170. In other words, a user can drink from the drinking container assembly 100 by pressing their lips against upper end 124 and tipping drinking container assembly 100, thereby allowing the fluids contained therein to flow through apertures 152 in a rapid and/or unimpeded manner as a pour spout. No sucking force by the user is required to drink the fluid. In other words, when the inner valve 170 is open, simply tipping the drinking container assembly 100 allows the fluid to pour from within the container 110 through the apertures 152 and into the mouth of the user 5.

Figure 3:
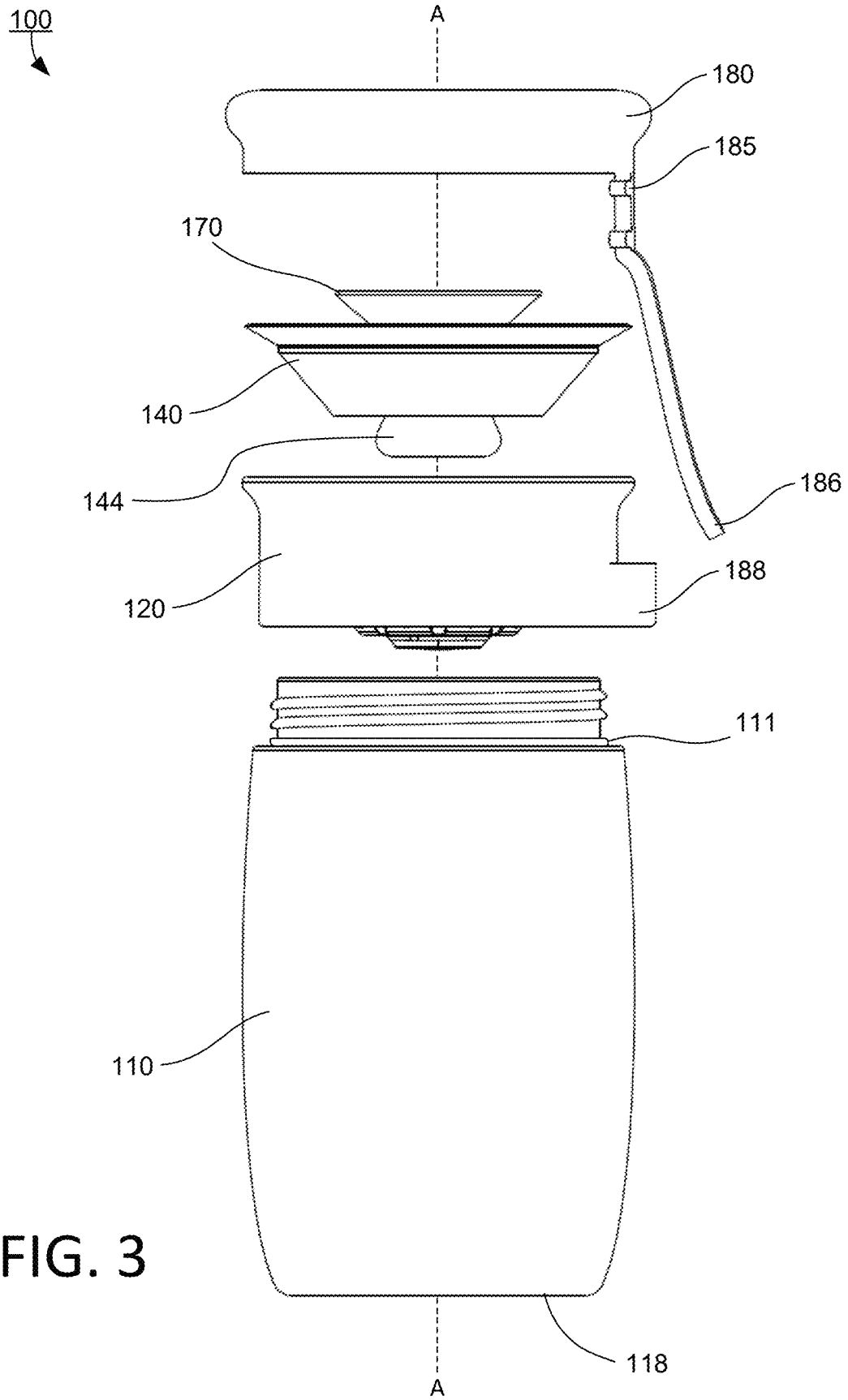
FIG. 3 illustrates an exploded view of the drinking container assembly.

FIG. 3 illustrates an exploded view of the drinking container assembly 100. The drinking container assembly 100 includes a container 110, a seal ring 111, a collar 120, a valve structure 140 and a lid 180.

The container 110 is substantially cylindrical in shape about a central axis (A) and has a side wall 112, an upper end 114 and a second closed end 118. The upper end 114 of the container 110 may be an open end having a central opening adapted to receive a fluid stored within the container 110. It is to be understood that container 110 can take any suitable size or shape capable of holding a fluid and receiving the collar 120 and the valve structure 140, such as a square shape or other suitable obtuse shape.

Figure 4:
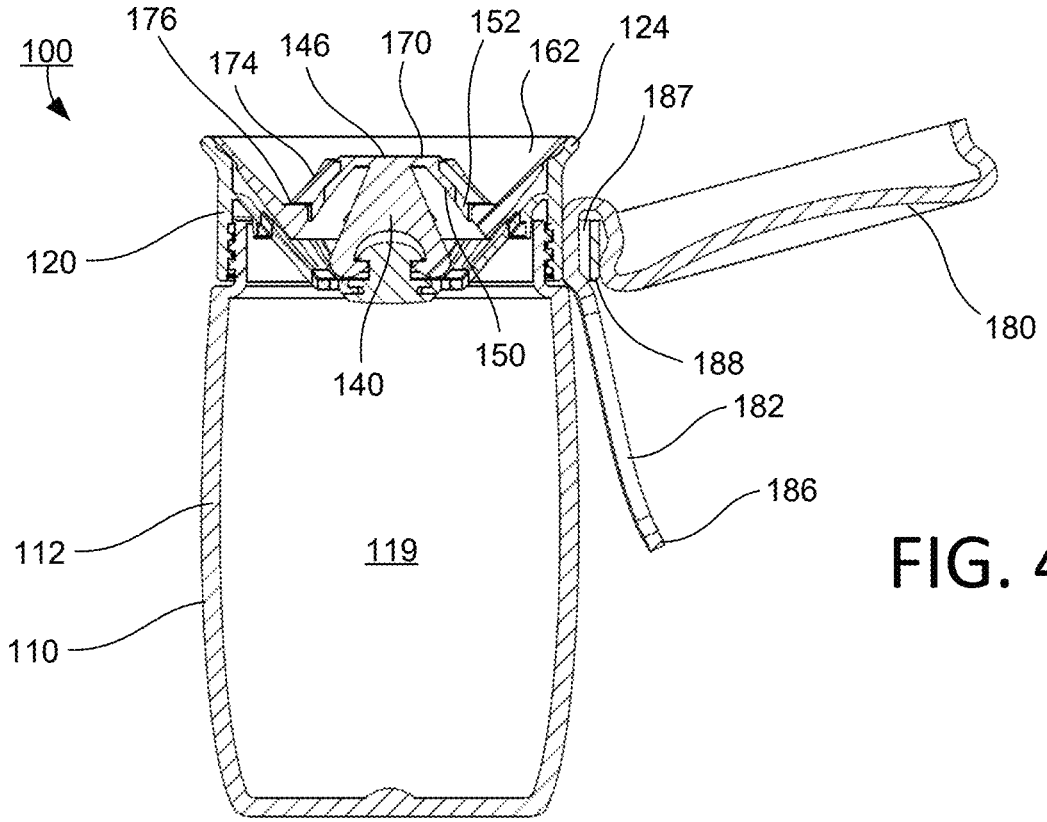
FIG. 4 shows a side cross section view of the drinking container assembly in a closed valve position.

FIG. 4 shows a side cross section view of the drinking container assembly 100 having inner valve 170 in a closed position. As shown, sealing flap 174 of inner valve 170 is substantially pressed against skirt 150 and blocking apertures 152. Consequently, fluids are unable to flow freely through apertures 152. However, as discussed above, fluid can flow through apertures 138 of collar 120 and between upper end 124 and sealing edge 162 when a user presses their lips against sealing edge 162.

Figure 5:
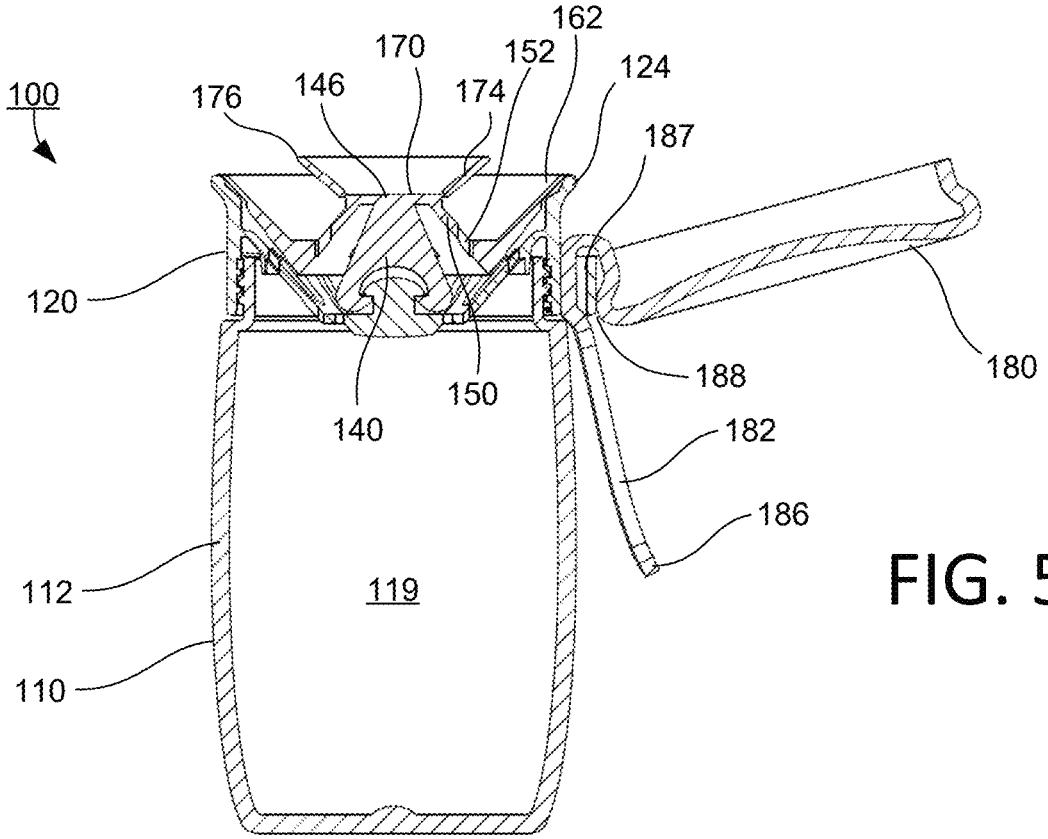
FIG. 5 depicts a side cross section view of the drinking container assembly in an open valve position.

FIG. 5 depicts a side cross section view of the drinking container assembly 100 having inner valve 170 in an open position. As shown, sealing flap 174 of inner valve 170 is pivoted away from skirt 150 and does not block apertures 152. Consequently, fluids are able to flow freely through apertures 152 without additional suction. As discussed above, a user can simply tilt the drinking container assembly 100 to allow the fluids to flow from the cavity 119.

Figure 6:
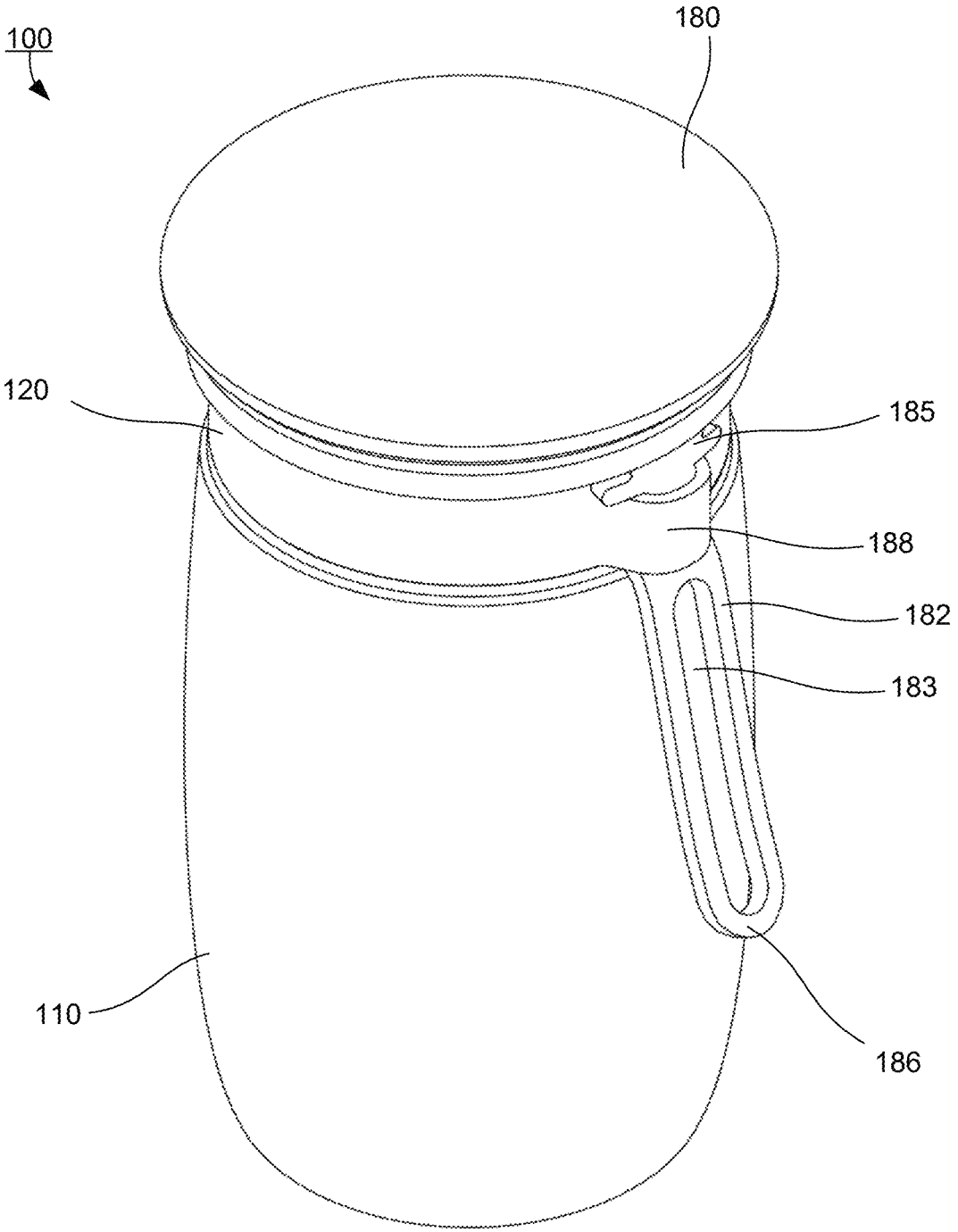
FIG. 6 depicts the drinking container assembly in an upper perspective.
Figure 7:
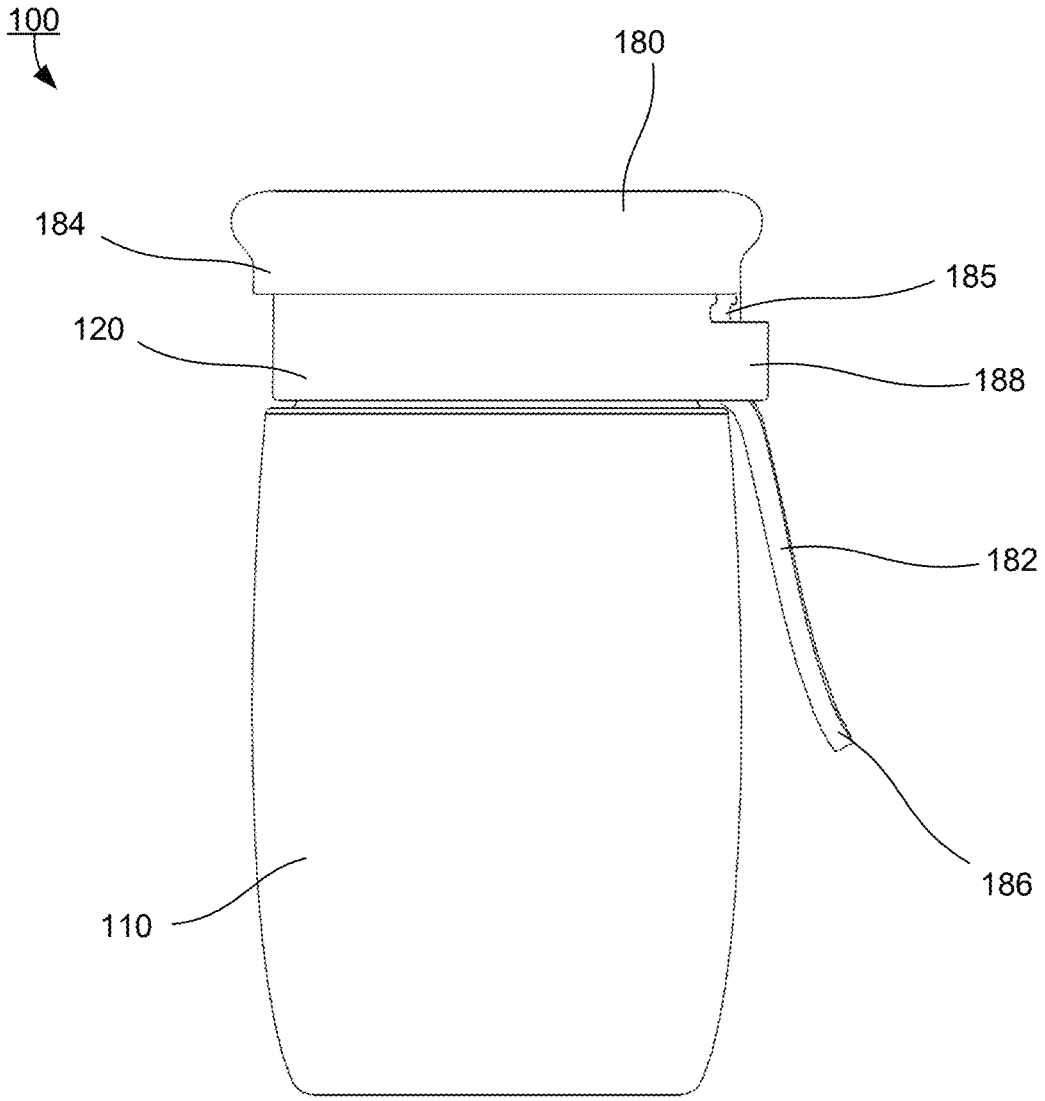
FIG. 7 illustrates a side view with a cover over a top in a closed storage position.

FIG. 6 and FIG. 7 depict the drinking container assembly 100 in an upper perspective and a side view with a lid 180 over a top in a closed storage position. Lid 180 can cover collar 120 when a user does not want to drink from drinking container assembly 100. In some embodiments, a strap 182 is disposed to facilitate holding of the drinking container assembly 100.

Figure 8:
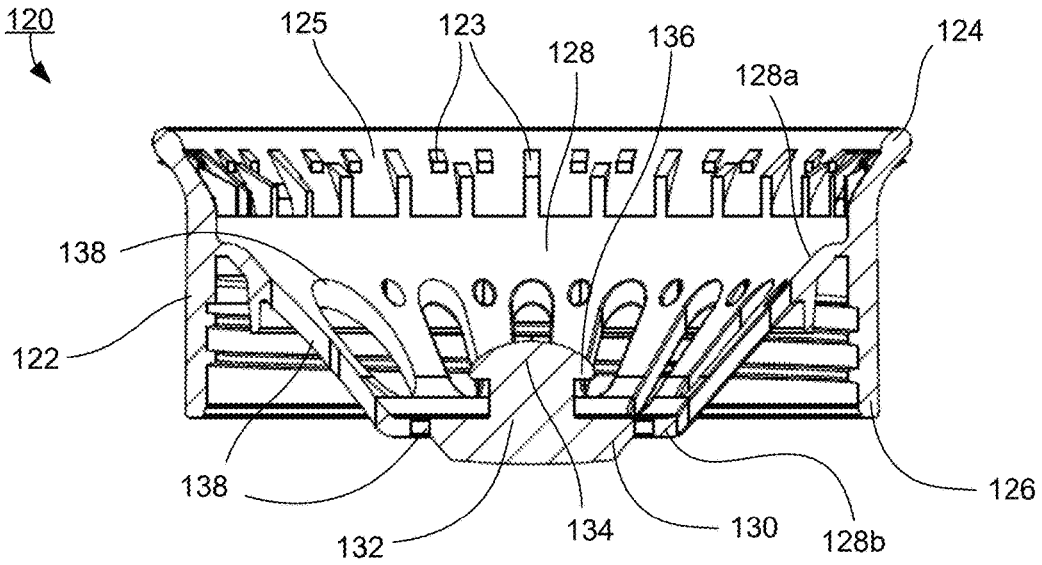
FIG. 8 depicts a side cross section view of a collar.
Figure 9:
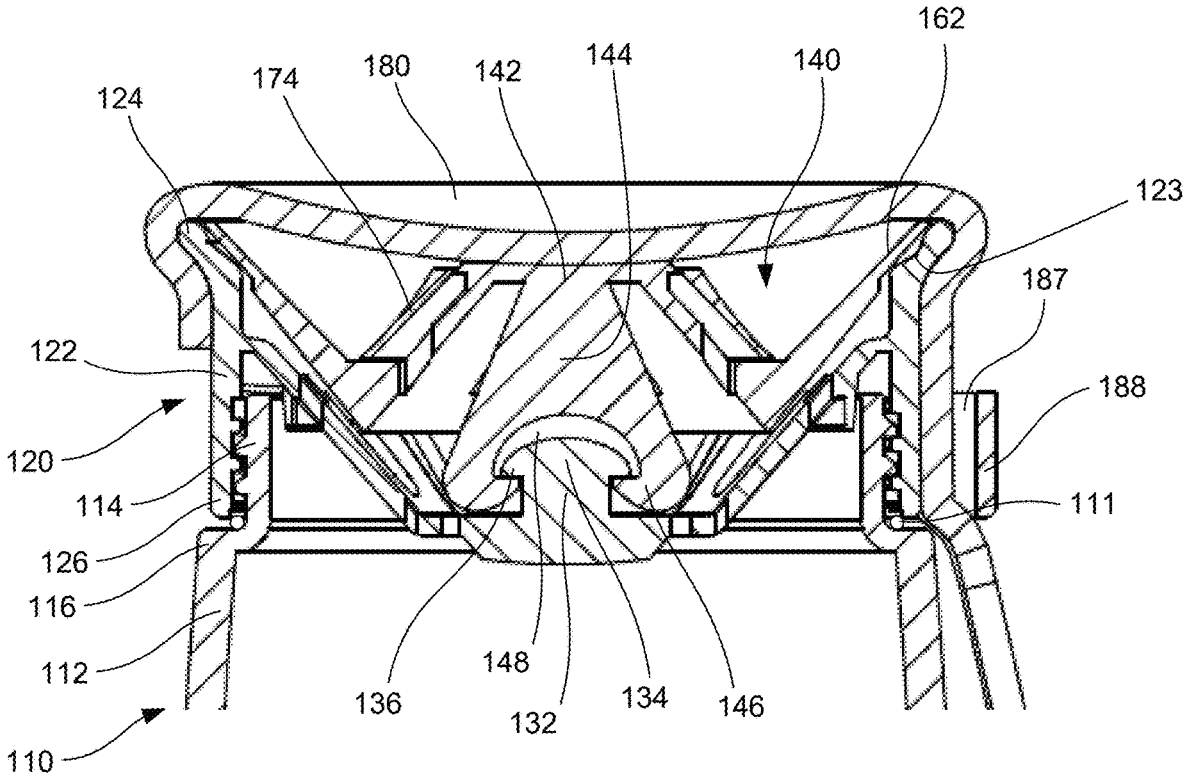
FIG. 9 depicts a partial side cross section view of the drinking container assembly in a closed valve position.

FIG. 8 illustrates a cross section view of the collar 120 showing an internal structure of the collar 120. FIG. 9 depicts the collar 120 with the valve structure 140, the lid 180 and the container 110.

The collar 120 includes an upper surface 128*a* that faces upward. The collar 120 is attached at a lower end 126 to an upper end 114 of the container 110, as shown in FIG. 9. The collar 120 also includes a lower surface 128*b* that faces downward toward the container 110 away from the valve structure 140 in assembly. As shown, the fastener assembly includes male threads disposed at the lower end 126 of the collar 120 being threadedly attached to the female threads provided about an inner surface at the upper end 114 of the container 110. The threaded connection between the container 110 and the collar 120 is fluidly sealed by the seal ring 111 disposed between a concentric shoulder 116 and the upper end 114 of the container 110 to prevent any leakage of fluid contained within the container 110.

Figure 13:
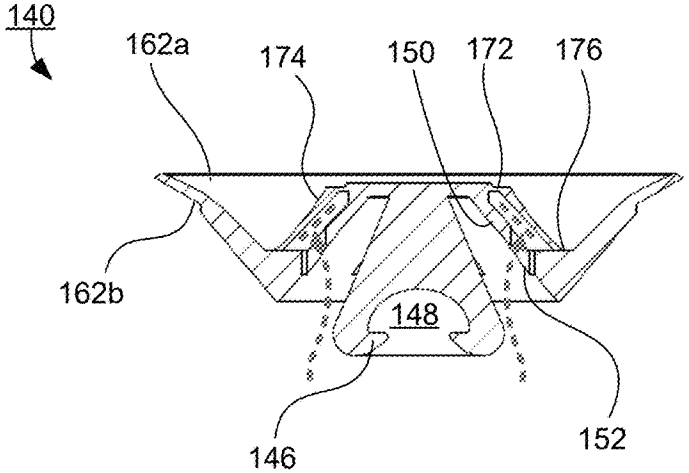
FIG. 13 illustrates side cross section view of the multi-position annular seal in a closed position.

As shown in a partially enlarged view in FIG. 9, the collar 120 may be constructed to include an outer wall 122 whose upper end terminates at upper end 124. Just below the upper end 124, a support or abutment surface 123 is provided on an inward facing collar surface edge of the collar 120 juxtaposed to the lower surface 162*b* (e.g., as shown in FIG. 13) of scaling edge 162 is adapted to come into sealing engagement with the lower surface 162*b* (e.g., as shown in FIG. 13) of sealing edge 162. FIG. 9 depicts a sealed configuration between the abutment surface 123 at the inward facing collar surface edge of the collar 120 and the lower surface 162*b* (e.g., as shown in FIG. 13) of sealing edge 162. In the sealed configuration, a fluid is prevented from flowing out of the container 110, unless a sipping pressure is applied to the upper end 124.

The collar 120 is constructed as a frustoconical support member covering a central opening of the upper end 114 of the container 110. In general, various walls extend inwardly from a concentric inner surface of the collar 120 to an internal lower wall 130 that covers the central opening of the upper end 114 to the container 110.

The upper end 124 of the collar 120 can have an outwardly flared contour. An intermediate wall 128 extends radially inward in a downwardly stepped fashion defining the central internal lower wall 130 over the opening of upper end 114 of the container 110. The lowermost internal lower wall 130 is positioned at a substantially central position within the collar 120 and over the opening of upper end 114.

The lower wall 130 expands radially outward from a base to a peripheral edge. A projection 132 is provided that may be positioned substantially central to the collar 120 opening. A lower portion of intermediate wall 128 extends radially upward from the peripheral edge, outward and away from the lower wall 130 at a predetermined angle towards a second radial ledge. The radial ledge then expands radially outward a predetermined distance into the concentric inner surface. The concentric inner surface extends upward and flares outward toward the upper end 124 of the collar 120 and terminates at upper end 124.

The projection 132 extends upward from the internal lower wall 130 at the central position in the collar 120. The projection 132 includes an upward post that terminates to define an upright mushroom-shaped bulbous head 134. Outer edges of the bulbous head 134 extend radially outward beyond an outer surface of the post of the projection 132. The outer edges of the bulbous head 134 define a concentric shoulder that extends radially outward beyond an outer surface of the post. The projection 132 may be made as a single integrated part of the lower wall 130 or can be made as a separate part and permanently attached to the lower wall 130. The projection 132 may be secured to the lower wall 130 in a variety of different ways, such as by securely over-molded onto the lower wall 130 and/or any other suitable manner.

The lower side of the valve structure 140 has an extension arm 144 that extends from the center surface 142 downward and has a mating recess 148 adapted to be fastened to the projections 132. The recess 148 is provided in a lower side surface of the extension arm 144 of the valve structure 140 that faces the upper surface of the collar 120. A concentric flange 146 extends inwardly at the entry end of the recess 148 in the valve structure 140 in order to provide an engagement and locking mechanism to attach to a concentric shoulder defined by the bulbous head 134 of the projection 132. That is, the recess 148 of the valve structure 140 is pushed down over the bulbous head 134 until the concentric flange 146 slides over the bulbous head 134 and locks onto the concentric shoulders 136 below the bulbous head 134.

In use in the first closed valve position, when a suction force is applied with a predetermined negative suction pressure to the upper end 124 of the collar 120, the sealing edge 162 of the valve structure 140 will be lifted under the suction force with enough height to break the seal and allow the liquid to flow through the gaps 125 (FIG. 8) constructed on the abutment surface 123 and the lifted sealing edge 162 of the valve structure 140 on the inner surface of the upper end 124.

The lid 180 includes a lip 184 that surrounds the upper end 124 of the collar 120. The lip 184 is adapted to cover the upper end 124 of the collar 120 and to maintain cleanliness to the collar 120 in a sanitary storage position. The lid 180 further includes a strap 182 adapted to secure the lid 180 to a retainer 188 integrated into the collar 120.

As shown in FIG. 6, FIG. 7 and FIG. 9, the retainer 188 extends concentrically outward from a side of the collar 120. The retainer 188 provides an opening 187 adapted to receive the strap 182. The retainer 188 receives an end 186 of the strap 182 and is pulled through into a secure position.

As shown in FIG. 4 and FIG. 5 in cross section, the end 186 is secured to the retainer 188. That is, the end 186 is fed through the opening 187 in the retainer 188 portion of the collar 120 until the strap 182 is substantially pulled all the way through to a predetermined position. As shown in FIG. 3 and FIG. 6, various stops 185 may be constructed into the strap 182 to secure the strap 182 at the predetermined position. The stops 185 may be positioned on either side of the retainer 188 to keep the strap 182 in a particular position. As shown in FIG. 6, an opening 183 may be constructed into the strap 182 so that a user can clasp onto the strap 182 easier.

FIGS. 4 and 5 illustrate use of the lid 180 in an open position. FIGS. 6 and 7 illustrate use of the lid 180 in a closed position. In the open position, the retainer 188 may be used to act as a stop for the lid 180 when the lid 180 and strap 182 are pivoted to a predetermined opening angle.

FIG. 8 shows the valve structure 140 secured to an open upper surface 128*a* of the collar 120. The lower end 126 of the collar 120 is fastened via a fastener assembly to the upper end 114 of the container 110. Assembled, the seal ring 111 is disposed between the upper end 114 of the container 110 and the concentric shoulder 116 of the collar 120.

A threaded fastener assembly may make up the fastener assembly connection disposed between the collar 120 and the container 110 and/or any other suitable portion where a concentric fastener connection is necessary. However, it is to be understood that various other suitable constructions for the secure assembly connection mechanism between the collar 120 and the container 110 may be used.

FIGS. 10-13 show the valve structure 140 in a first closed position, and FIGS. 14-17 show the valve structure 140 in a second open position.

Figure 11:
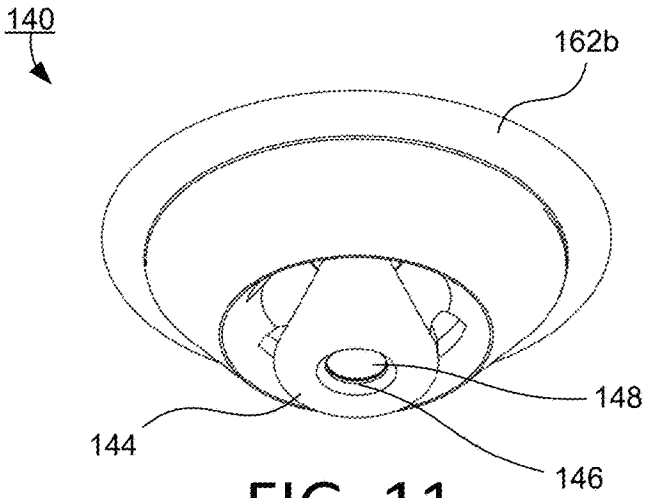
FIG. 11 shows a lower perspective view of the multi-position annular seal in a closed position.
Figure 10:
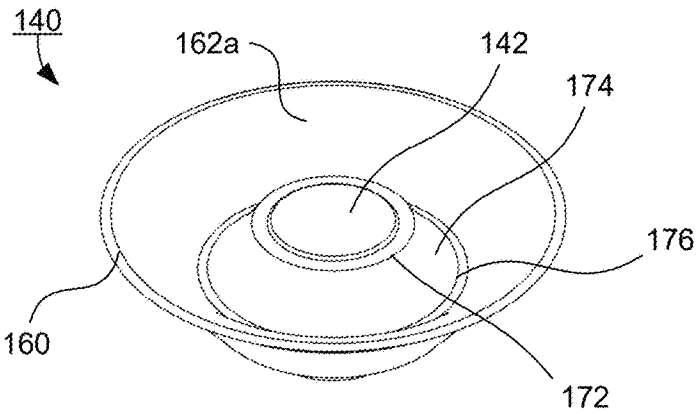
FIG. 10 depicts an upper perspective view of a multi-position annular seal in a closed position.
Figure 12:
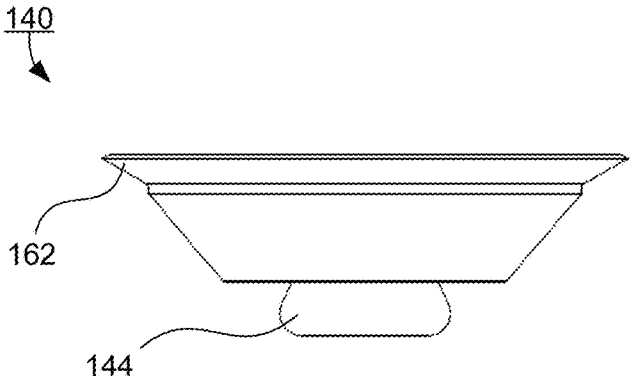
FIG. 12 depicts a side view of the multi-position annular seal in a closed position.
Figure 15:
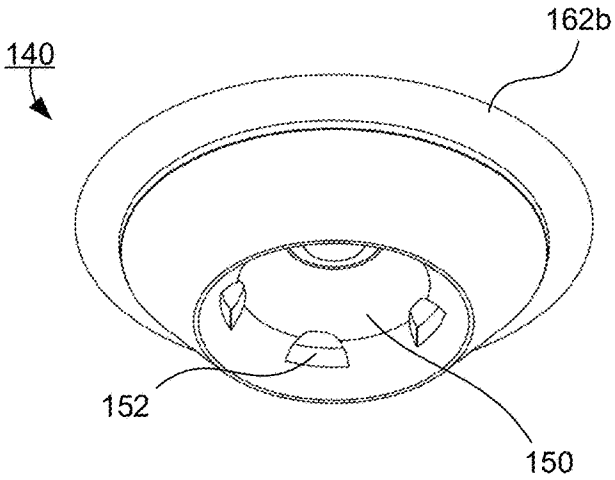
FIG. 15 shows a lower perspective view of the multi-position annular seal in an open position.
Figure 17:
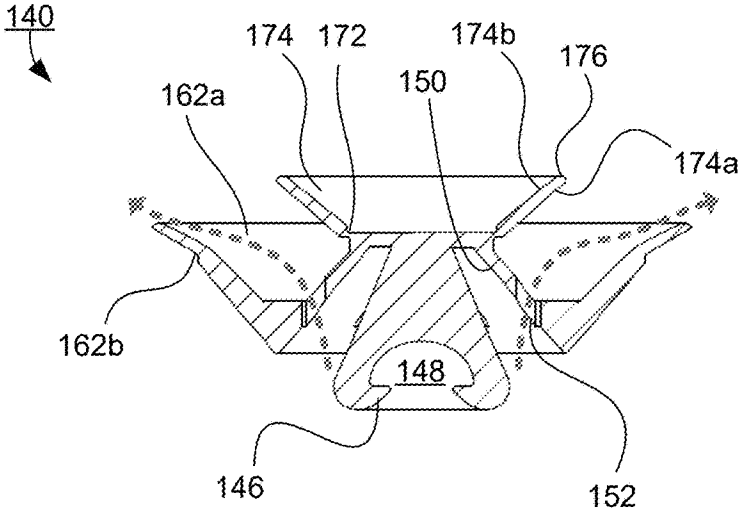
FIG. 17 illustrates a side cross section view of the multi-position annular seal in an open position.

As shown in FIGS. 10 and 11, the valves of valve structure 140 are constructed in the form of frustoconical discs. The outer valve 160 of valve structure 140 has an upper surface 162*a* that faces upward and away from the collar 120 in assembly. The outer valve 160 of valve structure 140 has a lower surface 162*b* having a frustoconical shape that substantially mirrors the frustoconical shape of the upper surface 128*a* (e.g., as shown in FIG. 8) of the collar 120 that it is attached to in assembly.

Figure 89:
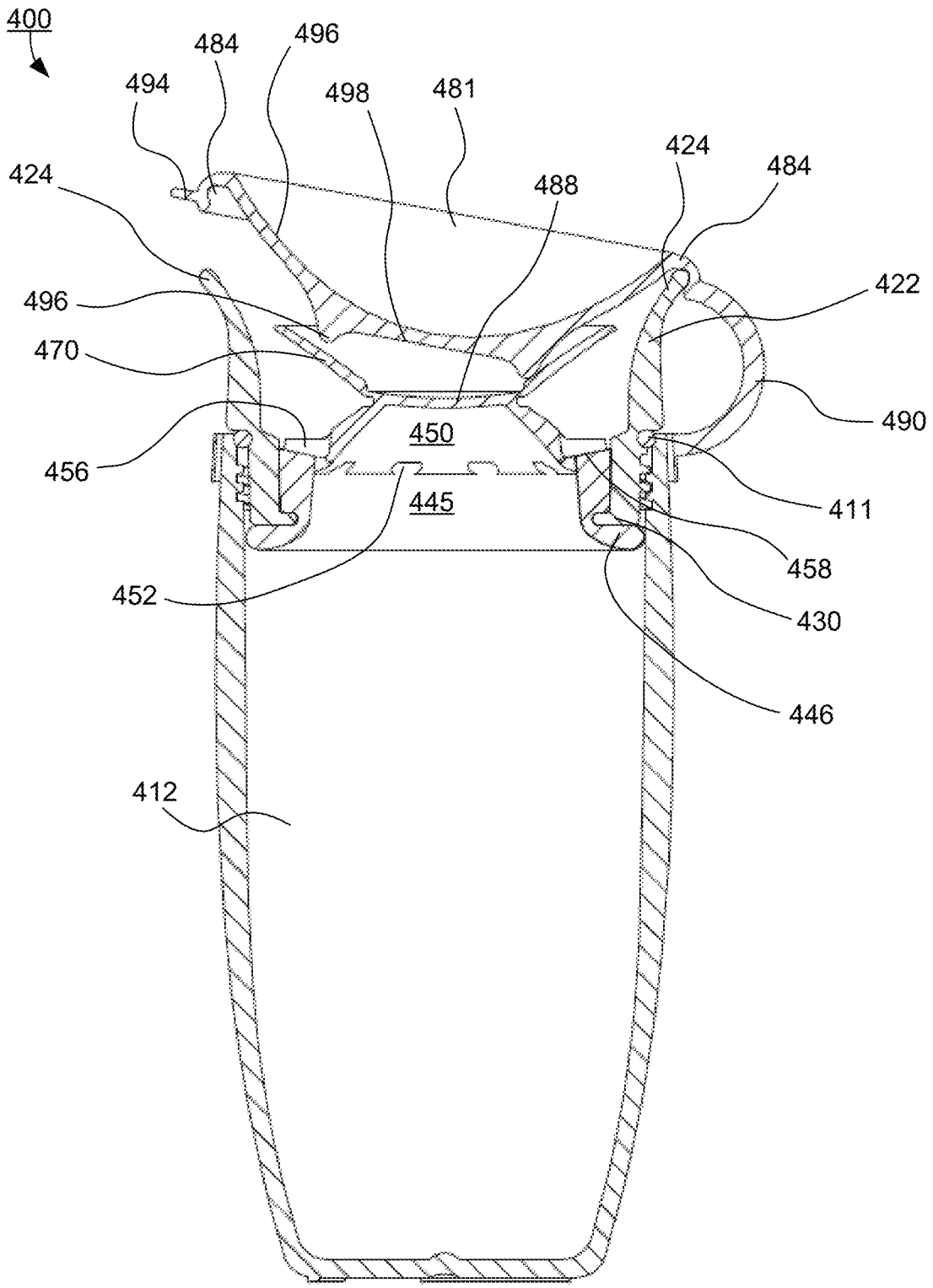

As shown in FIG. 89 and FIG. 13, the lower surface 162*b* of outer valve 160 lies adjacent to a portion of the upper surface 128*a* of the collar 120 in assembly. At a predetermined distance downwardly along the upper surface 128*a* of the collar 120, the lower surface 162*b* of the valve structure 140 abruptly inclines upward and away from the lower surface 162*b* toward a center surface 142 defining a skirt 150.

Figure 14:
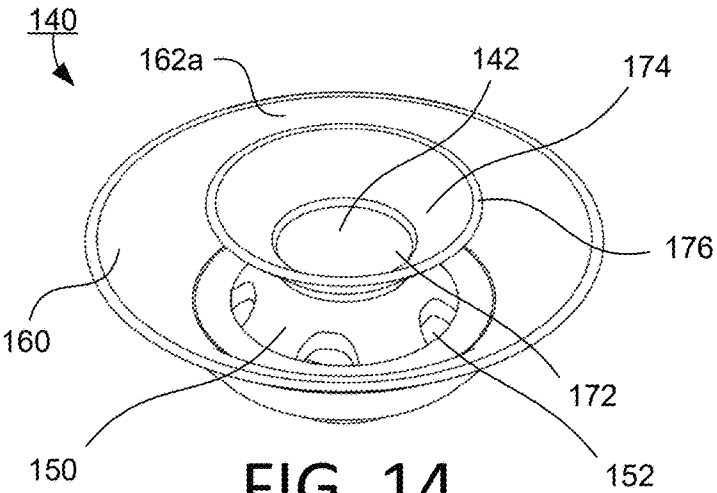
FIG. 14 depicts an upper perspective view of the multi-position annular seal in an open position.
Figure 16:
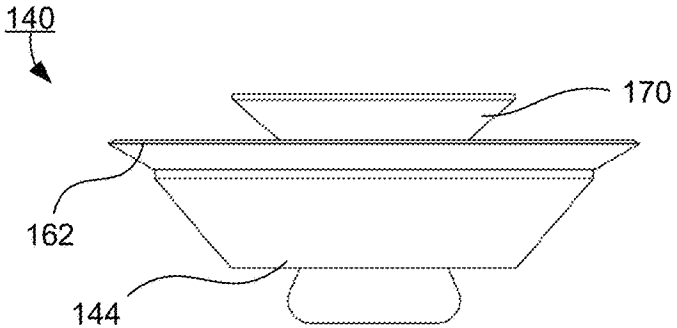
FIG. 16 depicts a side view of the multi-position annular seal in an open position.
Figure 18:
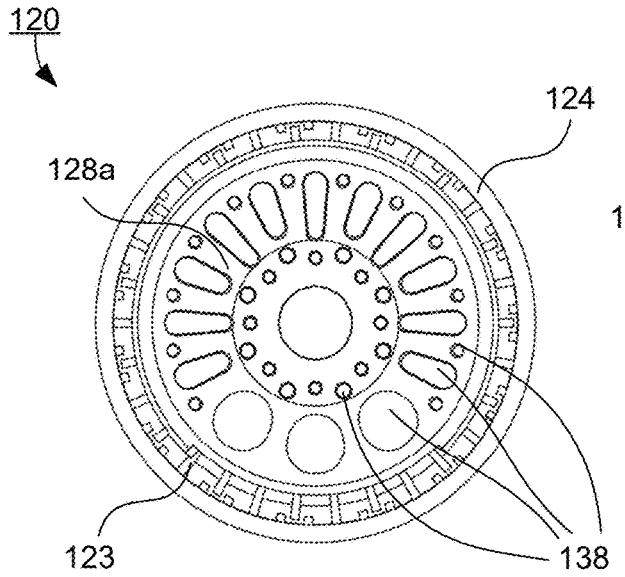
FIG. 18 depicts a top view of a collar.
Figure 19:
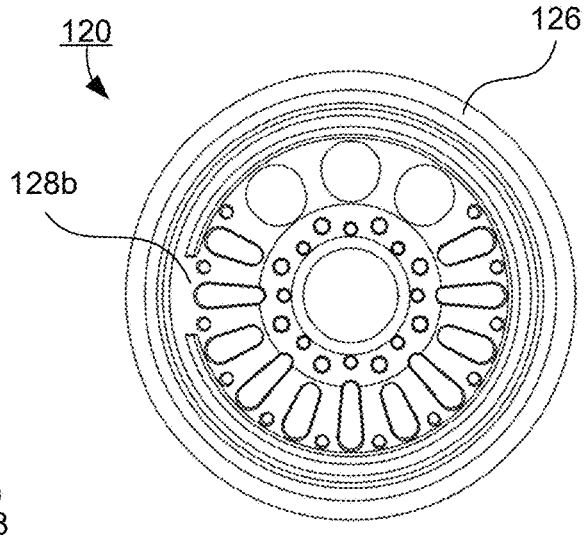
FIG. 19 shows a bottom view of the collar.
Figure 20:
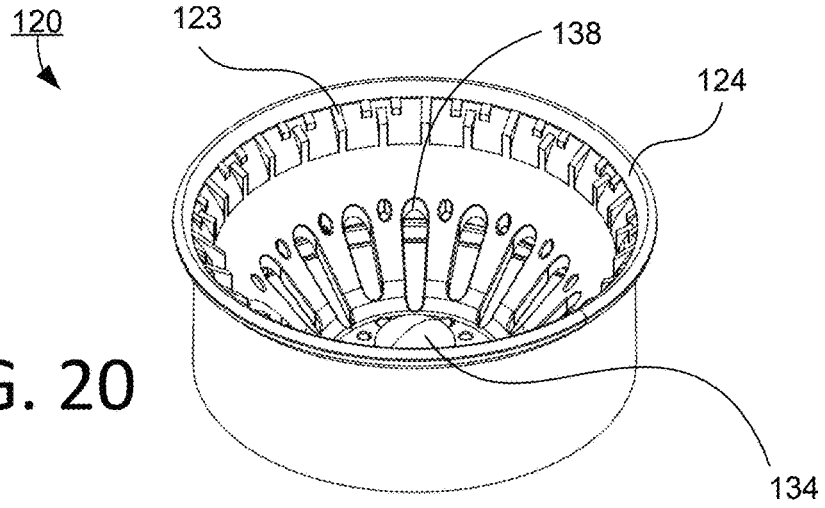
FIG. 20 illustrates an upper perspective view of the collar.
Figure 21:
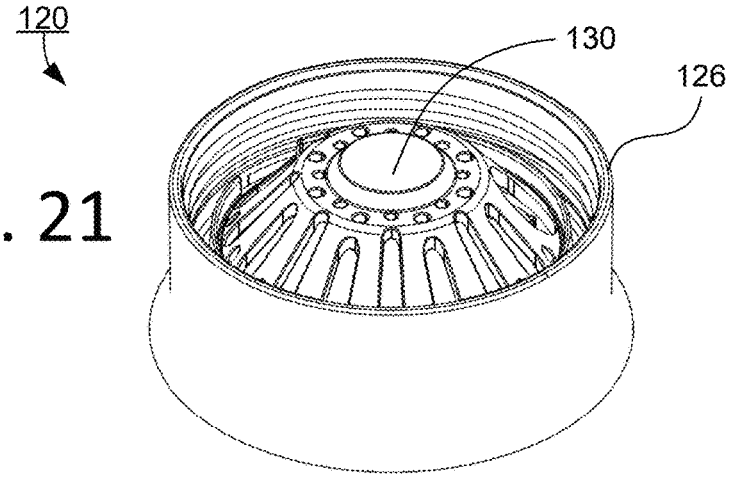
FIG. 21 illustrates a lower perspective view of the collar.
Figure 22:
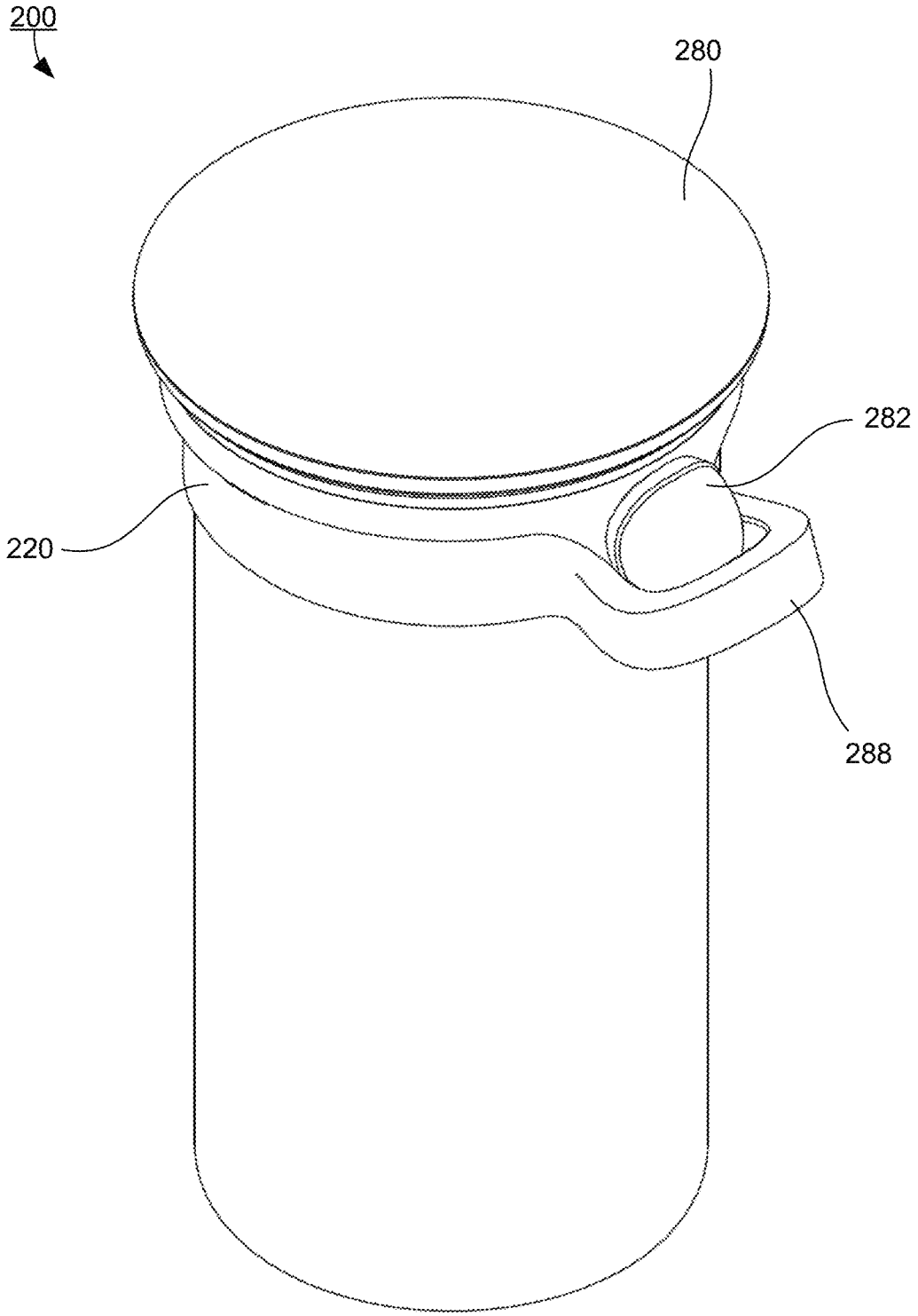
FIG. 22 depicts an upper perspective view of another exemplary drinking container assembly.

As shown in FIG. 9 and FIG. 14, an upper end of the skirt 150 terminates in the upper circular center surface 142 of the valve structure 140. In the skirt 150, various apertures 152 are disposed for fluid communication between the container 110 and the upper end 124 of the collar 120 during use.

FIGS. 14-17 show an inner valve 170 can include a sealing flap 174 extending from the center surface 142 concentrically outward a predetermined distance to a peripheral edge 176. The sealing flap 174 has a length that permits the sealing flap 174 to create a seal against the upper surface 162*a* of the valve structure 140, thereby closing off the apertures 152 when in the first closed position. The sealing flap 174 resembles an umbrella shape extending from the center surface 142. The sealing flap 174 has a lower flap side 174*a*, and an upper flap side 174*b*.

As shown in FIG. 1, FIG. 3, FIG. 9 and FIG. 10 to FIG. 13, the sealing flap 174 of the valve structure 140 can be moved into a downward first position that resembles an open umbrella. As shown in FIG. 2, FIG. 4 and FIG. 14 to FIG. 17, the sealing flap 174 of the valve structure 140 can be moved into an upper second position that resembles a flipped backward umbrella. In other words, the sealing flap 174 can be moved between two positions. The peripheral edge 176 of the sealing flap 174 extends concentrically outward from the center surface 142 of the valve structure 140. The peripheral edge 176 of the sealing flap 174 pivots about a hinge 172 into the downward first position, and the upper second position.

As shown in FIG. 1, FIG. 3, FIG. 9 and FIG. 10 to FIG. 13, the sealing flap 174 of the inner valve 170 is pushed closed in an open umbrella configuration such that the peripheral edge 176 is seated against the upper surface 162*a* of the valve structure 140 when the sealing flap 174 is in the downward first position. In this downward first position, the inner valve 170 of the valve structure 140 is positioned in a sipping configuration. As shown in FIG. 1 and FIG. 13, an outer peripheral edge 176 of the sealing flap 174 lies against the upper surface 162*a* of the valve structure 140. In this position, the apertures 152 are covered and sealed off by the lower flap side 174*a* side of the sealing flap 174. Sufficient force is created at a hinge 172 to bias the outer peripheral edge 176 against the upper surface 162*a* of the valve structure 140 with sufficient strength to keep a fluid tight seal. As shown in FIG. 13, the apertures 152 in the skirt 150 are sealed off by the sealing flap 174 and fluid is trapped and cannot flow across the skirt 150 as it is sealed by the sealing flap 174. Accordingly, the fluid is only permitted to flow adjacent to the upper end 124 (e.g., acting as a sipping edge) between the collar 120 and the lower surface 162*b* of the valve structure 140 as shown in FIG. 1. In this downward first position, the sealing flap 174 of the inner valve 170 is closed off in the valve structure 140 and the drinking container assembly 100 can only be used for sipping. As shown in FIG. 1, fluid can only be drawn out for sipping from between the upper end of the collar 120 and the outermost peripheral end of the valve structure 140 when a sipping vacuum force is applied by the user at any position concentrically around the rim or upper end 124 of the collar 120.

As shown in FIG. 2, FIG. 4 and FIG. 14 to FIG. 17, the sealing flap 174 of the inner valve 170 is open and splayed upward away from the upper surface 162*a* of the valve structure 140 and resembles a flipped backward umbrella when the sealing flap 174 is in the upward second position. In this upward second position, the inner valve 170 is open and the valve structure 140 is in an unimpeded pour configuration. In order to move the sealing flap 174 from the first position to the upward second position, the upper center surface 142 of the inner valve 170 may be depressed causing the peripheral edge 176 of the scaling flap 174 to flip upward and away from the upper surface 162*a* of the annular seal into the upward second position via hinge 172. In this upward second position, fluid is allowed to flow from within the container 110 through apertures 152 in the skirt 150 and across the upper surface 162*a* of the valve structure 140 as shown in FIG. 2. In this position, the valve structure 140 acts as a pour mechanism without interruption. When the container 110 is tipped over in this second position, fluid within the container 110 is allowed to drain unimpeded across the upper surface 162*a* of the valve structure 140 through the apertures 152 and out of the drinking container assembly 100 freely.

In some embodiments, a multi-position valve or valve structure (e.g., valve structure 140) may include an upper frustoconical portion connected to a tubular lower end portion, and an interior valve disposed at a junction between upper frustoconical portion and a tubular lower end portion. The interior valve can have an upward conical body with a concentric flap that overlaps the conical body and that pivots from a first closed position to a second open position. When the concentric flap of the interior valve is in the first closed position, the concentric flap overlaps the conical body and a suction force applied to the multi-position valve causes a fluid to flow across a lower surface of a peripheral end of an uppermost portion of the upper frustoconical portion as a sipper. When the concentric flap of the interior valve is in a second open position, the concentric flap is pivoted upward, and interior valve is open such that when the container is tipped upward the fluid flows unimpeded through openings within the interior valve on the conical body.

In some embodiments, collar 120 can include an upper frustoconical portion extending from an upper rim sloping inwardly along a supporting surface having a plurality of protrusions to an intermediate wall, an outer wall extending radially downward a predetermined distance from the intermediate wall, a plurality of threads provided on the outer wall and adapted to fasten the collar to a container, an angular wall extending slopingly downward and inward from the intermediate wall to a tubular wall extending downwardly from the angular wall to a lower wall, a projection formed in the lower wall and extending upwardly to form a neck that extends upward into a bulbous head defining a concentric shoulder and a securing notch onto which a radial lip of an annular seal can be secured, and a plurality of through-holes located throughout the collar adapted to allow a fluid to flow from within the container. In some embodiments, a collar and valve assembly (e.g., collar 120 and valve structure 140) can include a collar and an annular seal. The collar can have an internal frustoconical wall with an open circular upper end that extends downward and inwardly into a closed lower end. The closed lower end can have a projection extending outward from its center. The collar can include a support surface arranged along an inner surface of the open circular upper end, a fastener assembly disposed adjacent to a bottom end of the collar provided to securely fasten to a container, a plurality of passages disposed in the internal frustoconical wall to channel a fluid, and a plurality of protrusions disposed radially adjacent to the support surface defining various channels. The annular seal can have a first frustoconical surface substantially similar to a shape of the internal frustoconical wall, the annular seal having a blind bore recess on a lower surface at its center for receiving and securing onto the projection, and a skirt portion extending from an upper portion of its center, the skirt portion having a hinge adjacent to the upper portion of its center from which the skirt portion pivots into a first closed position and a second open position, wherein the first closed position, fluid flows across the collar and annular seal as s sipper, and wherein second position, the skirt portion is open and fluid flows through openings in the skirt in an unimpeded manner to allow the fluid to flow freely.

In some embodiments, a collar and valve assembly (e.g., collar 120 and valve structure 140) can include a collar and an annular seal. The collar can have an internal frustum shaped wall with an upper open end that extends downward and inward into a closed lower end. The collar can include a projection extending outward and away from the closed lower end, a support surface arranged along an inner surface adjacent to the upper open end, at least one aperture disposed in the internal frustum shaped wall to channel a fluid, and a fastener assembly disposed adjacent to a bottom of the collar provided to securely fasten to a container. The annular seal can have a first surface constructed in a form of a frustum substantially similar to a shape of the internal frustum shaped wall of the collar, the annular seal having an interconnecting portion on a lower surface to be received and secured onto the projection.

FIGS. 18-21 show a plurality of apertures 138 of varying sizes disposed concentrically on the collar 120. The radial apertures 138 create various passageways to allow the fluid in the container 110 to flow out of the container 110 and through the collar 120 into a cavity 119 provided above the apertures 138 and below the lower surface 162*b* of sealing edge 162 of the valve structure 140. Referring back to FIG. 1, at least one air vent aperture 164 is provided in the valve structure 140 to allow the venting of air from the external atmosphere back into the cavity 119 (obscured from view) of container 110. The air vent aperture 164 can function as a one-way air valve. For example, entry of the air from the external atmosphere will allow the pressure within the container 110 to come to an equilibrium state with the pressure outside of the drinking container assembly 100 as the user sucks fluid out from within the container 110. For example, as the user sucks the fluid out of the container, a negative vacuum pressure is created within the drinking container assembly 100 that causes the air from the external environment to be drawn into the container 110 through the air vent aperture 164 and the radial apertures 138. The varying sizes for the apertures 138 allow for the fluid to flow rapidly between the container 110 and across the valve structure 140. Construction of the larger holes allow for more fluid flow when used in a second pour position.

FIGS. 22-26 illustrate a container assembly 200 having a container 210, a collar 220, a valve 240, and a cover 280 with a strap 282. The cover 280 includes a lip 284 that surrounding the upper end of the collar 220 to maintain cleanliness in a sanitary storage position. Container assembly 200 has substantially similar features as drinking container assembly 100 discussed above.

Figure 23:
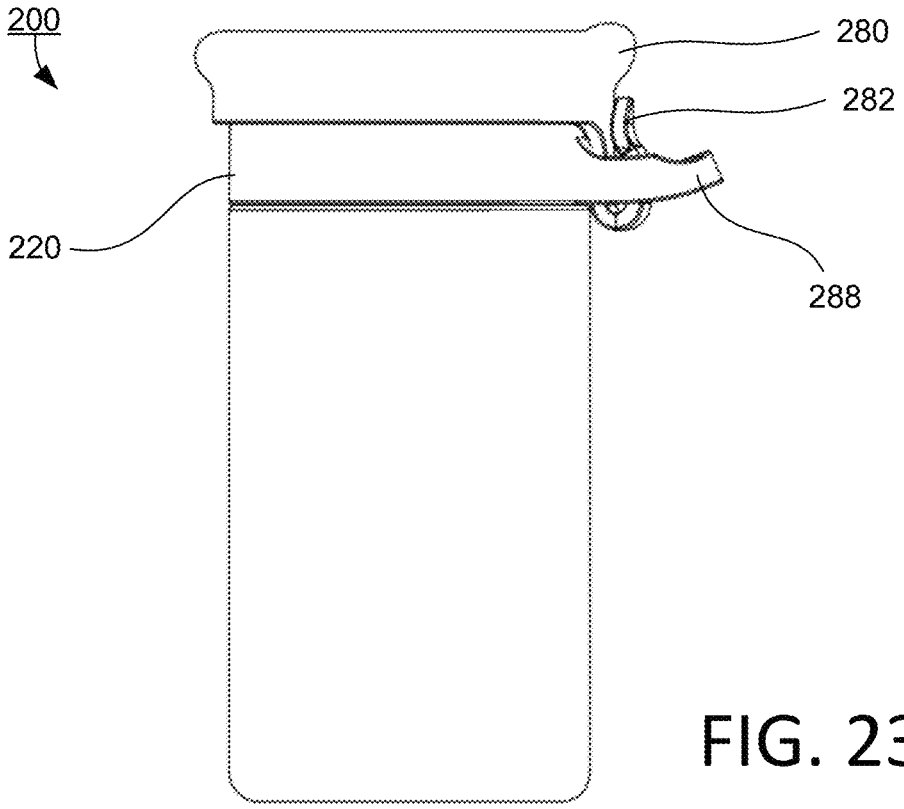
FIG. 23 shows a side view of the exemplary drinking container assembly with a cover in closed storage position.
Figure 24:
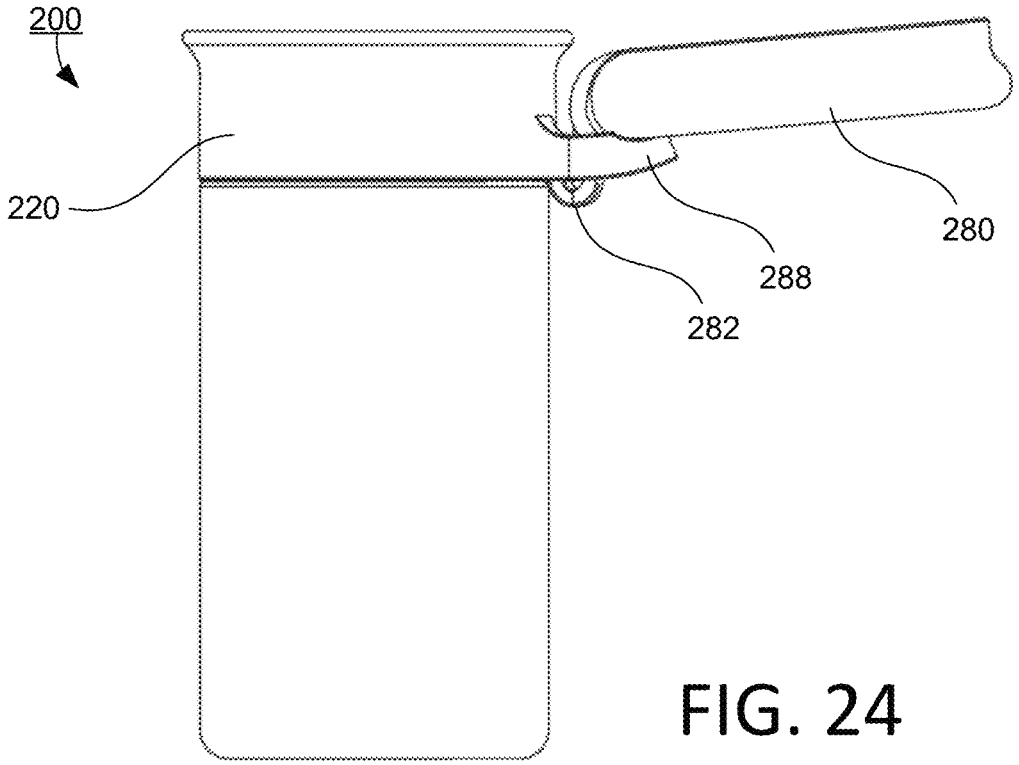
FIG. 24 depicts a side view of the exemplary drinking container assembly with a cover in an open position.
Figure 25:
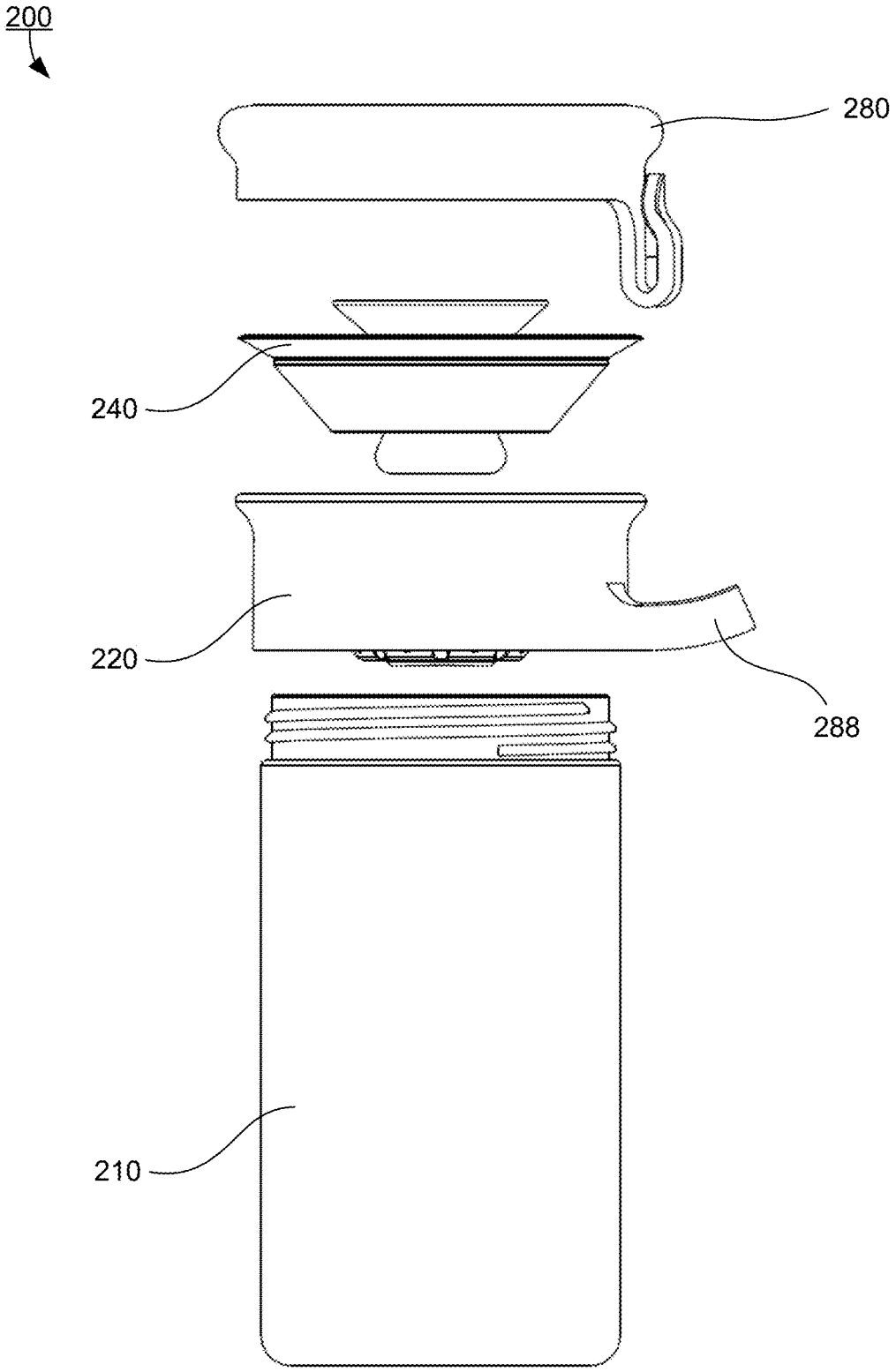
FIG. 25 illustrates an exploded view of the exemplary drinking container assembly.

FIGS. 23 and 24 illustrate use of the cover 280 in an open and closed position. In the open position shown in FIG. 24, the retainer 288 acts as a stop for the cover 280 and the strap 282 when the cover 280 and strap 282 are pivoted to a predetermined opening angle. The retainer 288 may have a contour that matches the shape of the cover 280 and the strap 282 is adapted to safely stop and secure the cover 280 in a predetermined open angle position.

Figure 26:
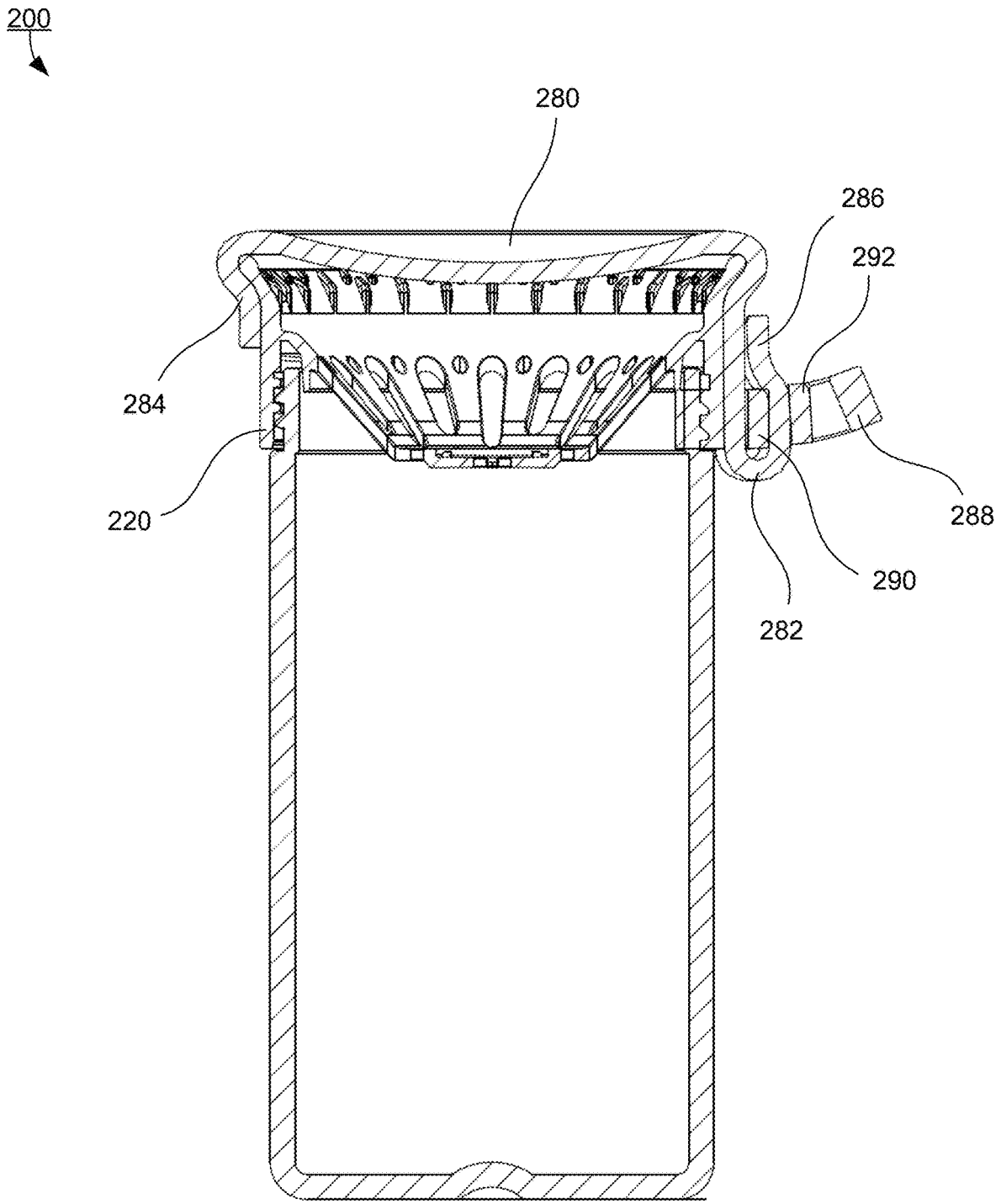
FIG. 26 shows a cross-section view of the exemplary drinking container assembly.

FIG. 26 shows a cross section of container assembly 200. The strap end 286 can be secured to the retainer 288. More specifically, the strap end 286 is fed around an outer wall of the collar 220 and an anchor 290, and then through a space disposed between the anchor 290 and a retaining wall 292 within the retainer 288 to secure the strap 282 in a secured position.

Figure 27:
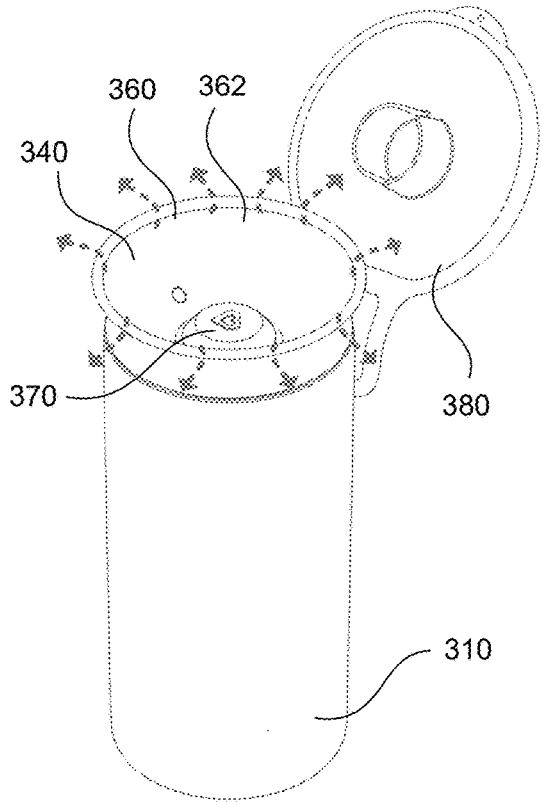
FIG. 27 shows an upper perspective view of the drinking container assembly with an inner flap of the multi-position annular seal in a closed position.
Figure 28:
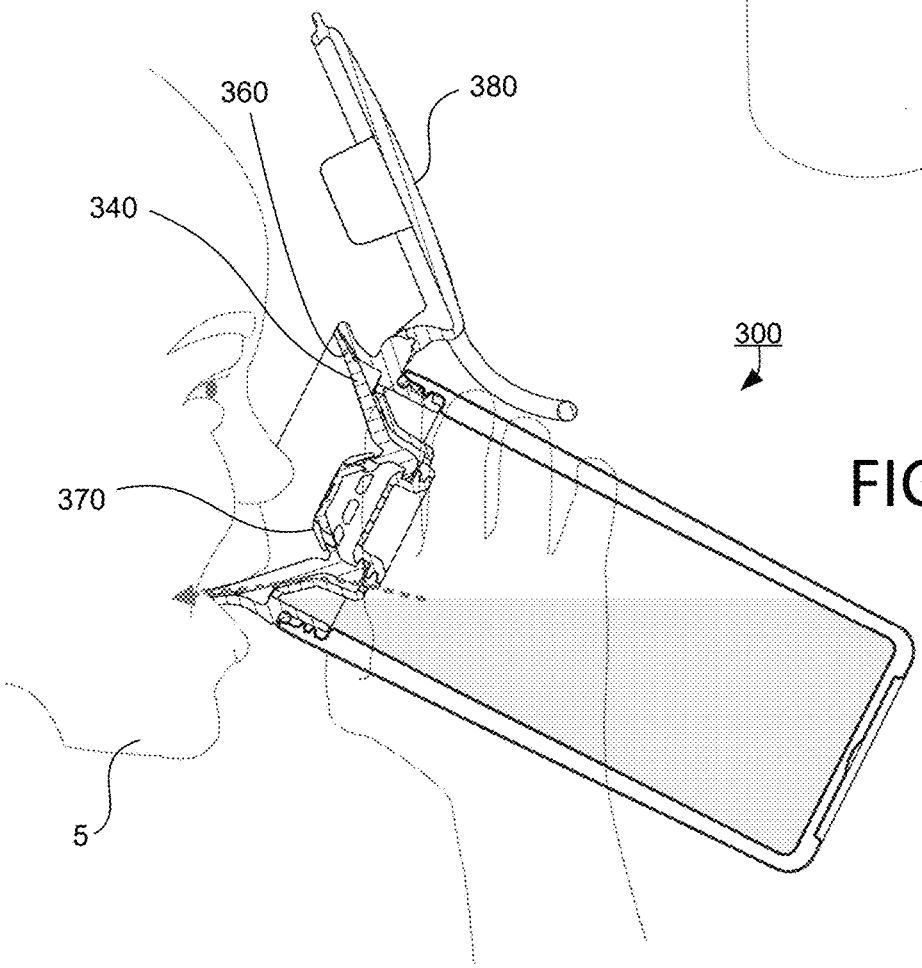
FIG. 28 shows another cross-section embodiment of a drinking container assembly drinking fluid through an outermost lip of a multi-position annular seal.

FIG. 27 and FIG. 28 show another exemplary drinking container assembly 300 having the inner valve 370 in a closed position, such that the drinking fluid can flow through the sealing edge 362 across the outer valve 360 that is lifted under a vacuum suction force created by the user 5. FIG. 28 shows a cross-section of with a user 5 drinking fluid through a scaling edge 362 of a multi-position annular seal 340. Similar features and functionality mimic the various other embodiments described herein. The multi-position annular seal 340 has an outer valve 360 and an inner valve 370.

Figure 29:
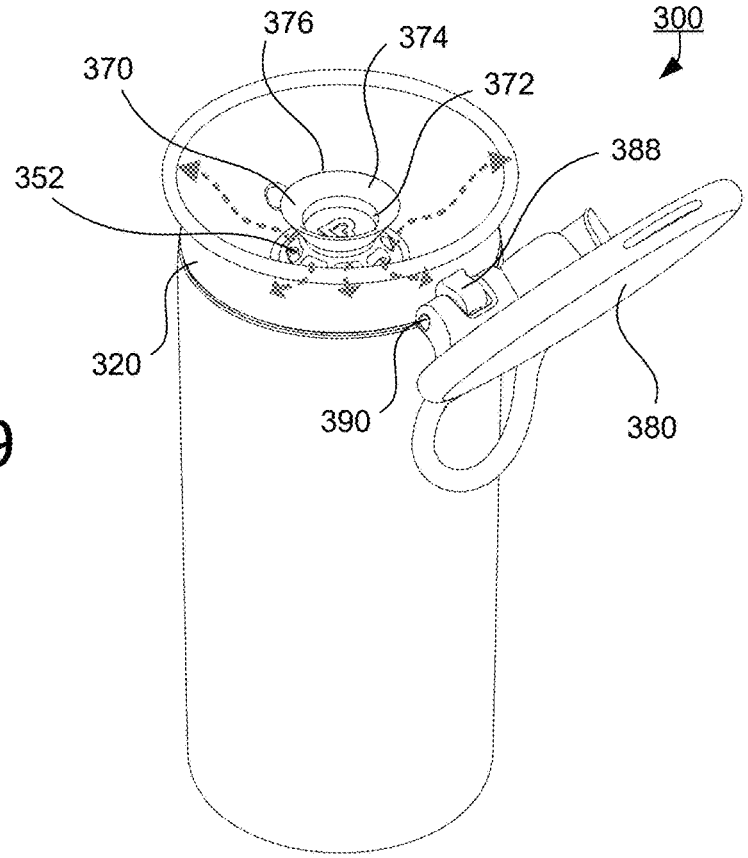
FIG. 29 shows an upper perspective view of the drinking container assembly with an inner flap of the multi-position annular seal in an open position.
Figure 30:
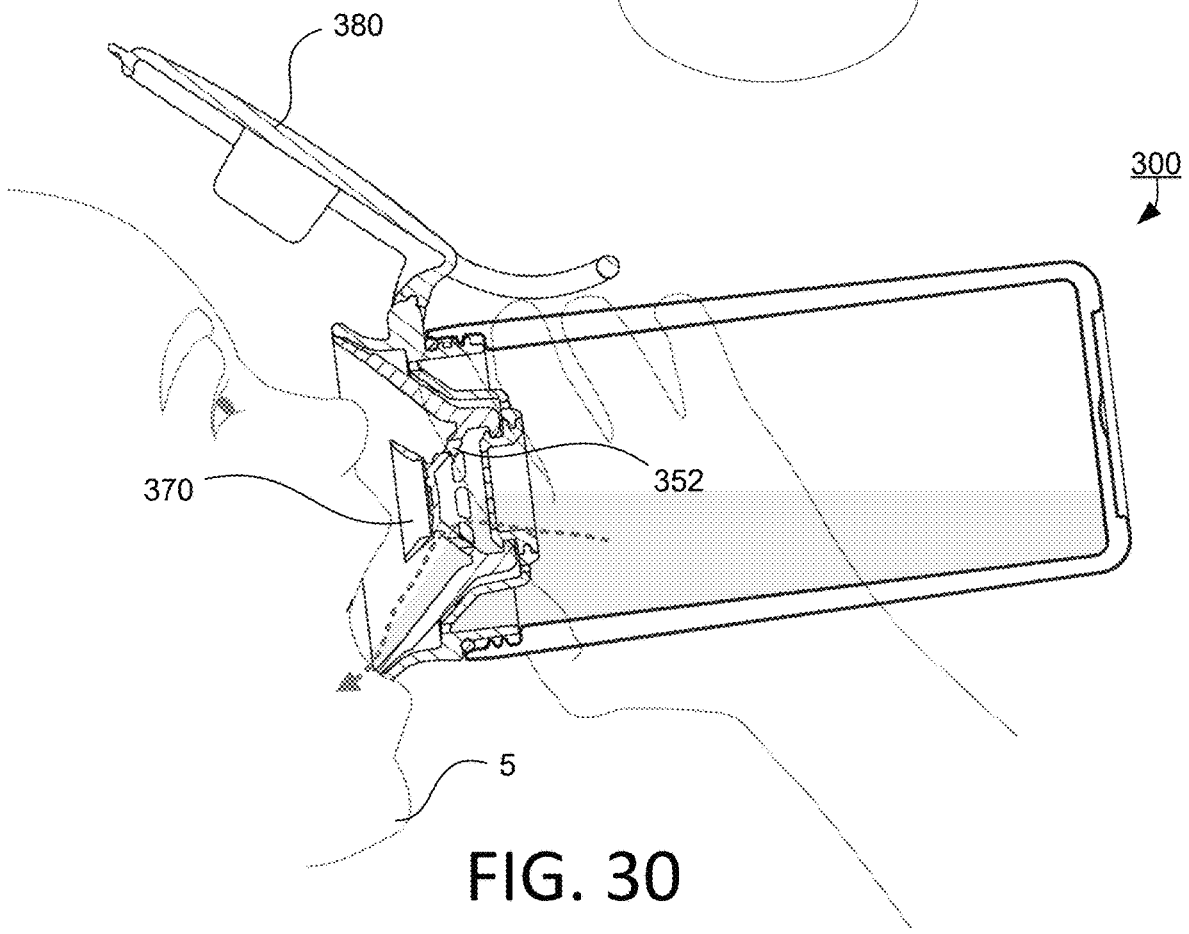
FIG. 30 shows another cross-section embodiment of the drinking container assembly drinking fluid through an innermost lip of the multi-position annular seal.

FIG. 29 and FIG. 30 show the inner valve 370 in an open position, such that simply tipping the drinking container assembly 300 back allows the fluid to pour from within the container 310 through the apertures 352 and into the users 5 mouth. FIG. 30 shows a cross-section of drinking container assembly 300 with a user 5 drinking fluid through apertures 352 disposed within the inner valve 370. The inner valve 370 is in an open position and the drinking fluid is allowed to pour through the apertures 352 unimpeded. No sucking force by the user 5 is required to drink the fluid.

Figure 31:
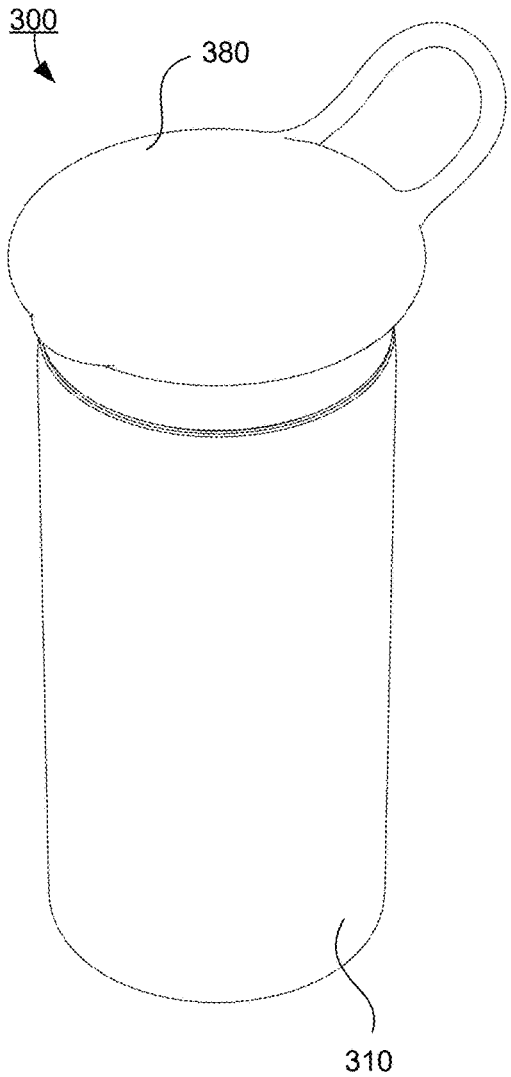
FIG. 31 illustrates an upper perspective view of the drinking container assembly.
Figure 32:
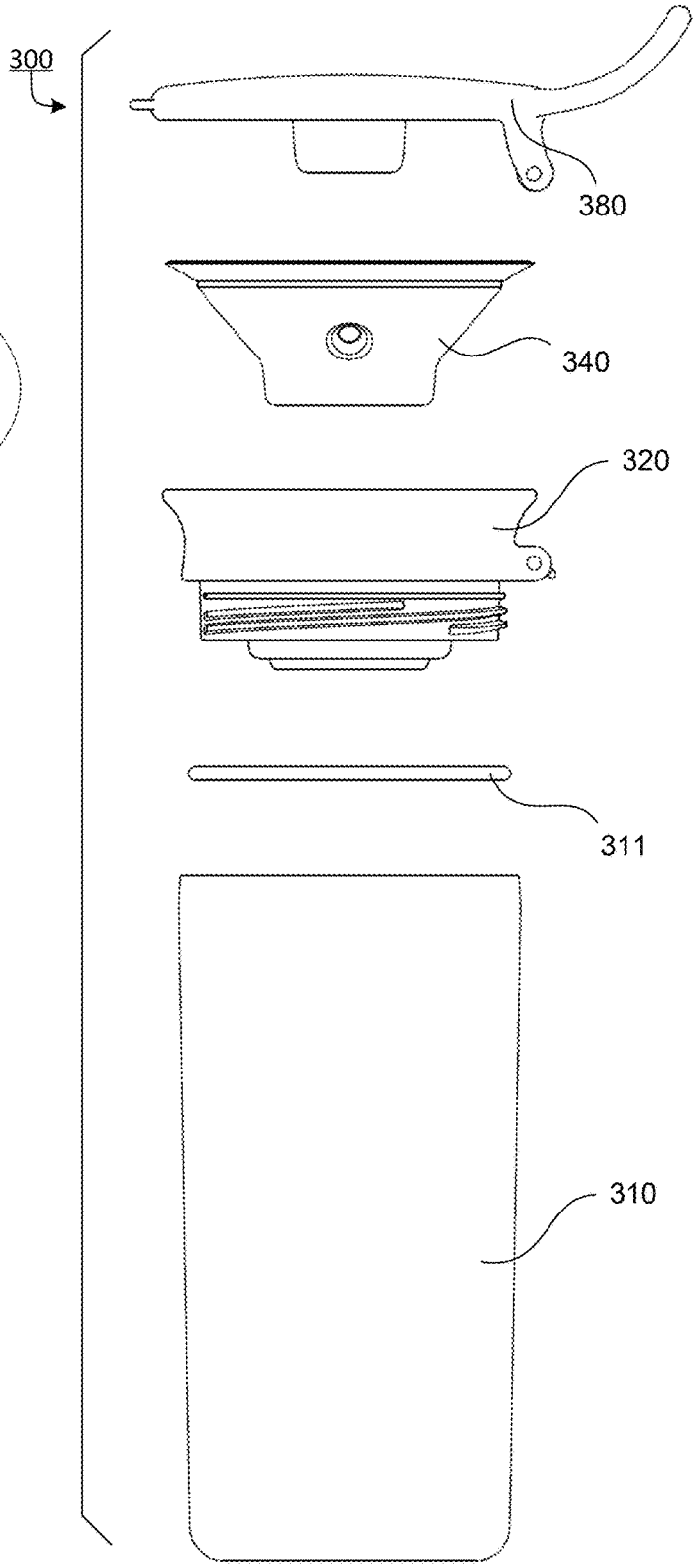
FIG. 32 depicts an exploded view of the drinking container assembly.

FIG. 31 shows an upper perspective view of the drinking container assembly 300 and FIG. 32 depicts an exploded view of the drinking container assembly 300. In FIG. 32, the drinking container assembly 300 includes a lid 380, a multi-position annular seal 340, a collar 320, a resilient sealing ring 311 and a container 310.

Figure 34:
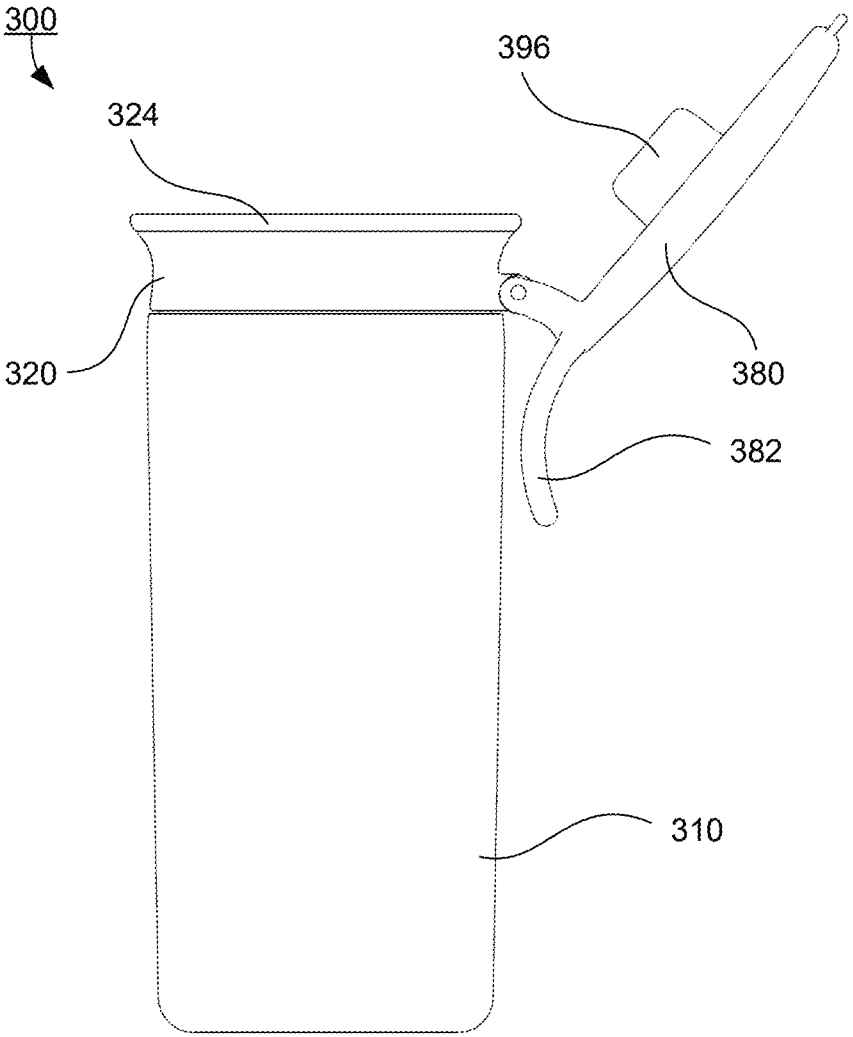
FIG. 34 shows a side view of the drinking container assembly with the lid open.
Figure 33:
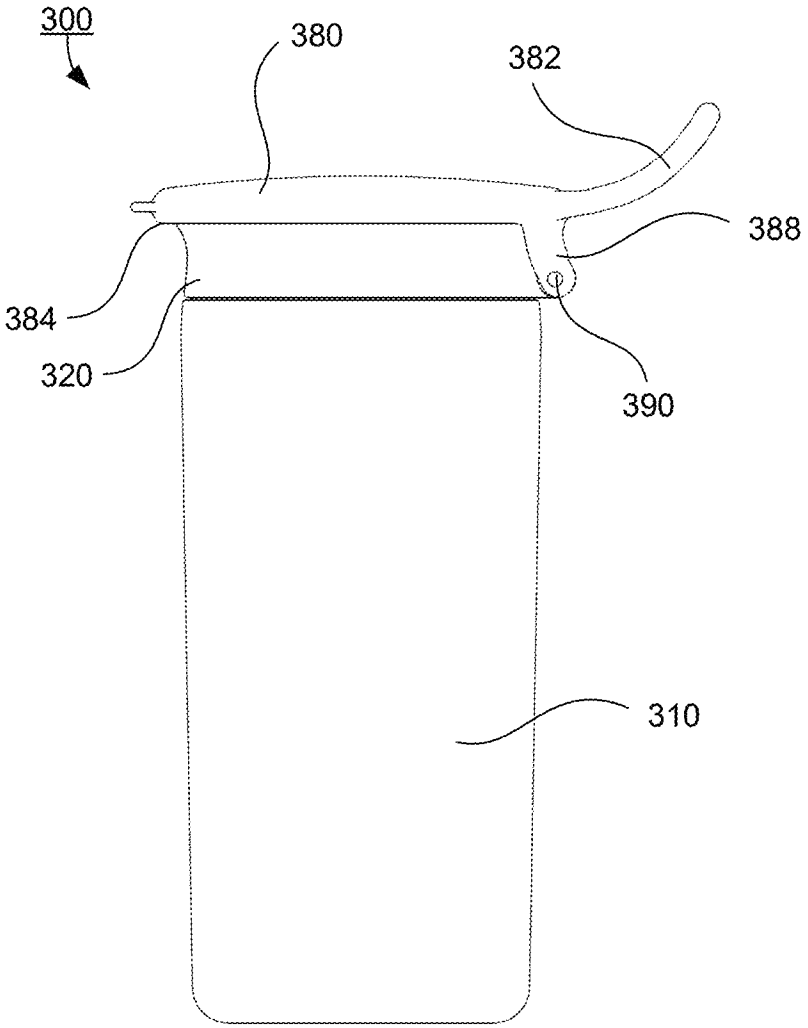
FIG. 33 shows a side view of the drinking container assembly with a lid closed.

FIG. 33 and FIG. 34 illustrate the lid 380 of the drinking container assembly 300 in a closed and an open configuration, respectively. Lid 380 pivots about hinge 388 to switch between the closed and open configurations.

Figure 35:
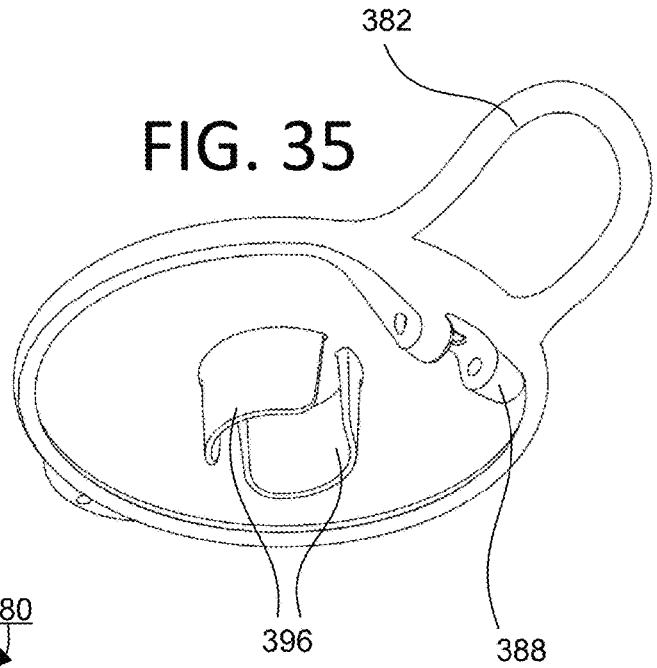
FIG. 35 is a lower perspective view of the lid.
Figure 36:
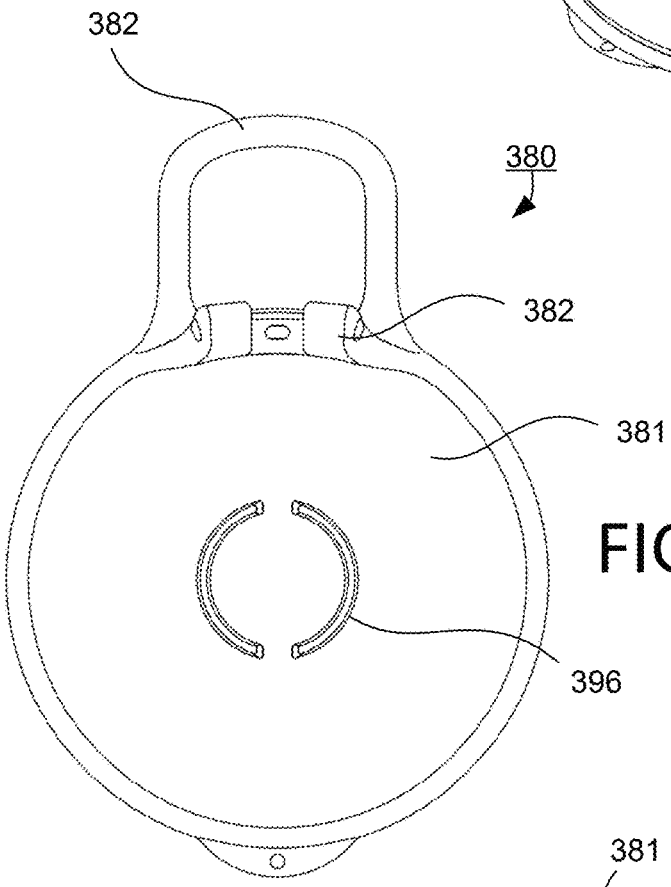
FIG. 36 is a bottom view of the lid.
Figure 37:
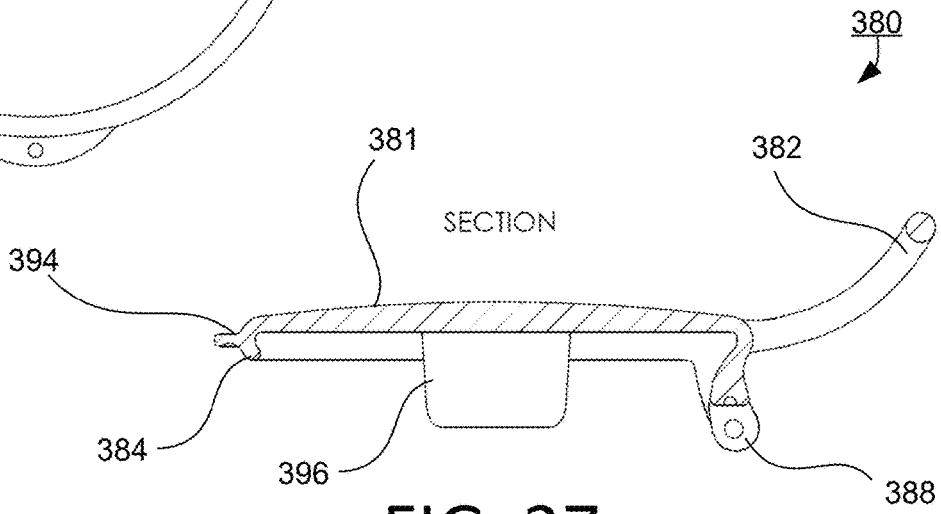
FIG. 37 is a side cross section view of the lid.

FIGS. 35-37 depict the lid 380 detached from drinking container assembly 300 and in more detail. The lid 380 includes a cover portion 381, a tab 394, a plunger 396 and a strap 382. As shown, a lip 384 is provided around cover portion 381 and turns downward around an outer periphery of the lid 380 over the cover portion 381. In use, the lip 384 is adapted to encircle and seal an upper rim 324 of the collar 320, thereby closing off the sealing edge 362 of the outer valve 360 of the multi-position annular seal 340 and the flow of fluid flow therethrough.

A hinge 388 is constructed at one end of the lid 380. The hinge 388 is adapted to rotationally pivot around lid 380 about the collar 320 as shown in FIG. 29. A pin 390 is axially provided through the hinge 388 and a hinge 388*a* disposed on collar 320 rotationally connecting the hinge 388 to the hinge 388*a* of collar 320. With the pin 390 installed, the lid 380 can rotate between a closed position as shown in FIG. 33 and an open position as shown in FIG. 34. In assembly, the hinge 388 is attached to the pin 390 that is secured to the collar 320 (e.g., on hinge 388*a*).

A strap 382 is provided adjacent to the hinge 388. Strap 382 extends from the lid 380 and is constructed in the shape of a loop. It is to be understood that the strap 382 may take a variety of different shapes, sizes and constructions according to this subject disclosure. Likewise, the material of the strap 382 may be a rigid or flexible material for a variety of different uses. As shown in FIG. 28 and FIG. 30, the strap 382 may act as a backstop, thereby limiting the rotation of the lid 380 when in a fully open position.

A tab 394 is constructed at another end of the lid 380. The tab 394 is adapted to be used to lift the lid 380 off of the upper rim 324 of the collar 320 during use. A user may use their finger to engage the tab 394 and lift the lid 380, causing it to rotate about the hinge 388 off of the collar 320.

In use, the plunger 396 of the lid 380 is adapted to push the sealing flap 374 of inner valve 370 into a closed position. For example, scaling flap 374 can pivot using hinge 372 downwards to the closed position. The plunger 396 extends a predetermined distance downwards from a bottom surface of the cover portion 381 to press against and close the inner valve 370.

Figure 38:
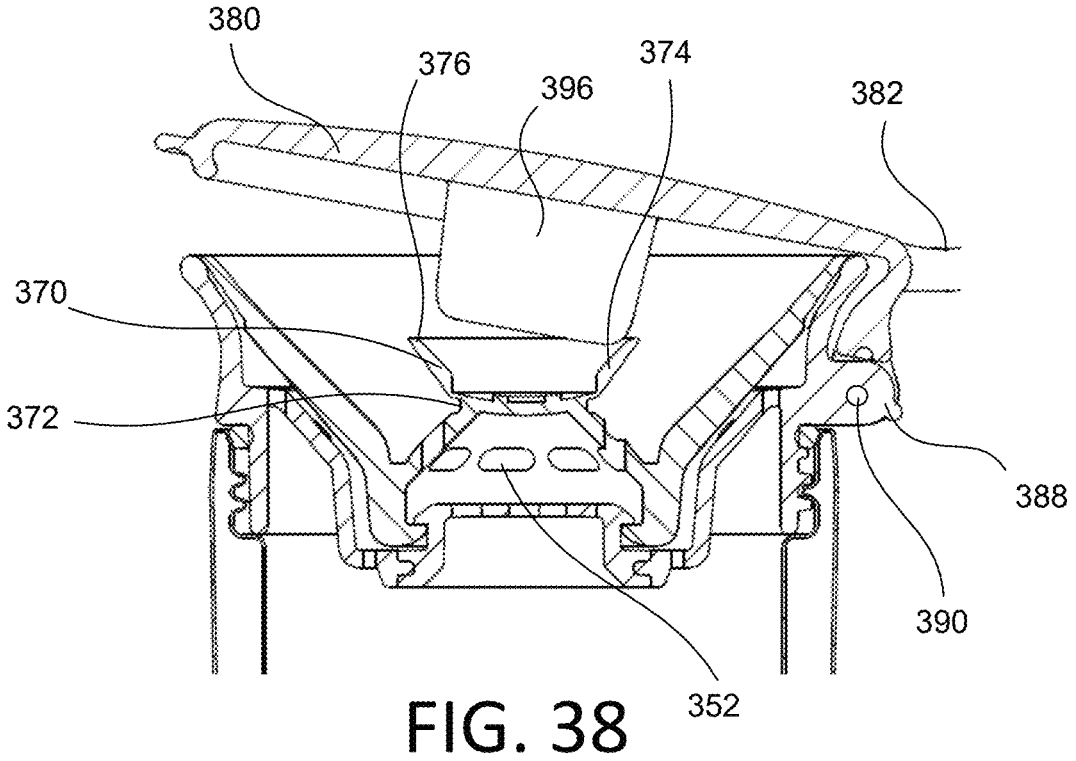
FIG. 38 is a partial cross-section view of the annular seal attached to the collar with the inner flap of the annular seal in an open position about to be engaged by a plunger on the lid.
Figure 39:
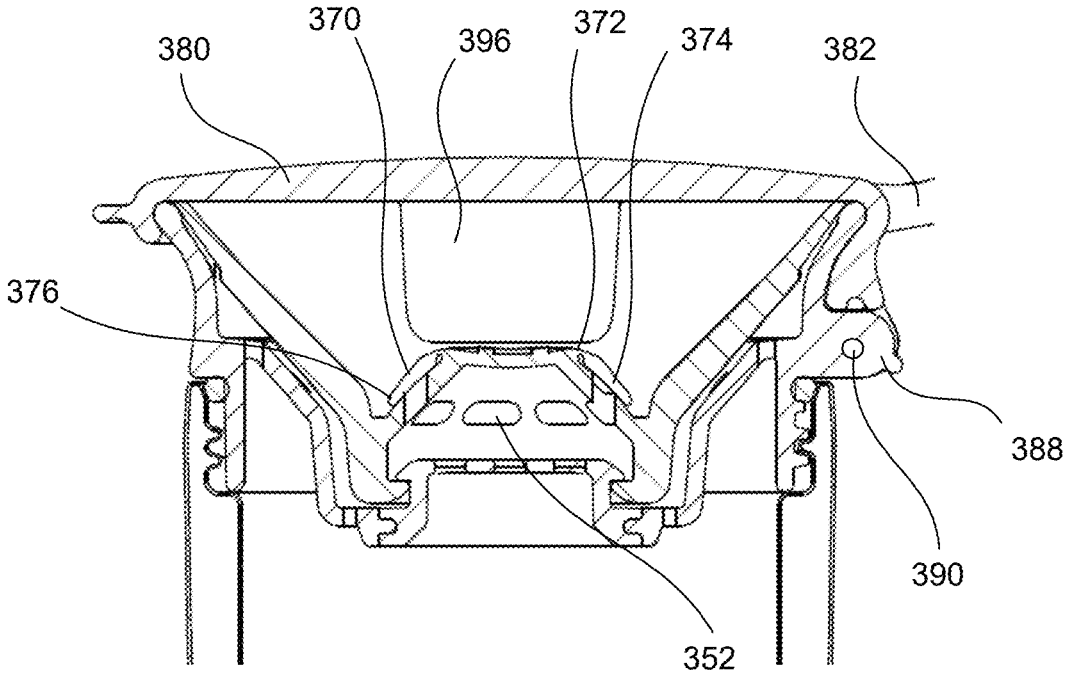
FIG. 39 is a partial cross-section view of the annular seal attached to the collar with the inner flap of the annular seal in a closed position, closed by engagement of the plunger on the lid.

FIG. 38 and FIG. 39 illustrate the closure of the lid 380 onto the upper rim 324 of the collar 320. More specifically, FIG. 38 demonstrates an intermediate position as the lid 380 is closed onto collar 320, while FIG. 39 demonstrates a closed position having lid 380 disposed on collar 320. As lid 380 is closed onto the upper rim 324 of the collar 320, the inner valve 370 of the multi-position annular seal 340 is closed by the plunger 396, which extends from a bottom surface of the lid 380. An end of the plunger 396 pushes against the concentric flange or sealing flap 374 of the inner valve 370 thereby closing the inner valve 370. A peripheral edge 376 of sealing flap 374 can abut against skirt wall 350, thereby blocking apertures 352.

Figure 40:
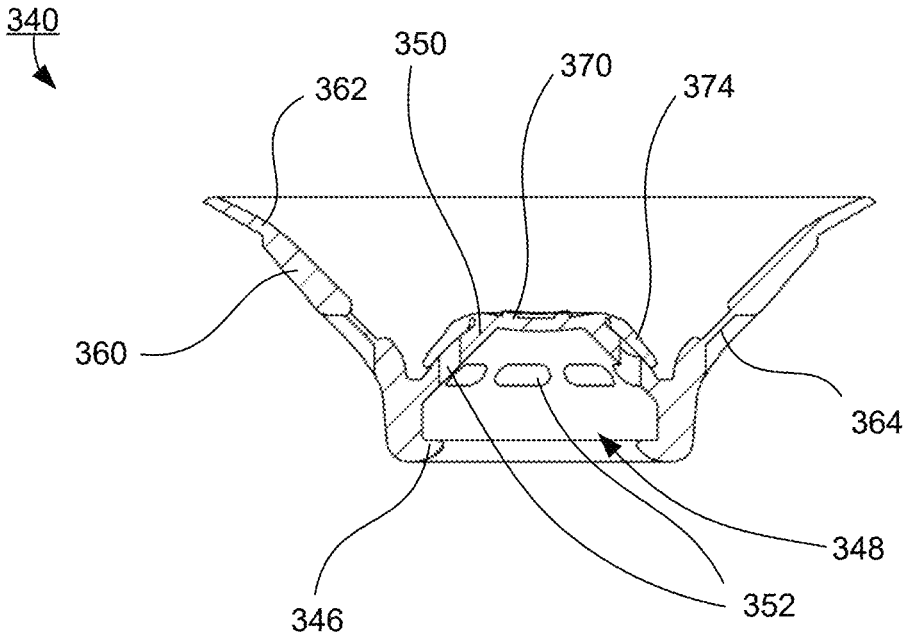
FIG. 40 shows a partial cross-section view of the annular seal attached to the collar with the inner flap of the annular seal in a closed position.

FIG. 40 shows the multi-position annular seal 340 with the sealing flap 374 of the inner valve 370 in the closed position and the apertures 352 closed off such that fluid is not permitted to flow through the inner valve 370. The multi-position annular seal 340 has an upper frustoconical body 344 shape that narrows into a tubular body 345 shape. As described above, the multi-position annular seal 340 has a sealing edge 362 disposed at its upper peripheral edge.

Figure 41:
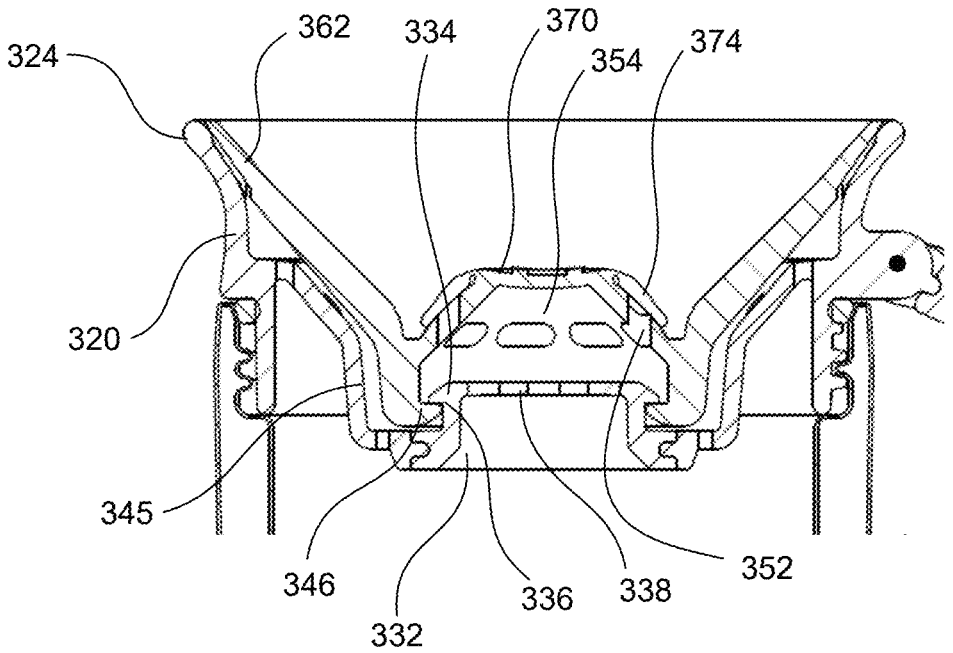
FIG. 41 depicts a cross-section view of the multi-position annular seal in a closed position.
Figure 44:
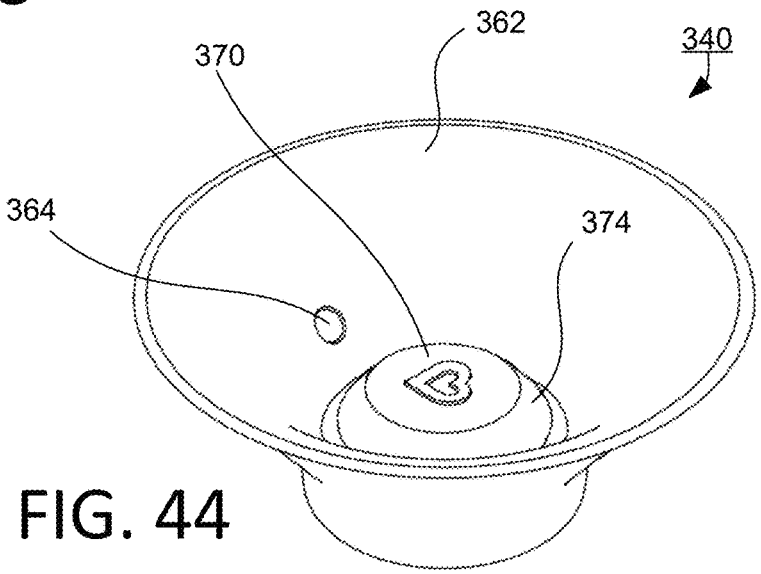
FIG. 44 is an upper perspective view of the multi-position annular seal in a closed position.
Figure 45:
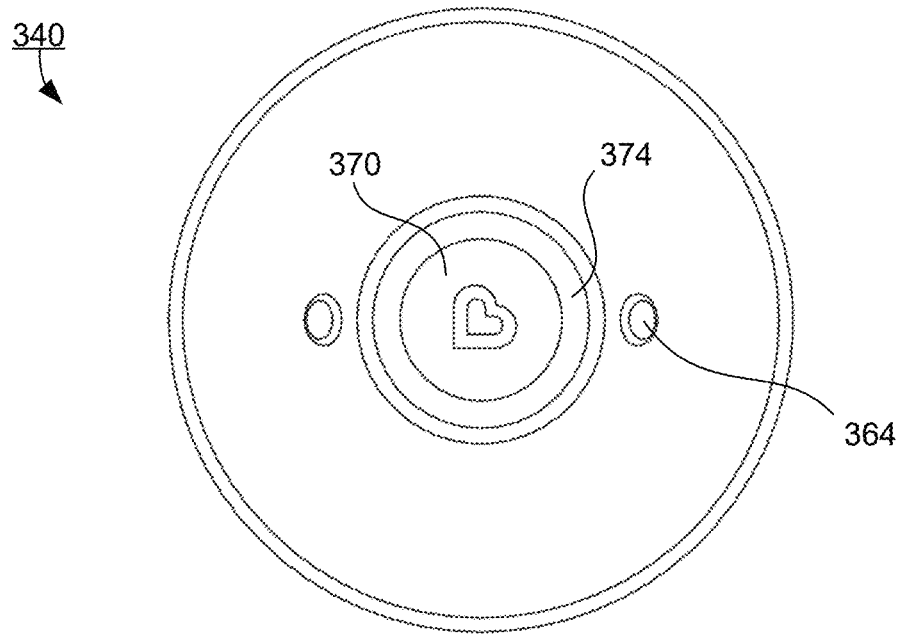
FIG. 45 is a top view of the multi-position annular seal in a closed position.
Figure 46:
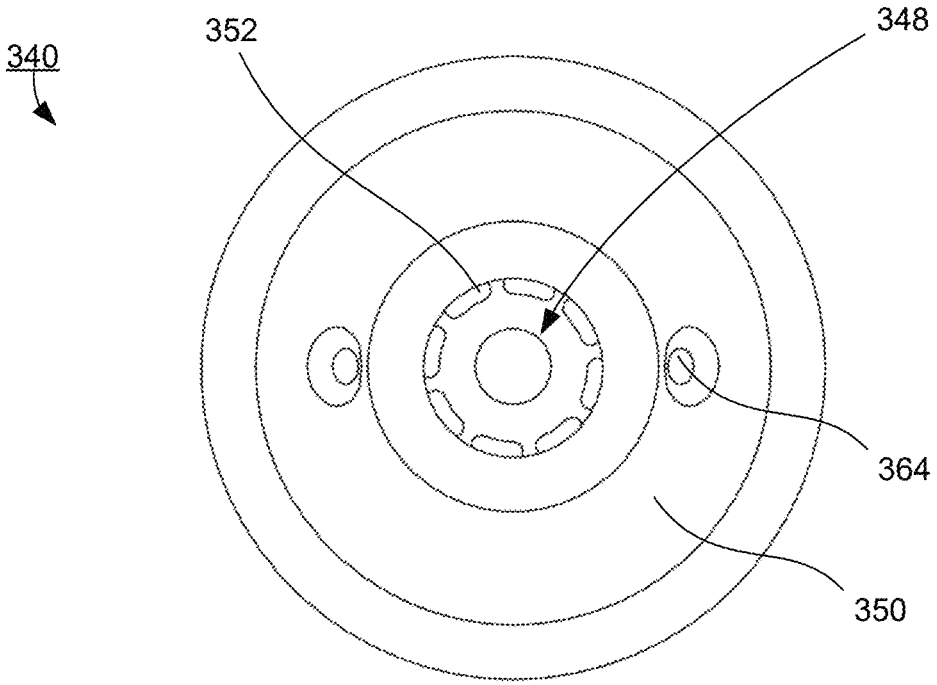
FIG. 46 is a bottom view of the multi-position annular seal.

FIG. 41 shows a partial cross-section view of the multi-position annular seal 340 attached to the collar 320 with a sealing flap 374 of the inner valve 370 in a closed position against a skirt wall 350. FIGS. 42-46 respectively show a lower perspective view, a side view, an upper perspective view, a top view, and a bottom view of the multi-position annular seal 340 having inner valve 370 in the closed position. When inner valve 370 is in this closed position, apertures 352 that are disposed in the skirt wall 350 are closed off and fluid is not allowed to flow through the inner valve 370. FIGS. 41 and 44 show the scaling flap 374 overlapping the apertures 352 disposed in the skirt wall 350 when the multi-position annular seal 340 is in the closed position.

Figure 42:
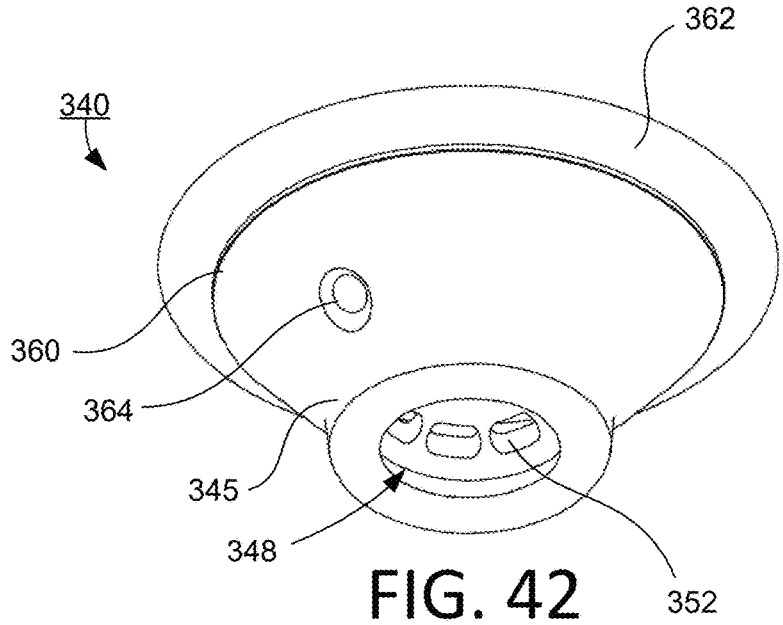
FIG. 42 shows a lower perspective view of the multi-position annular seal.
Figure 43:
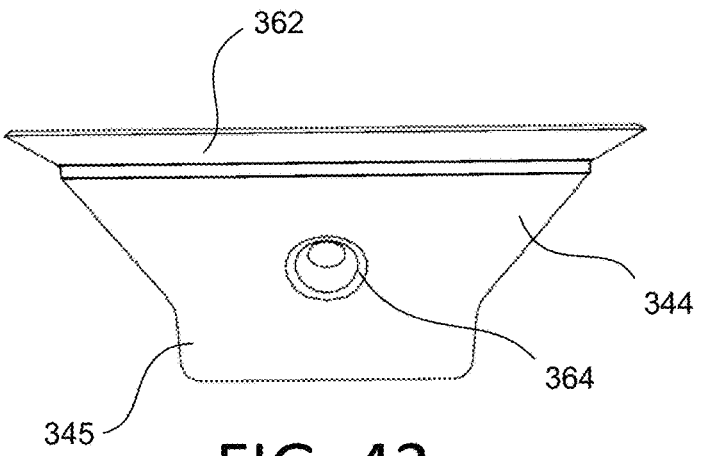
FIG. 43 is a side view of the multi-position annular seal.

As shown in FIGS. 40-42, a recess 348 is constructed in the lower tubular body 345 adapted to receive a projection 332 extending from the lower end of the collar 320 as shown in FIG. 40. The recess 348 includes a narrowing radial lip 346 adapted to be secured to a concentric shoulder 336 defined on projection 332. In assembly, a gap 354 is provided in an area between the multi-position annular seal 340 and the upper end of the projection 332. The gap 354 and resilient material thickness of the inner valve 370 within the multi-position annular seal 340 is provided to allow the sealing flap 374 of the inner valve 370 to have the flexibility to move between the open and closed position.

One way air valves 364 are provided in the multi-position annular seal 340 to moderate the vacuum pressure built up within the multi-position annular seal 340 when the user applies a vacuum suction to the multi-position annular seal 340.

Figure 47:
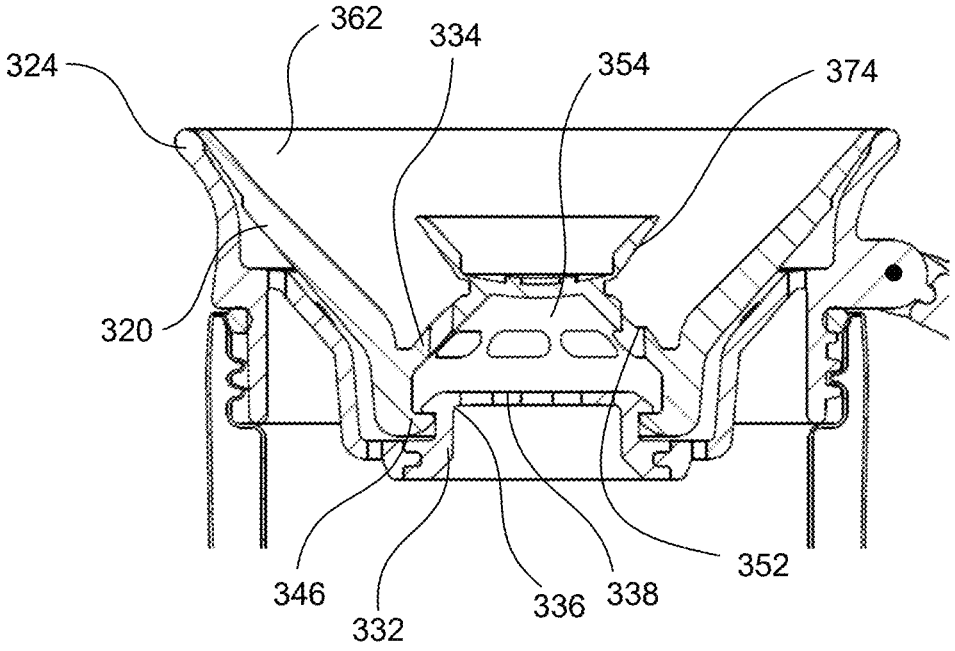
FIG. 47 shows a partial cross-section view of the annular seal attached to the collar with the inner flap of the annular seal in an open position.

FIG. 47 shows a partial cross-section view of the multi-position annular seal 340 attached to the collar 320 with a sealing flap 374 of the inner valve 370 in an open position. In this open position, apertures 352 in the skirt wall 350 are opened up and fluid is allowed to flow through the inner valve 370 to the mouth of a user 5.

Figure 48:
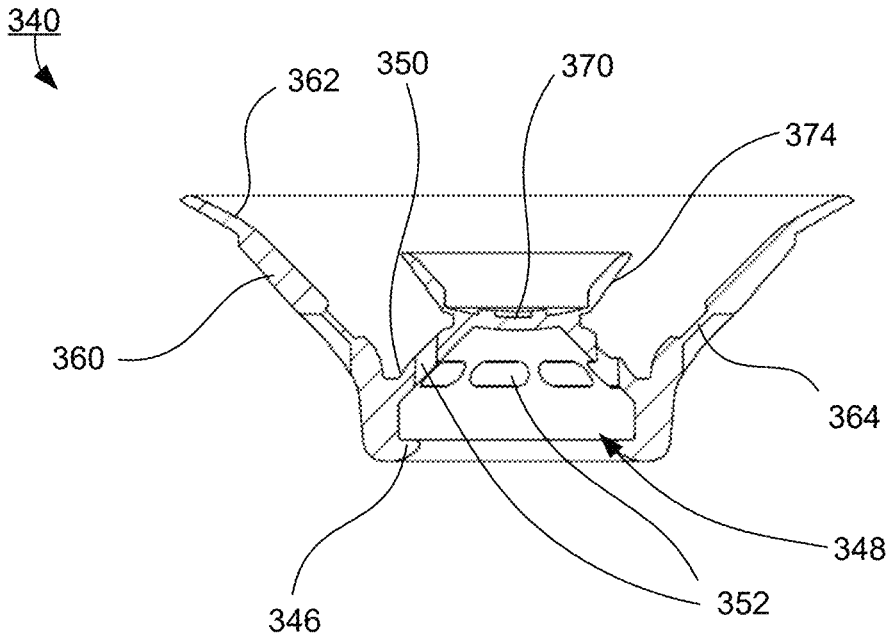
FIG. 48 depicts a side cross-section view of the multi-position annular seal in an open position.
Figure 49:
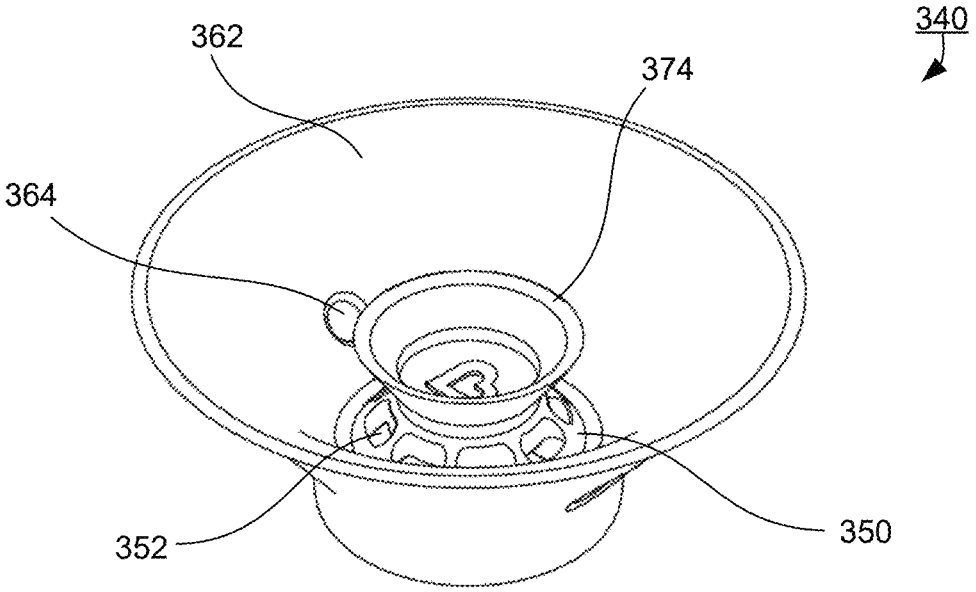
FIG. 49 is an upper perspective view of the multi-position annular seal in an open position.
Figure 50:
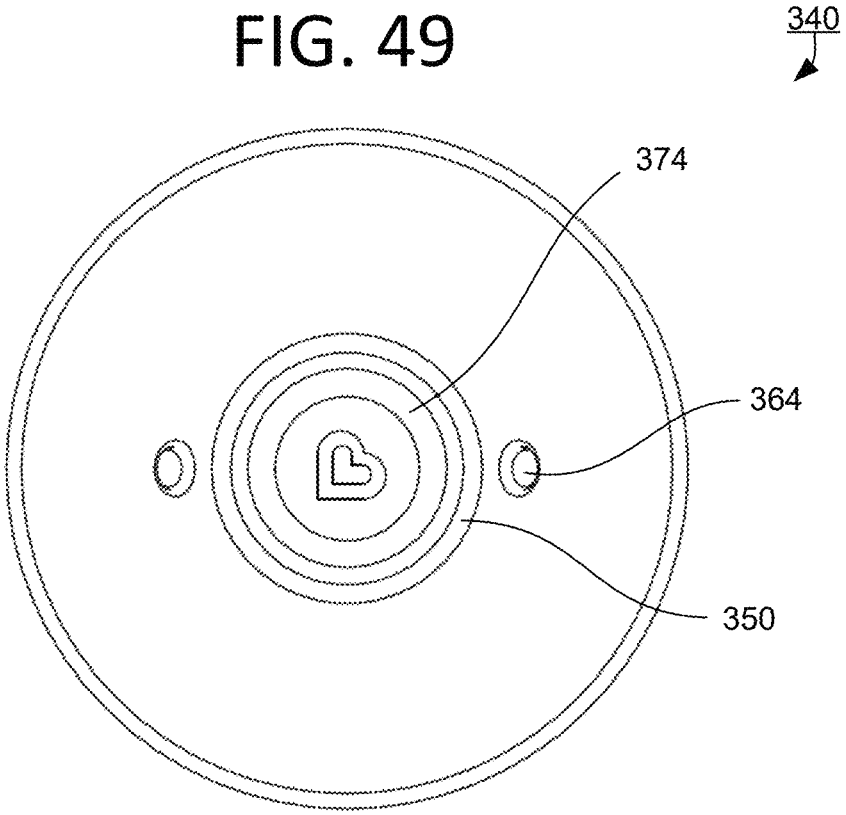
FIG. 50 is a top view of the multi-position annular seal in an open position.

FIG. 48 shows the multi-position annular seal 340 with the sealing flap 374 of the inner valve 370 in the open position and the apertures 352 in the skirt wall 350 are unobstructed such that fluid is permitted to flow through the inner valve 370 and the body of the multi-position annular seal 340. As shown in FIGS. 48-50, the sealing flap 374 is flipped upward and away from the skirt wall 350 and the inner valve 370. The apertures 352 are exposed and fluid is allowed to flow unimpeded through the skirt wall 350 to the user 5.

Figure 51:
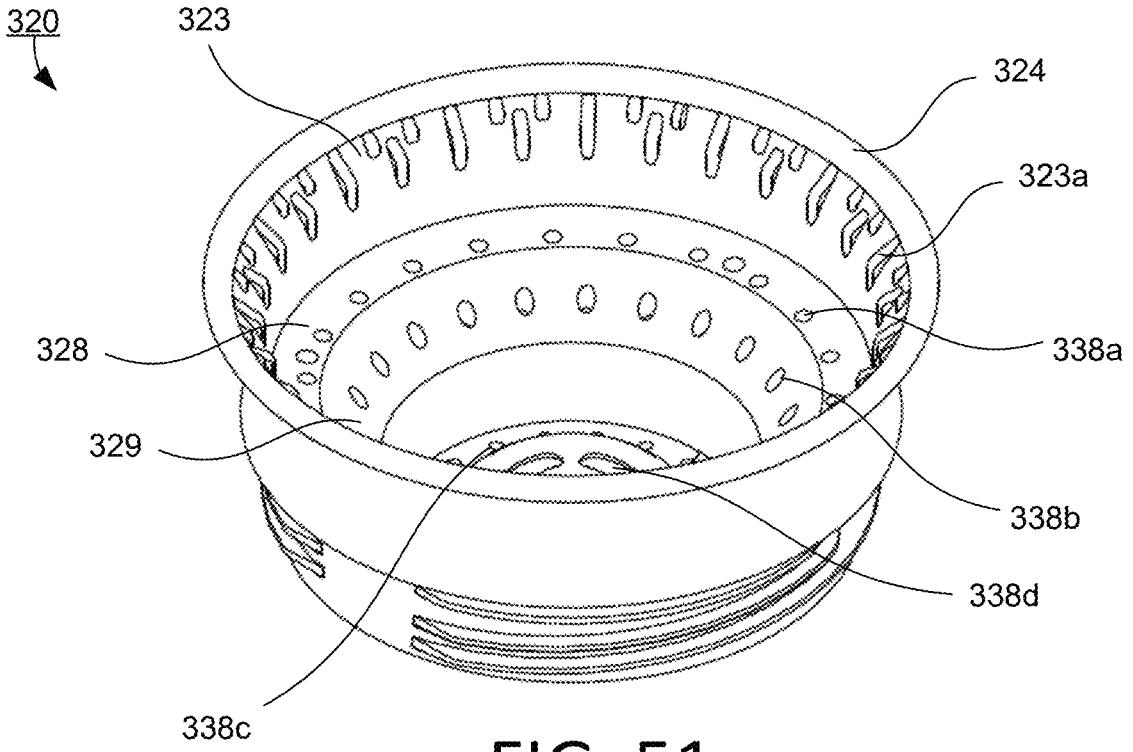
FIG. 51 is an upper perspective view of the collar.
Figure 52:
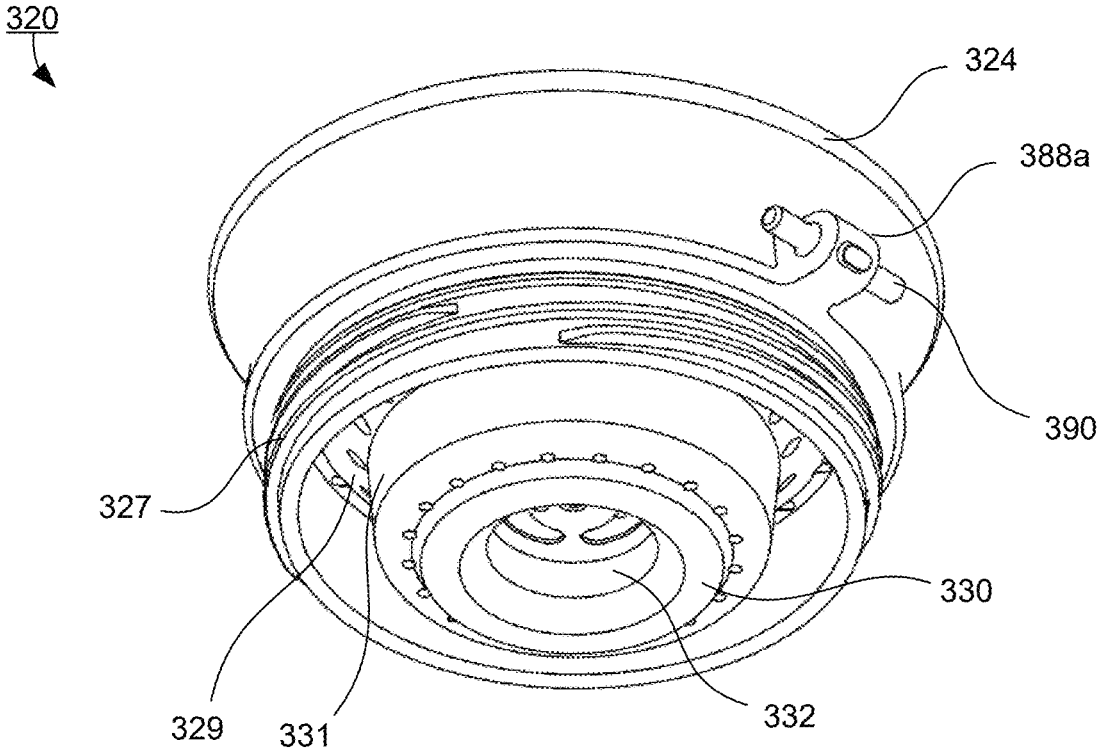
FIG. 52 is a lower perspective view of the collar.
Figure 53:
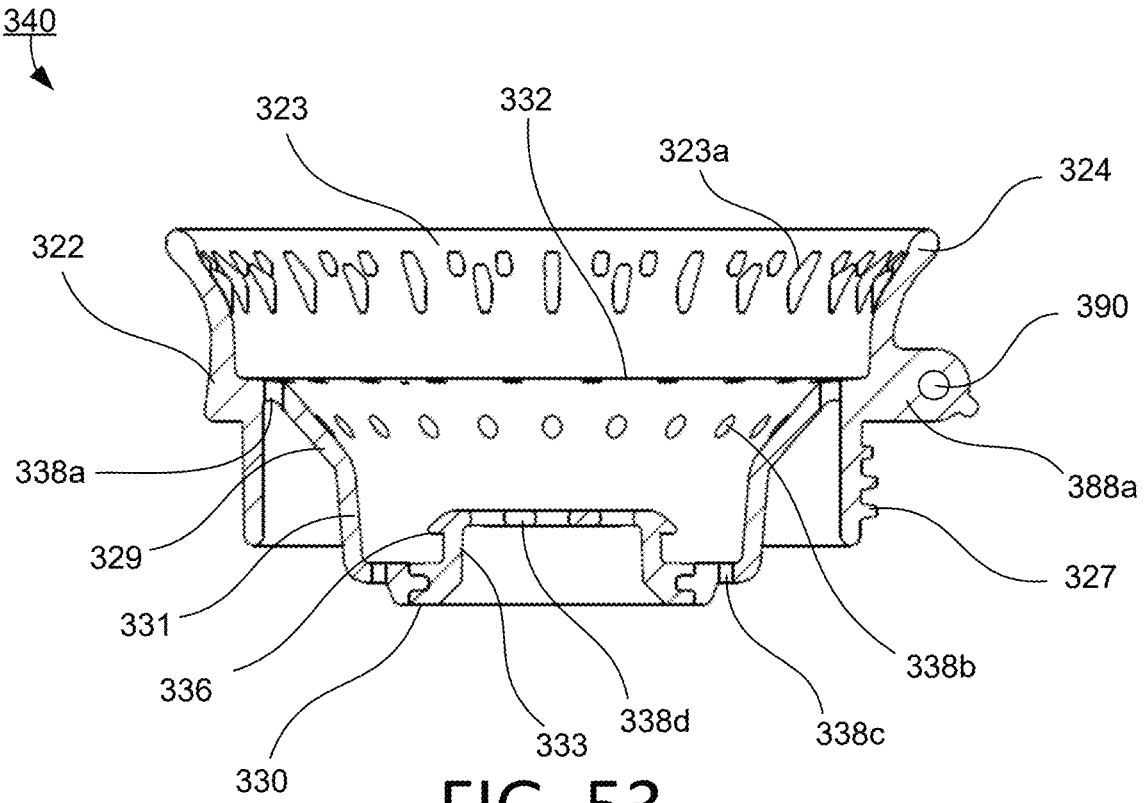
FIG. 53 is a side cross section view of the collar.
Figure 54:
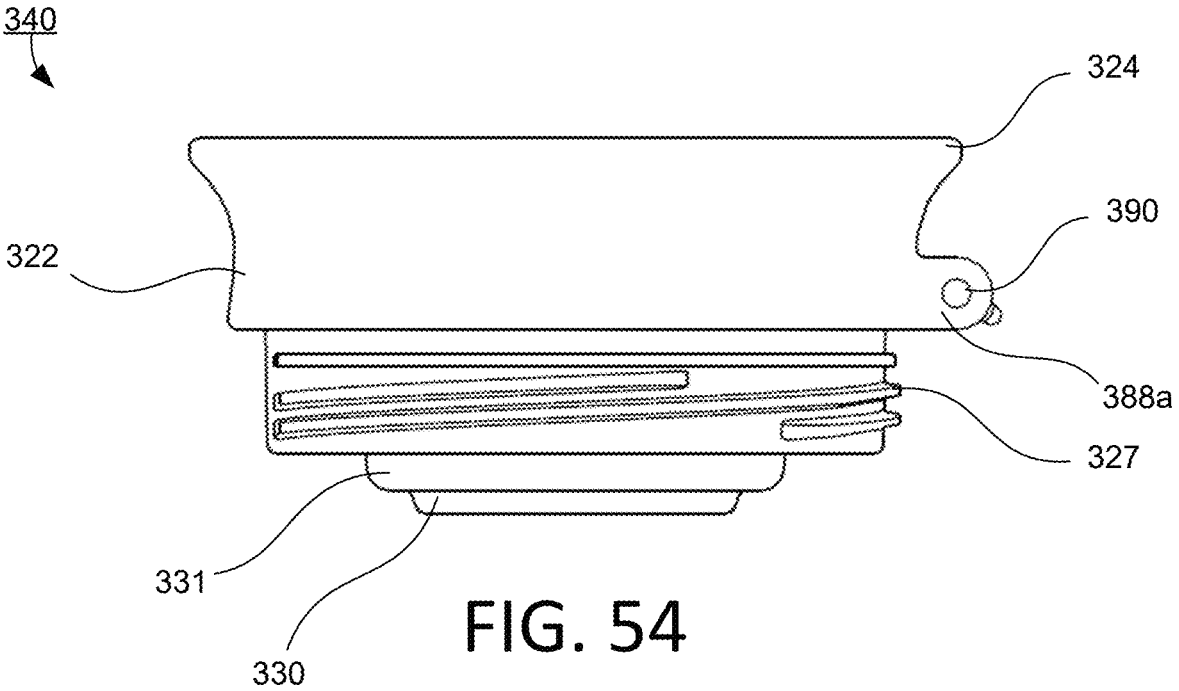
FIG. 54 is a side view of the collar.
Figure 55:
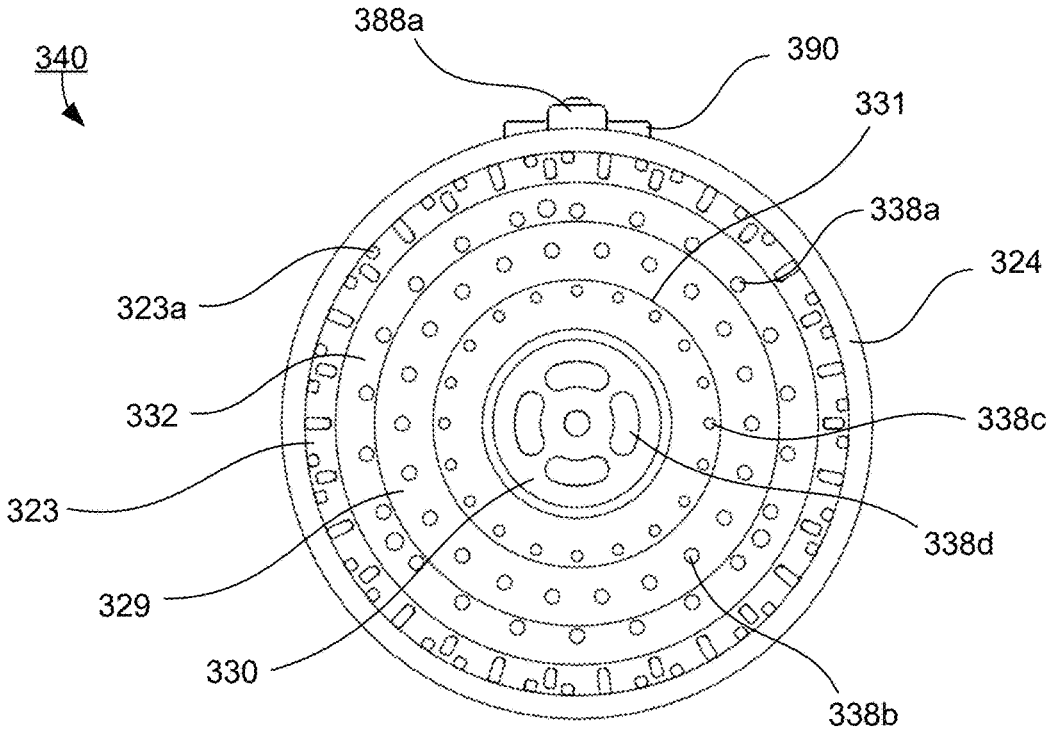
FIG. 55 is a top view of the collar.
Figure 56:
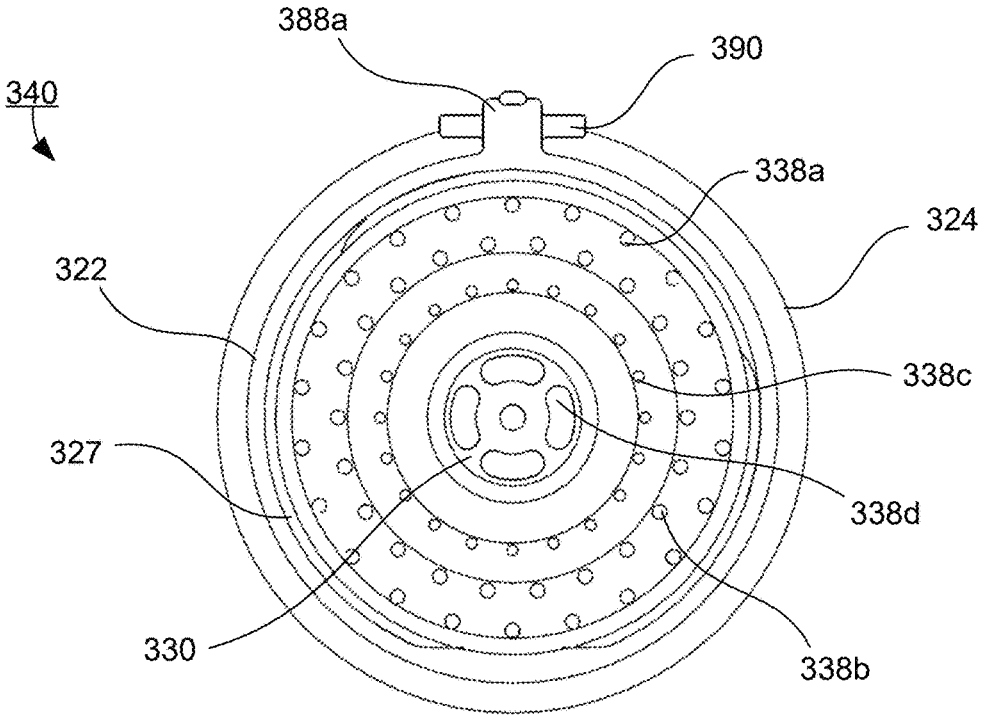
FIG. 56 is a bottom view of the collar.

FIGS. 51-56 depict various views of the collar 320. In particular, FIG. 51 to FIG. 52 illustrate upper and lower perspective views of the collar 320. FIG. 53 is a side cross section view of the collar 320, and FIGS. 54-56 are side, top, and bottom views of the collar 320, respectively.

Referring to FIG. 53, the collar 320 is shown to have an upper frustoconical portion and a tubular lower end portion.

The upper frustoconical portion begins at the upper rim 324, declining along a supporting surface 323 including a plurality of protrusions 323*a*. The supporting surface 323 slopes downward and inwardly to an intermediate wall 328. A plurality of apertures 338 are provided radially along the intermediate wall 328. An outer wall 322 extends radially downward from the intermediate wall 328 a predetermined distance. A plurality of threads 327 are provided on the a lower end of collar 320 and are operable to fasten collar 320 to the container 310. An angular wall 329 also extends from the intermediate wall 328 downward and inwardly to a tubular wall 331 portion. The tubular wall 331 extends downwardly from the angular wall 329 to a lower wall 330.

The projection 332 extends upwardly from the lower wall 330 and into the collar 320. The projection 332 has a neck 333 that extends upward into a bulbous head 334 defining a concentric shoulder 336 having a securing notch onto which the radial lip 346 of the valve structure 140 can be secured onto as shown in FIG. 40.

A plurality of through-holes or apertures 338 can be located throughout the collar 320. For example, a first set of apertures 338*a* may be provided in the intermediate wall 328, a second set of apertures 338*b* may be provided in the angular wall 329, third set of apertures 338*c* may be provided in the lower wall 330, and a fourth set of apertures 338*d* may be provided in a projection upper wall of the projection 332. All of the apertures 338 are adapted to allow the flow of a fluid contained within the container 310 when the multi-position annular seal 340 is in different positions. The apertures can take a variety of different sizes and shapes according to this subject disclosure.

Figure 57:
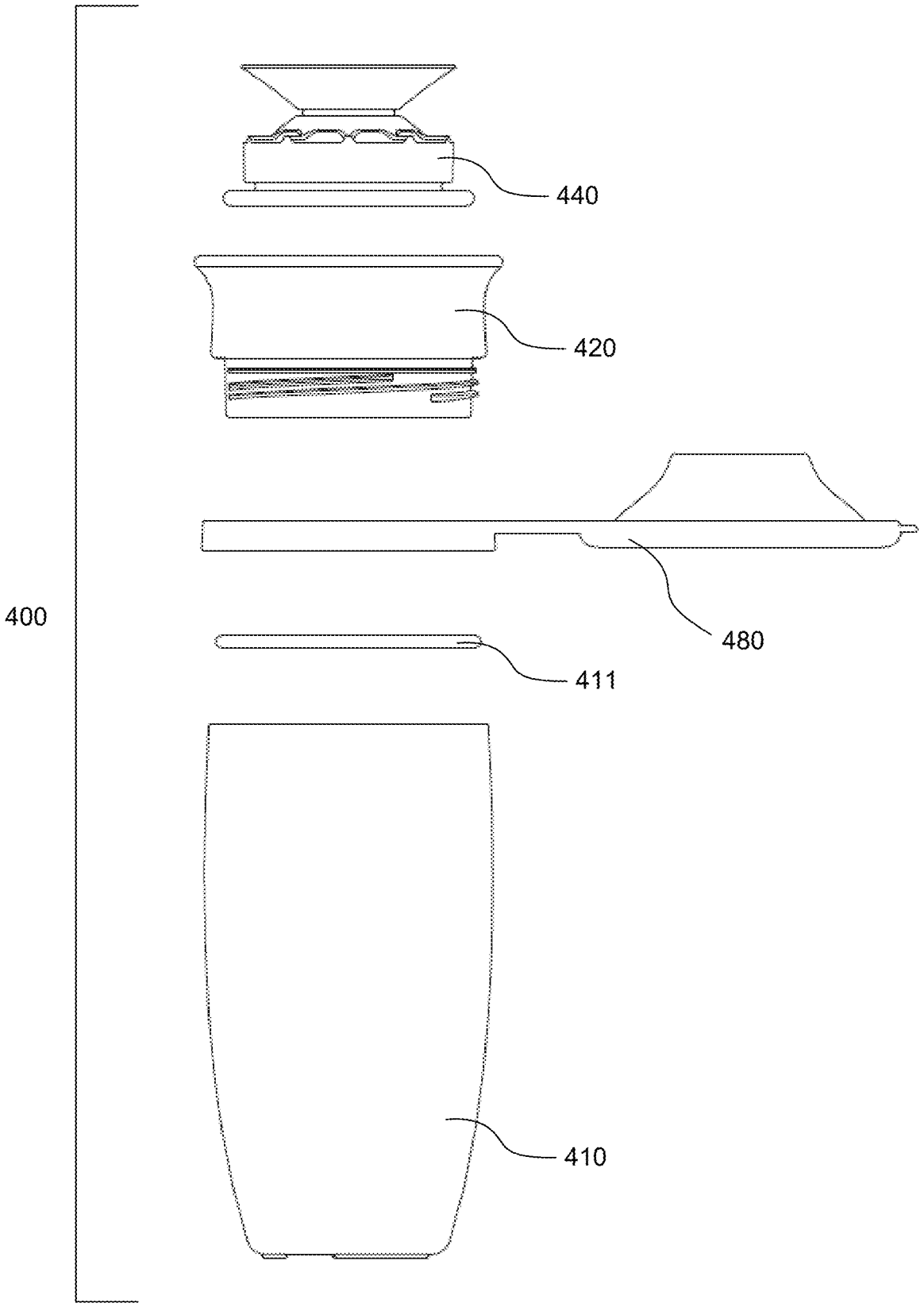
FIG. 57 is an exploded view of a drinking container assembly.

FIG. 57 is an exploded view of a drinking container assembly 400. Drinking container assembly 400 can include a container 410, a seal 411, a collar 420, a valve structure 440, and a lid 480.

Figure 58:
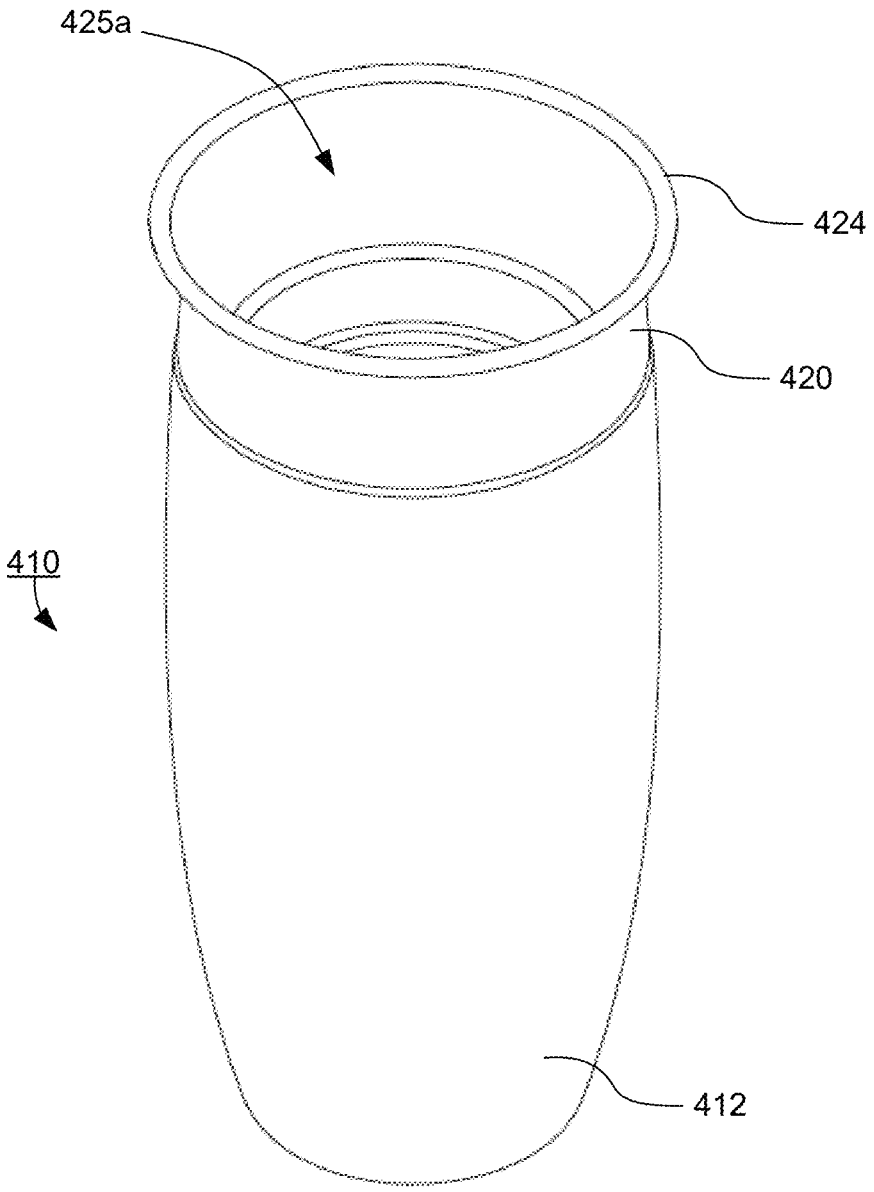
FIG. 58 and FIG. 59 illustrate an example container with an example collar.
Figure 59:
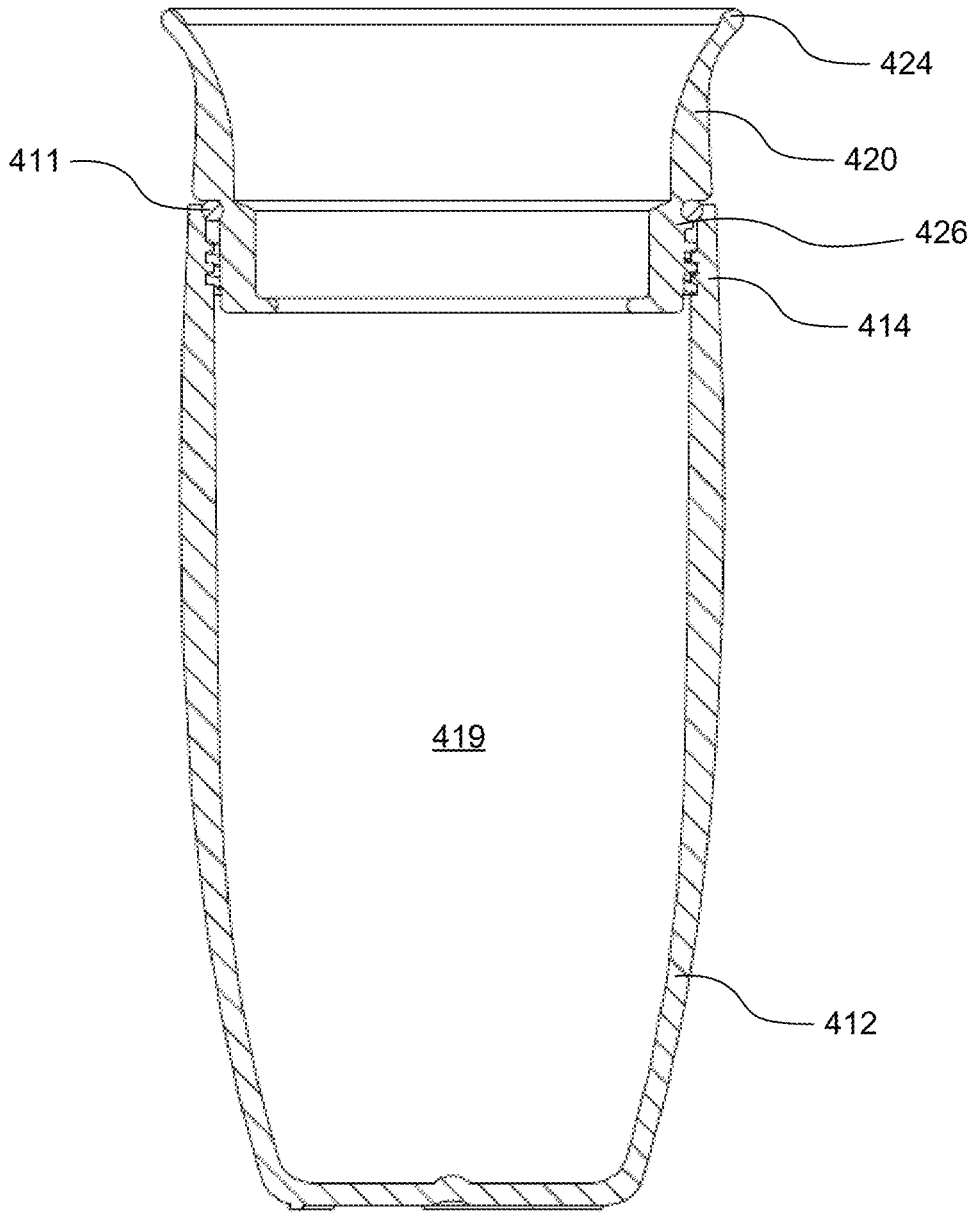
Figure 60:
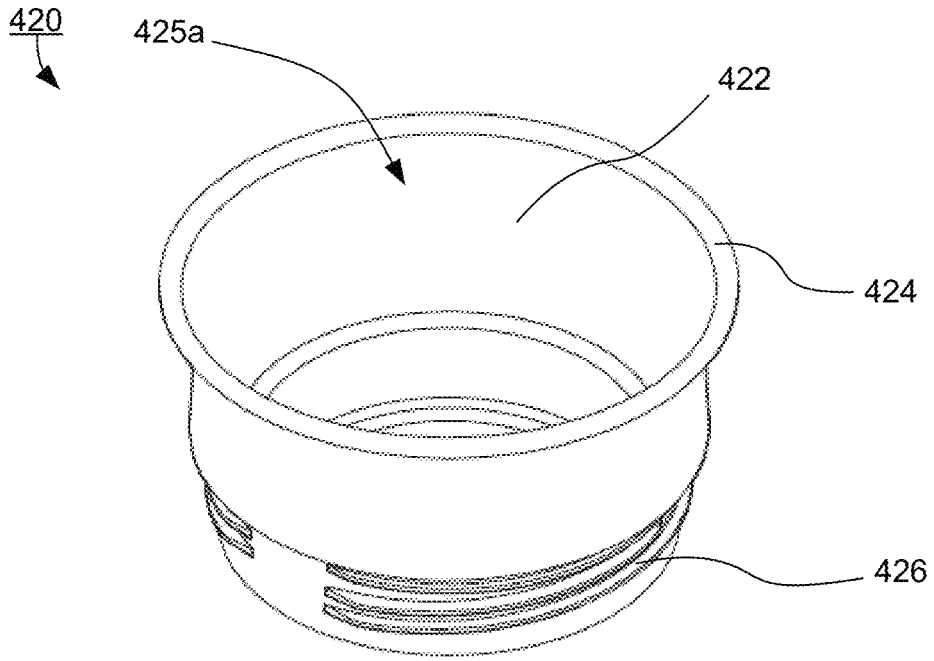
FIGS. 60-65 show various views of an example collar.
Figure 61:
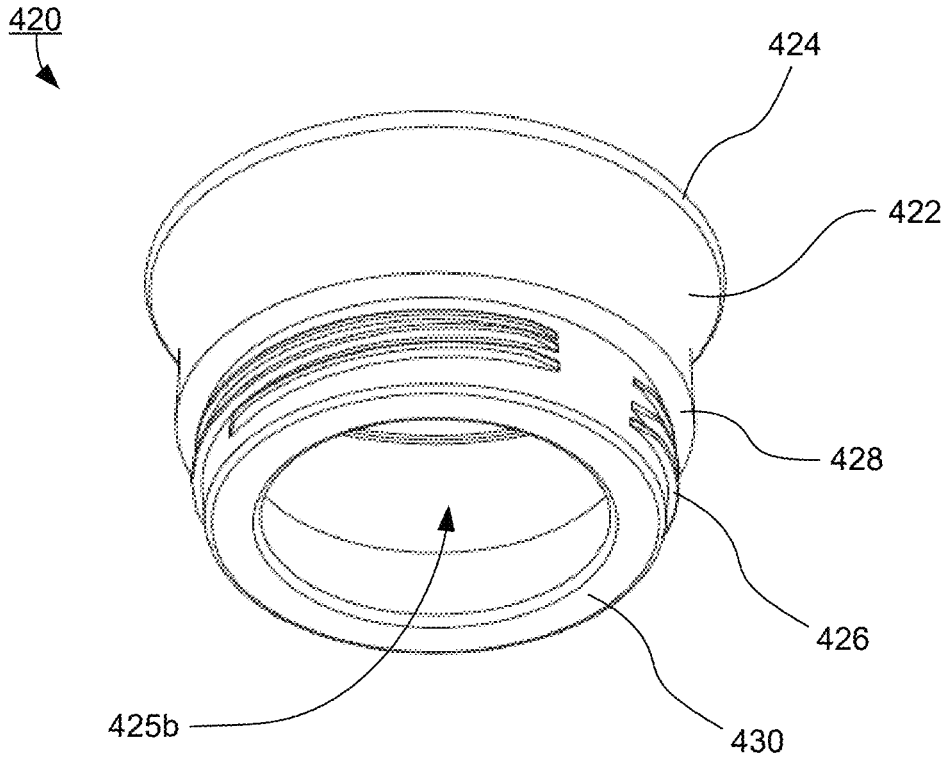
Figure 62:
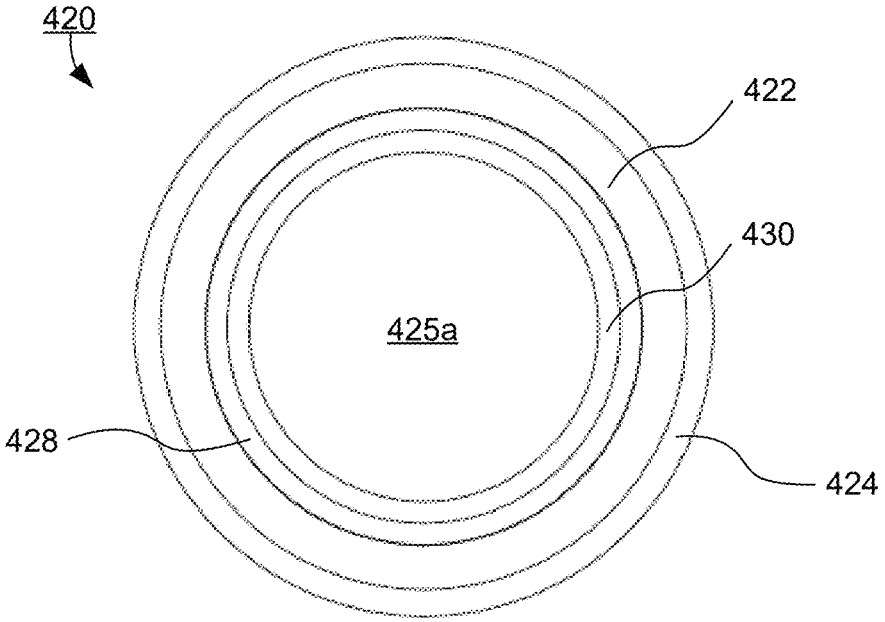
Figure 63:
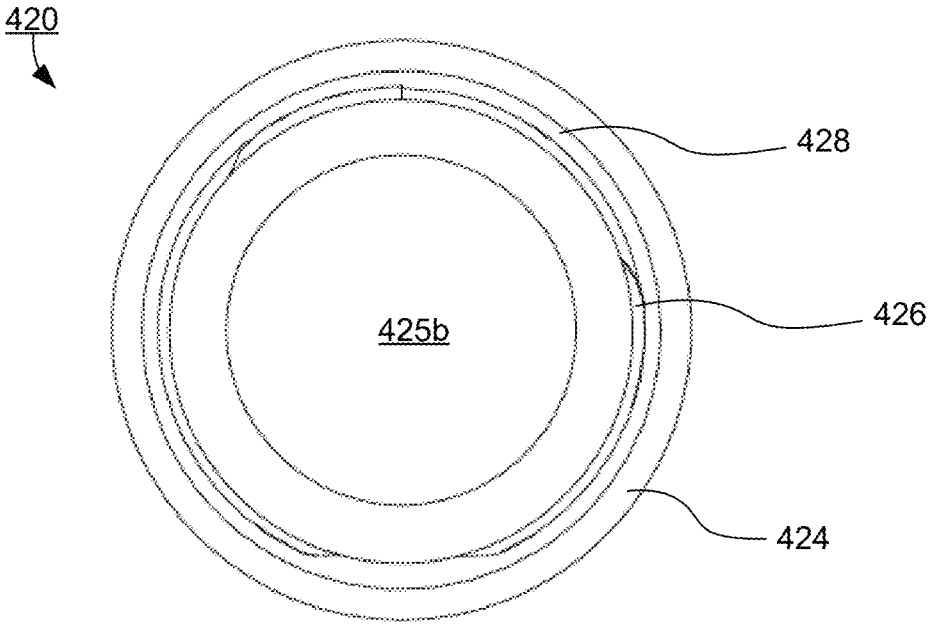

FIGS. 58 and 59 illustrate an example container 410 with an example collar 420. Collar 420 has a sidewall 422 having an upper end 424 and a lower securing portion 426. Collar 420 is configured to attach to container 410. More specifically, a lower securing portion 426 adjacent to sidewall 422 of collar 420 is configured to attach and secure to an upper securing section 414 of container body 412. For example, lower securing portion 426 of collar 420 and upper securing section 414 of container 410 may be and/or have threads operable to mate and thereby secure the two structures together. Seal 411 can sit between container body 412 and collar 420 to prevent leaks of contents disposed within a cavity 419 of container body 412. Seal 411 can be a seal in the shape of a ring and/or an O-ring made of a semi-flexible material to prevent leaking of fluids.

Figure 64:
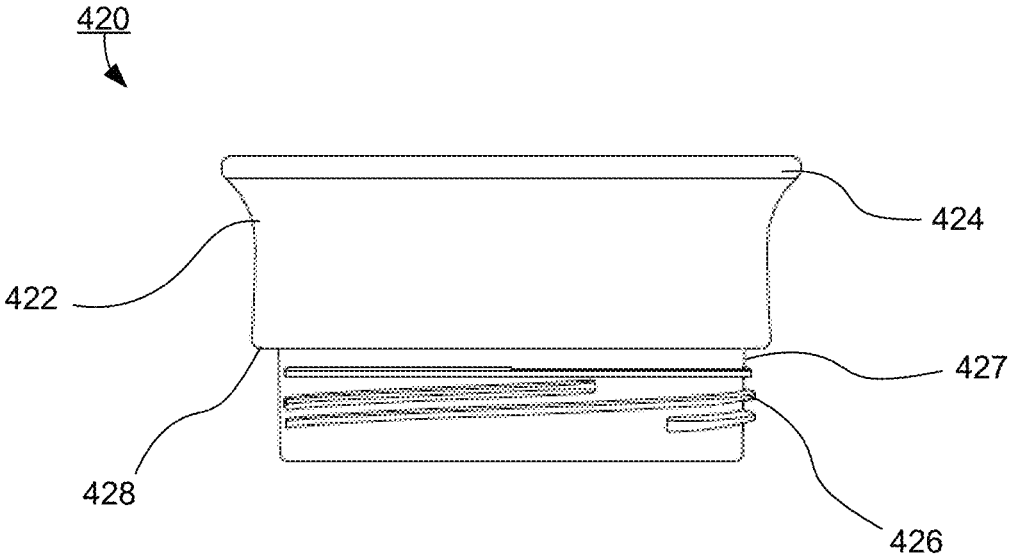
Figure 65:
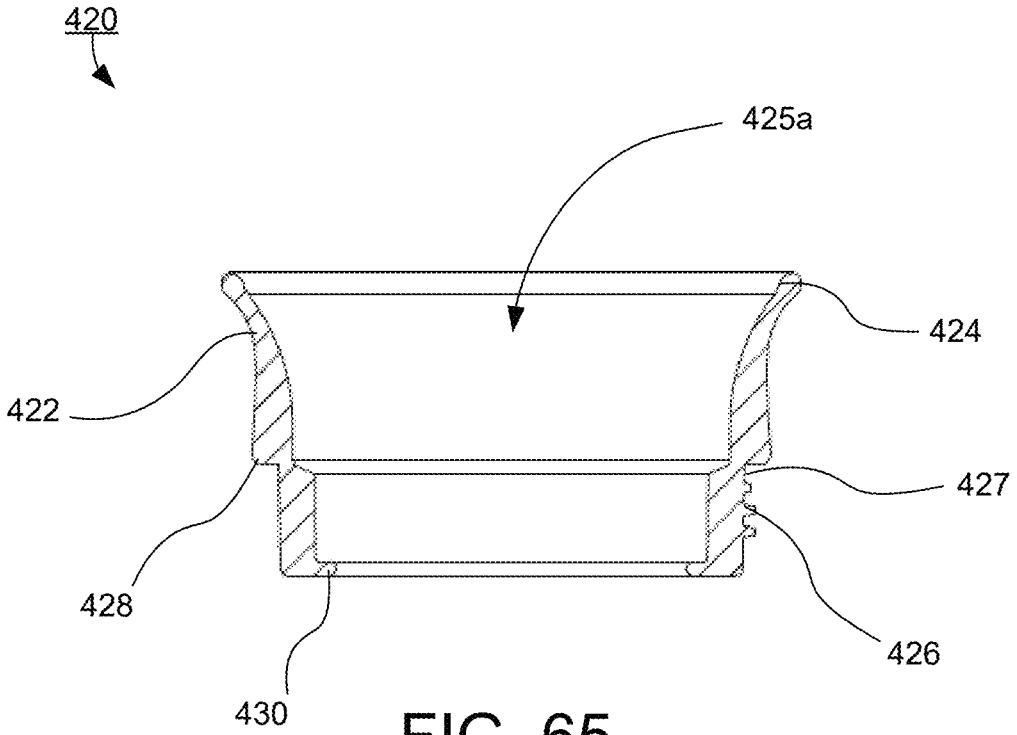
Figure 66:
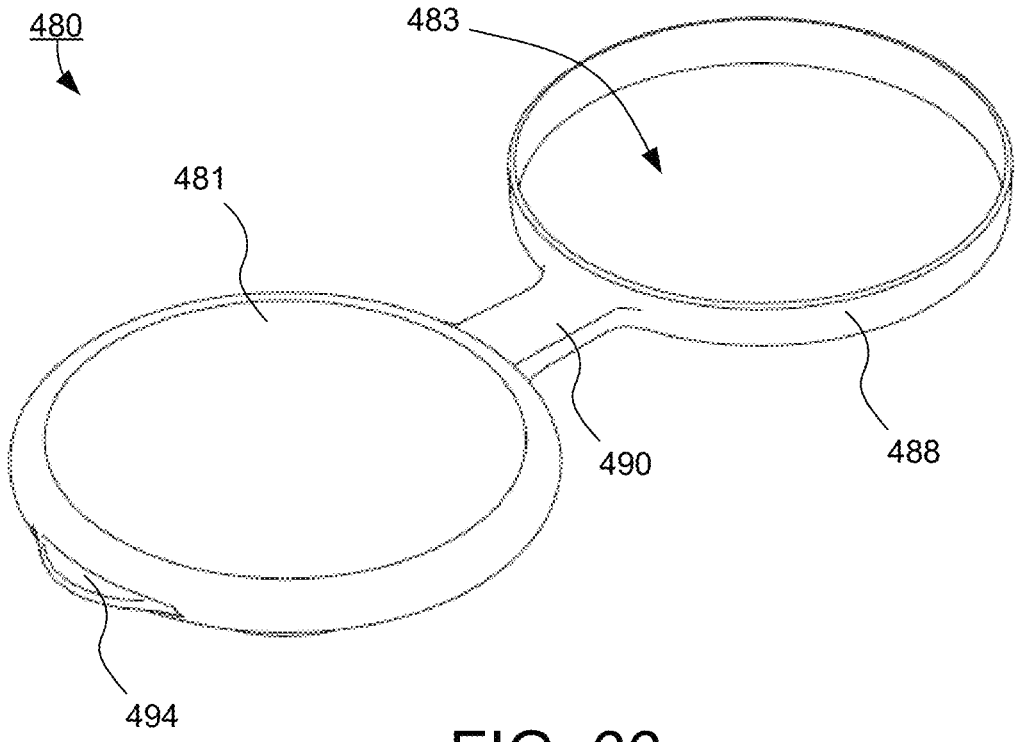
FIGS. 66-71 show various views of an example lid.
Figure 67:
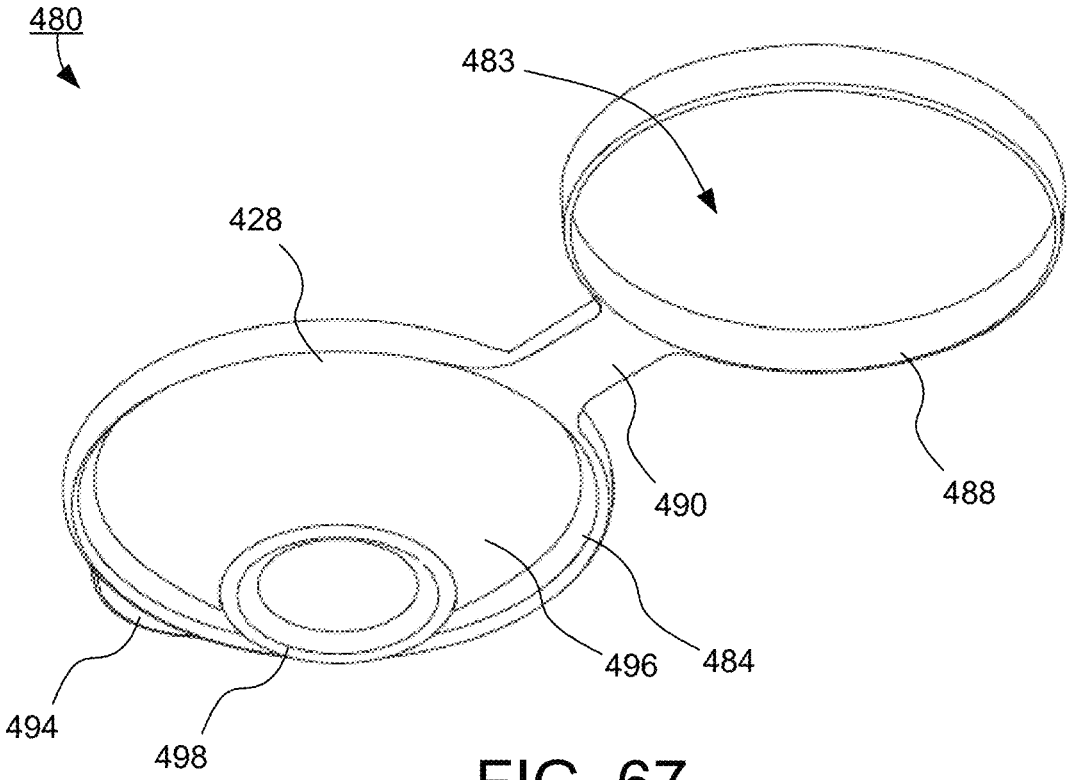
Figure 68:
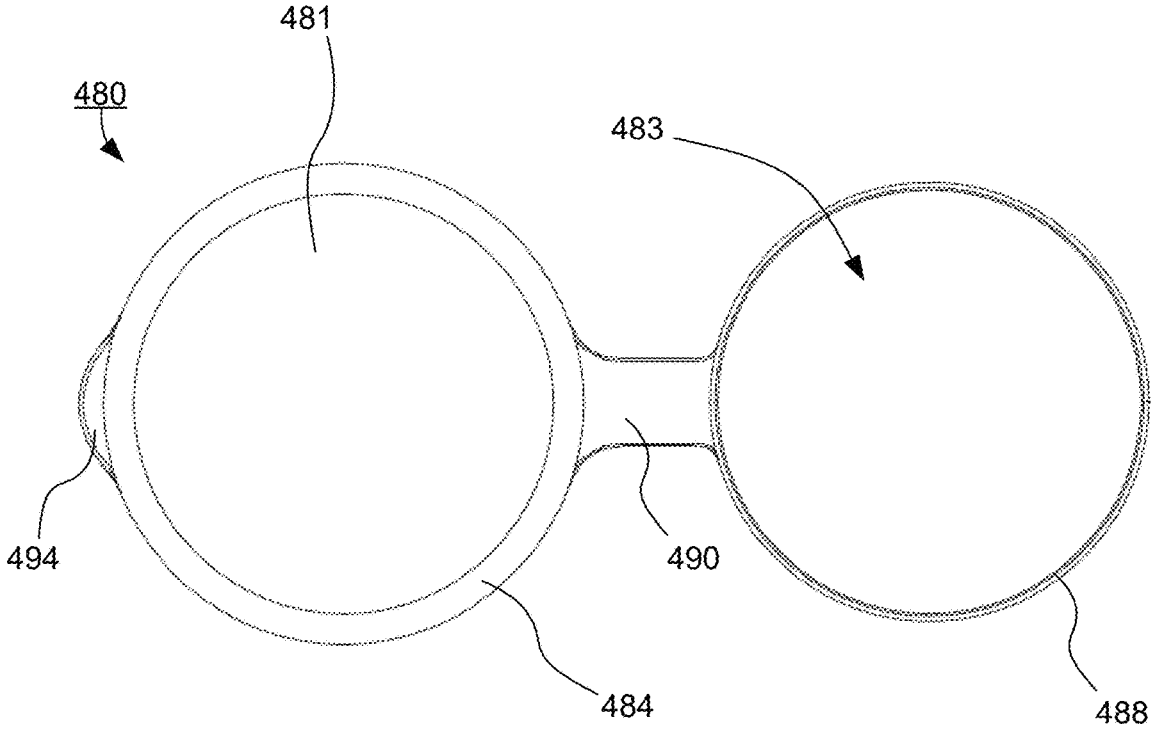
Figure 69:
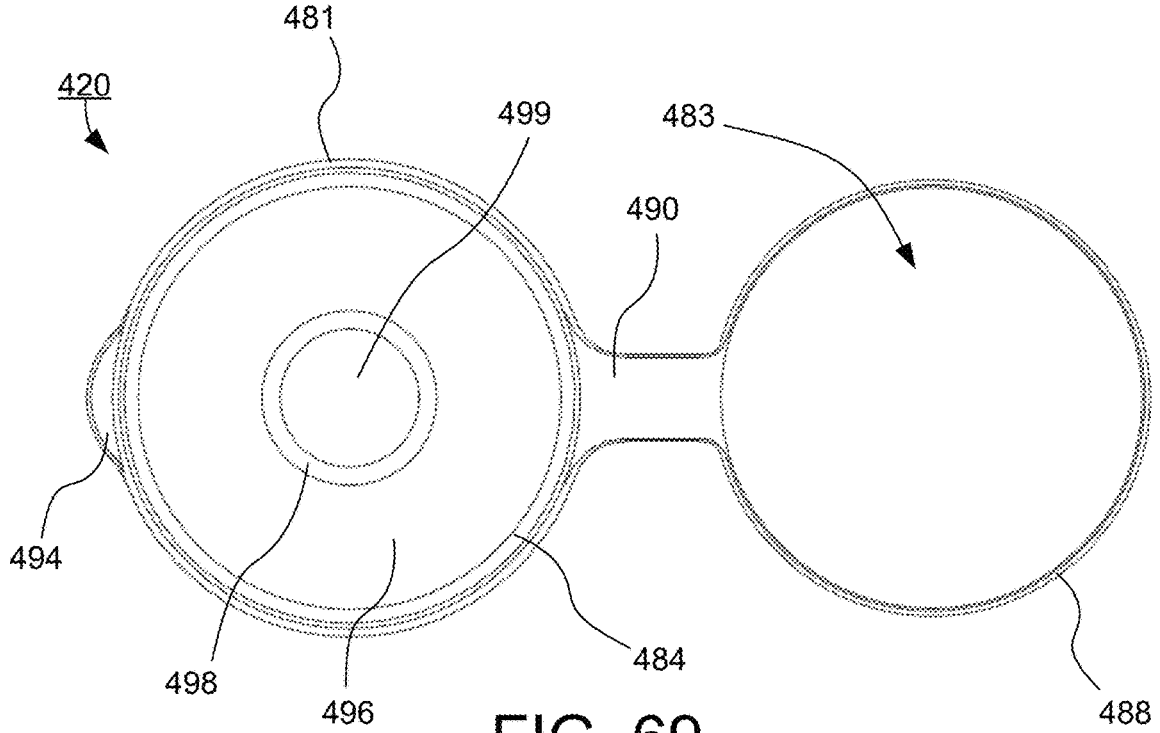
Figure 70:
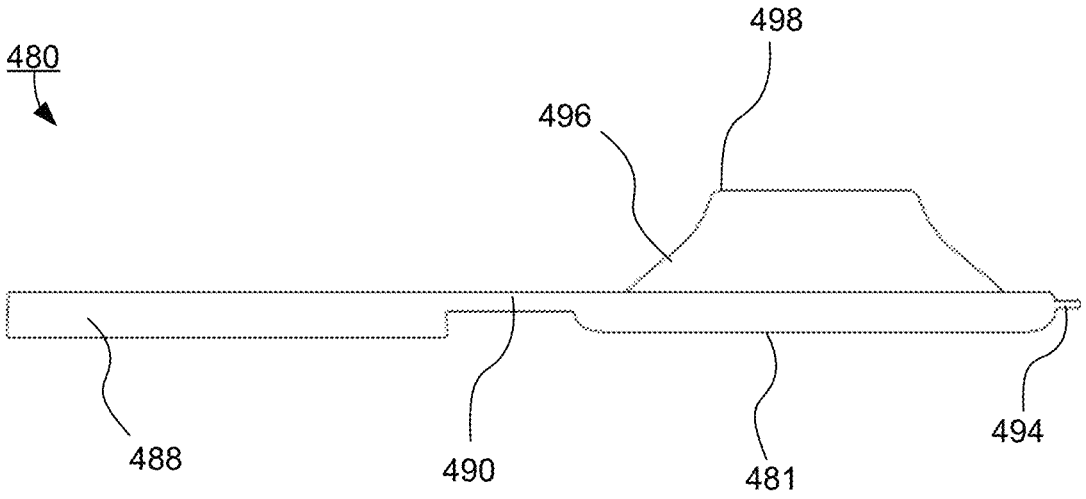
Figure 71:
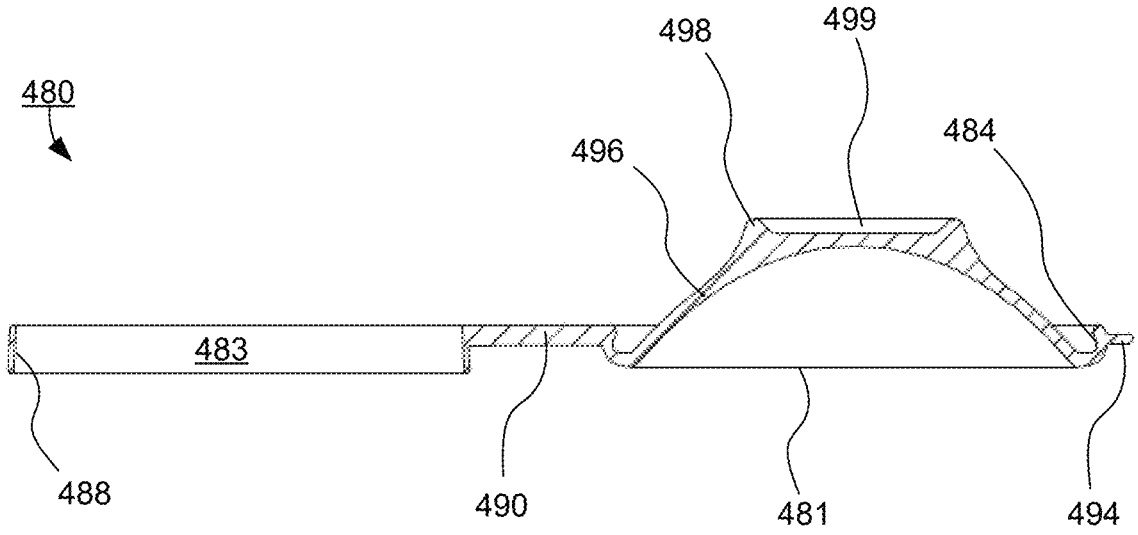
Figure 72:
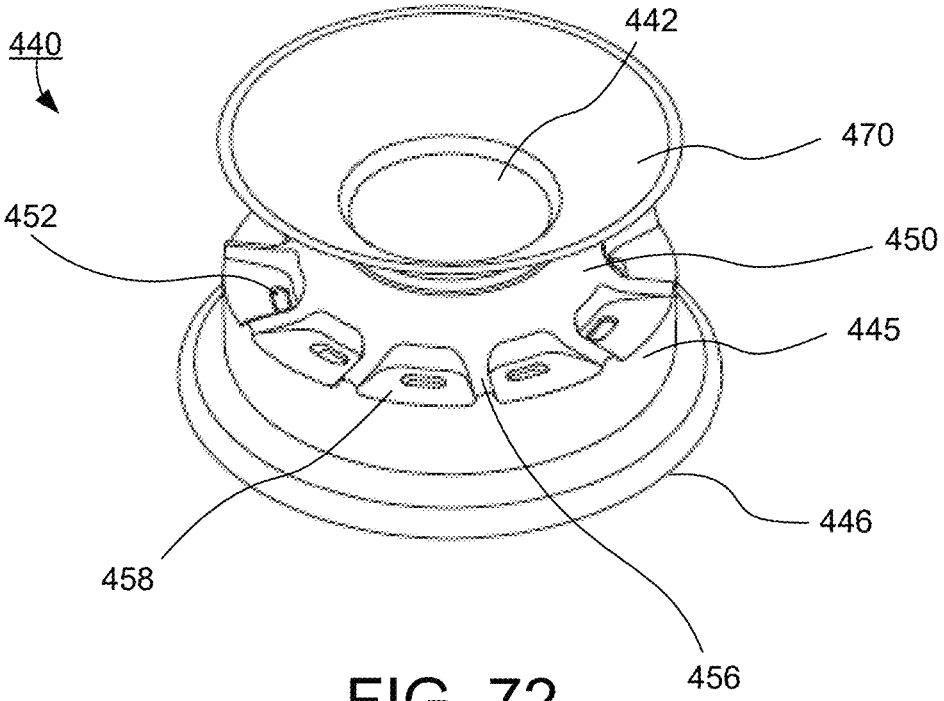
FIGS. 72-83 show various views of an example valve structure.
Figure 73:
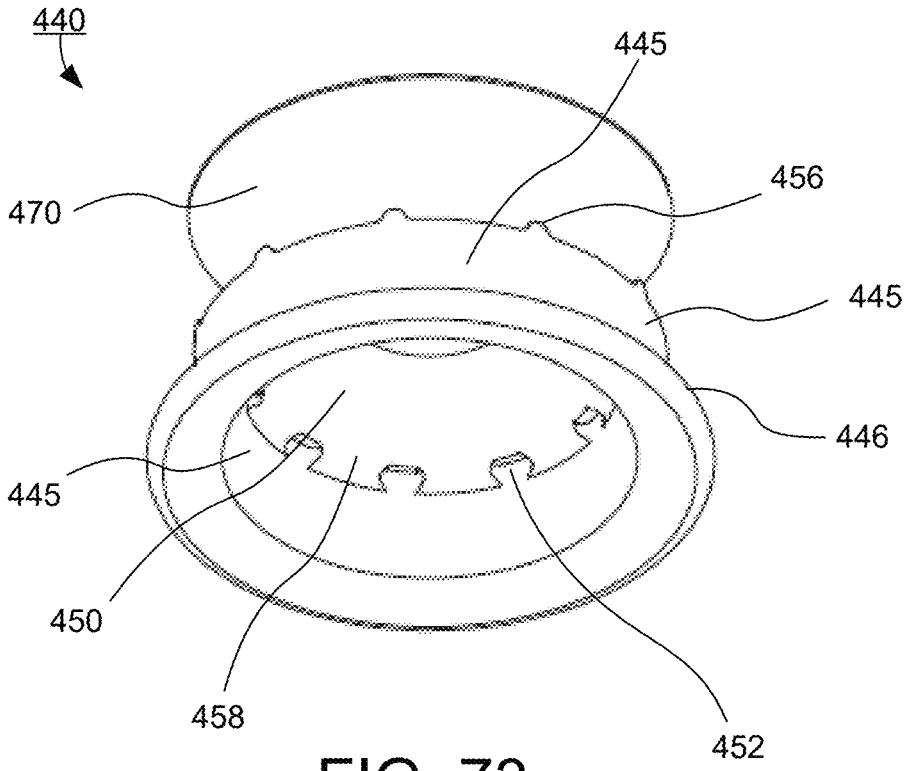
Figure 74:
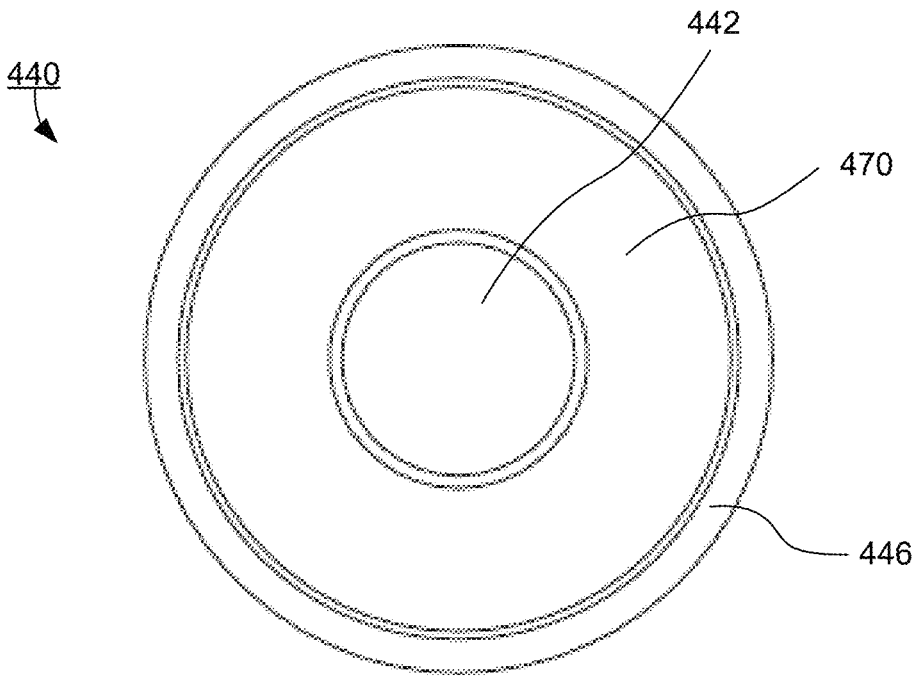
Figure 75:
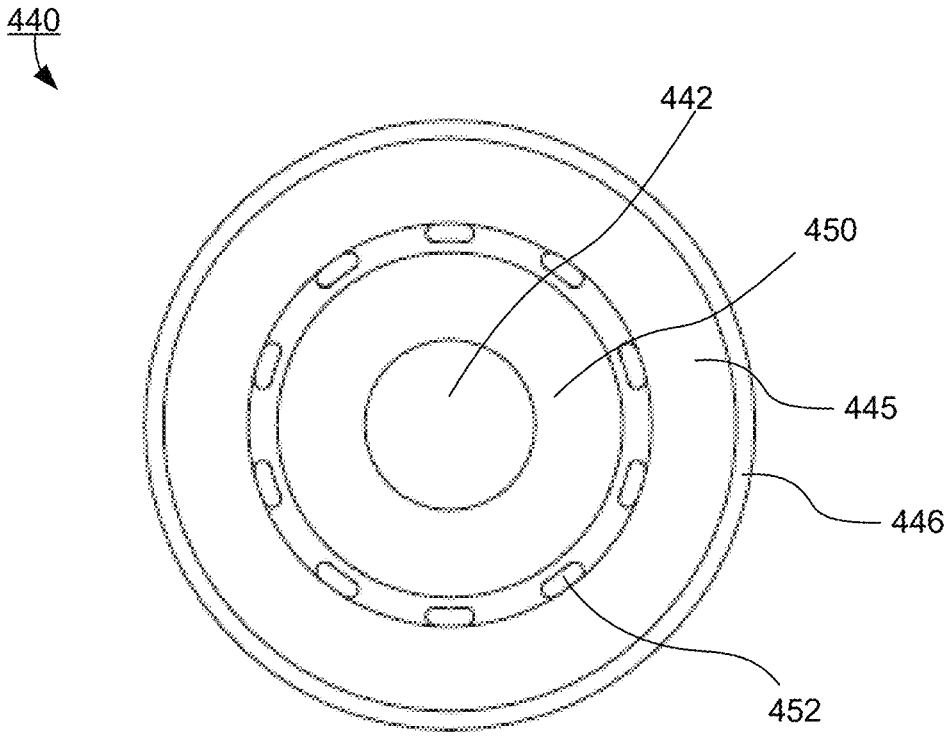
Figure 76:
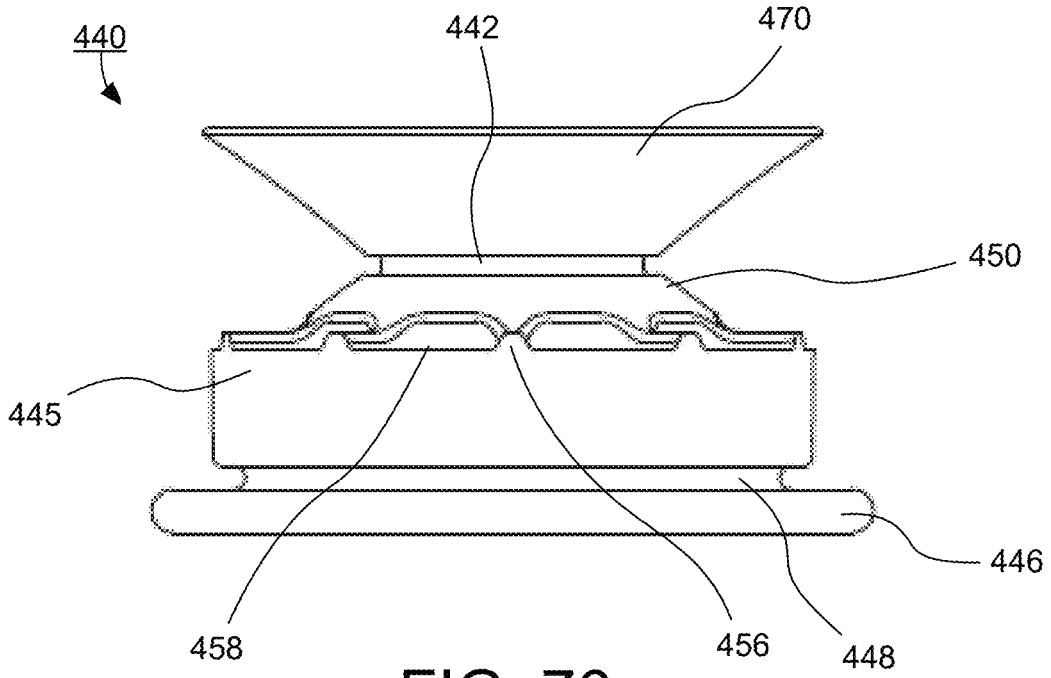
Figure 77:
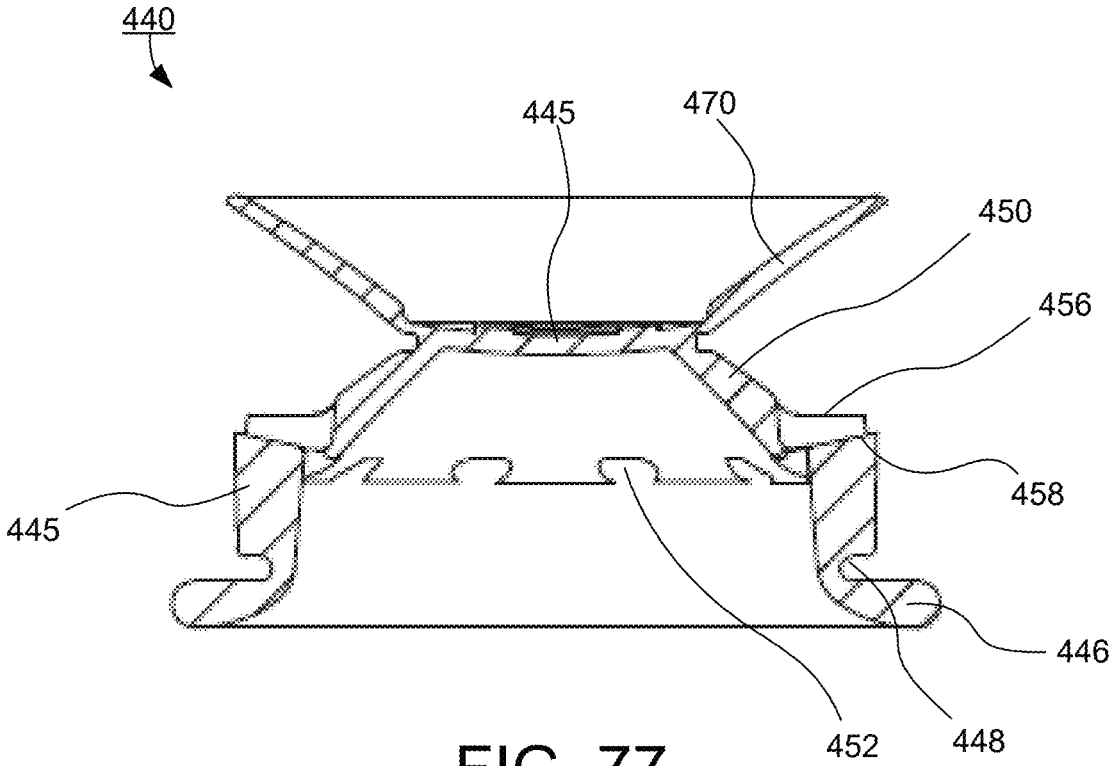
Figure 78:
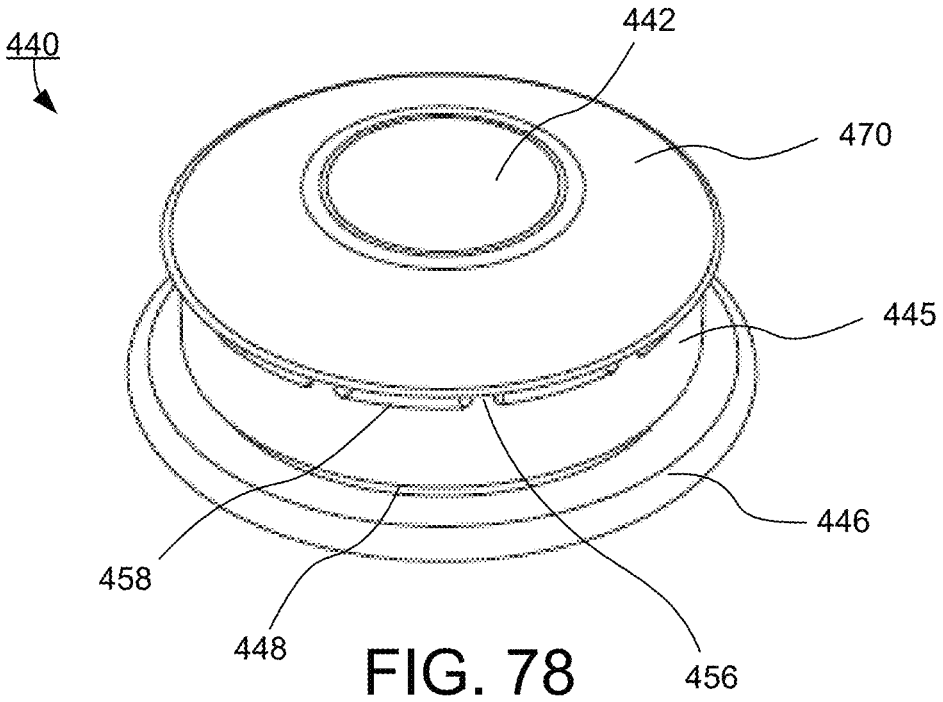
Figure 79:
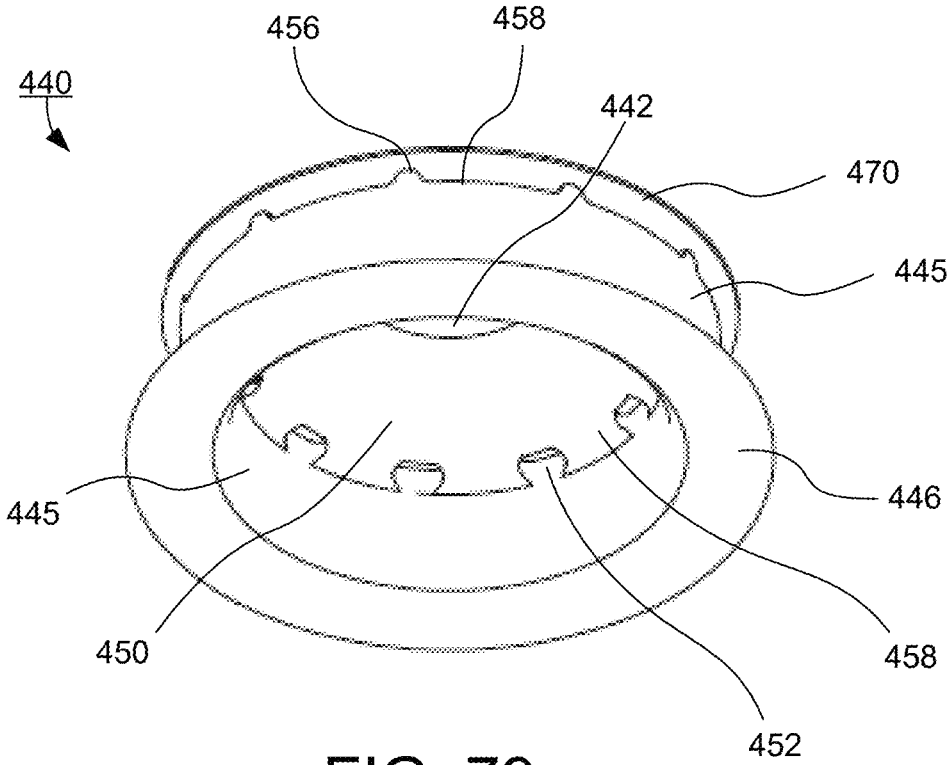
Figure 80:
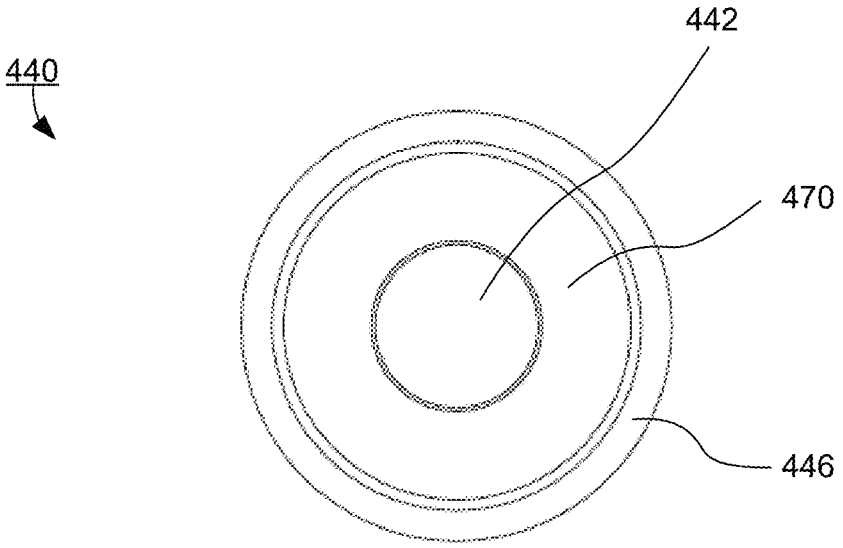
Figure 81:
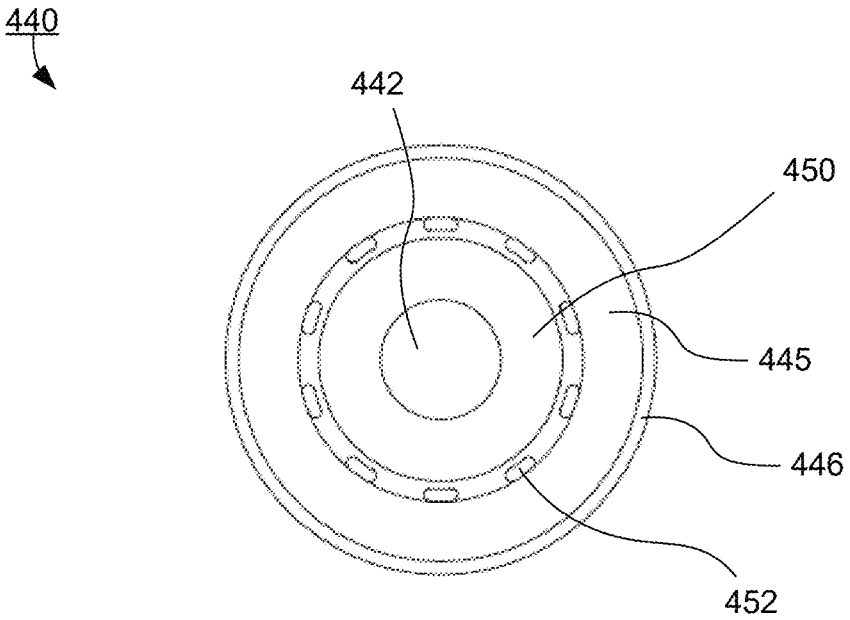
Figure 82:
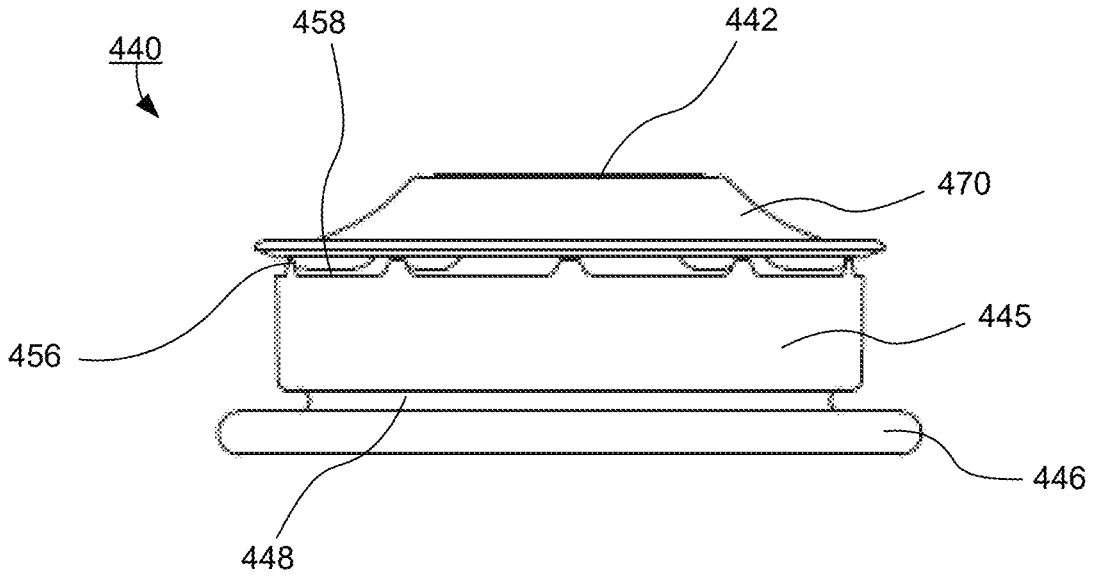
Figure 83:
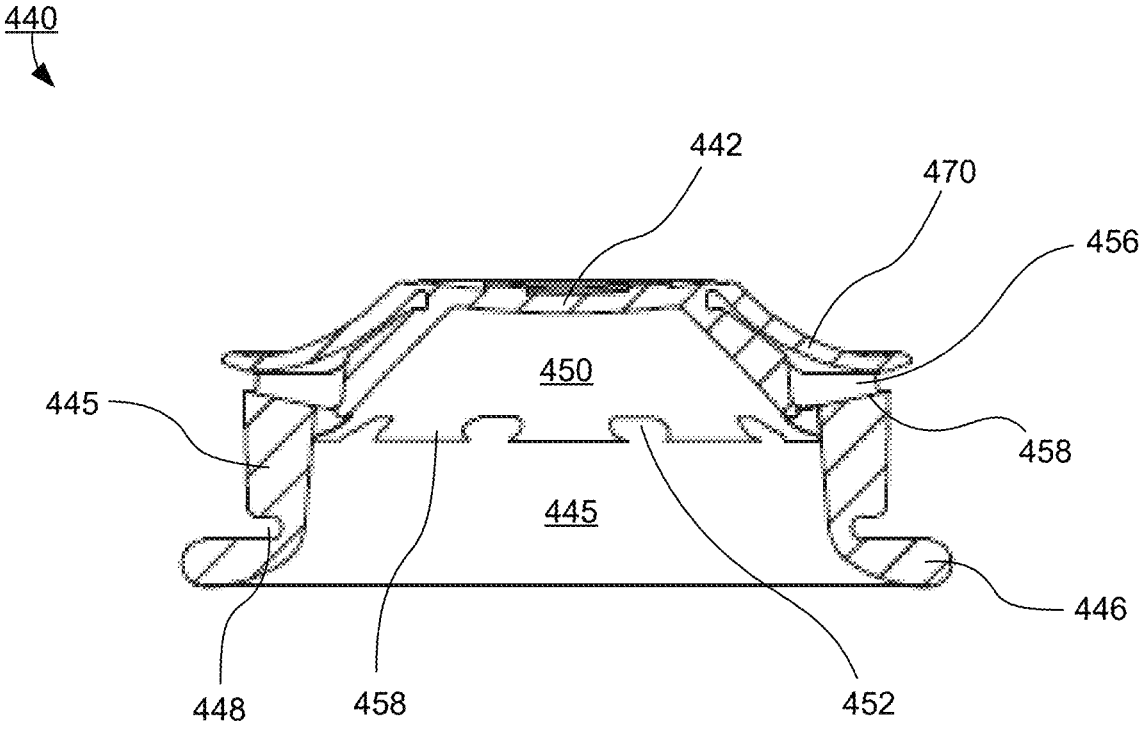
Figure 84:
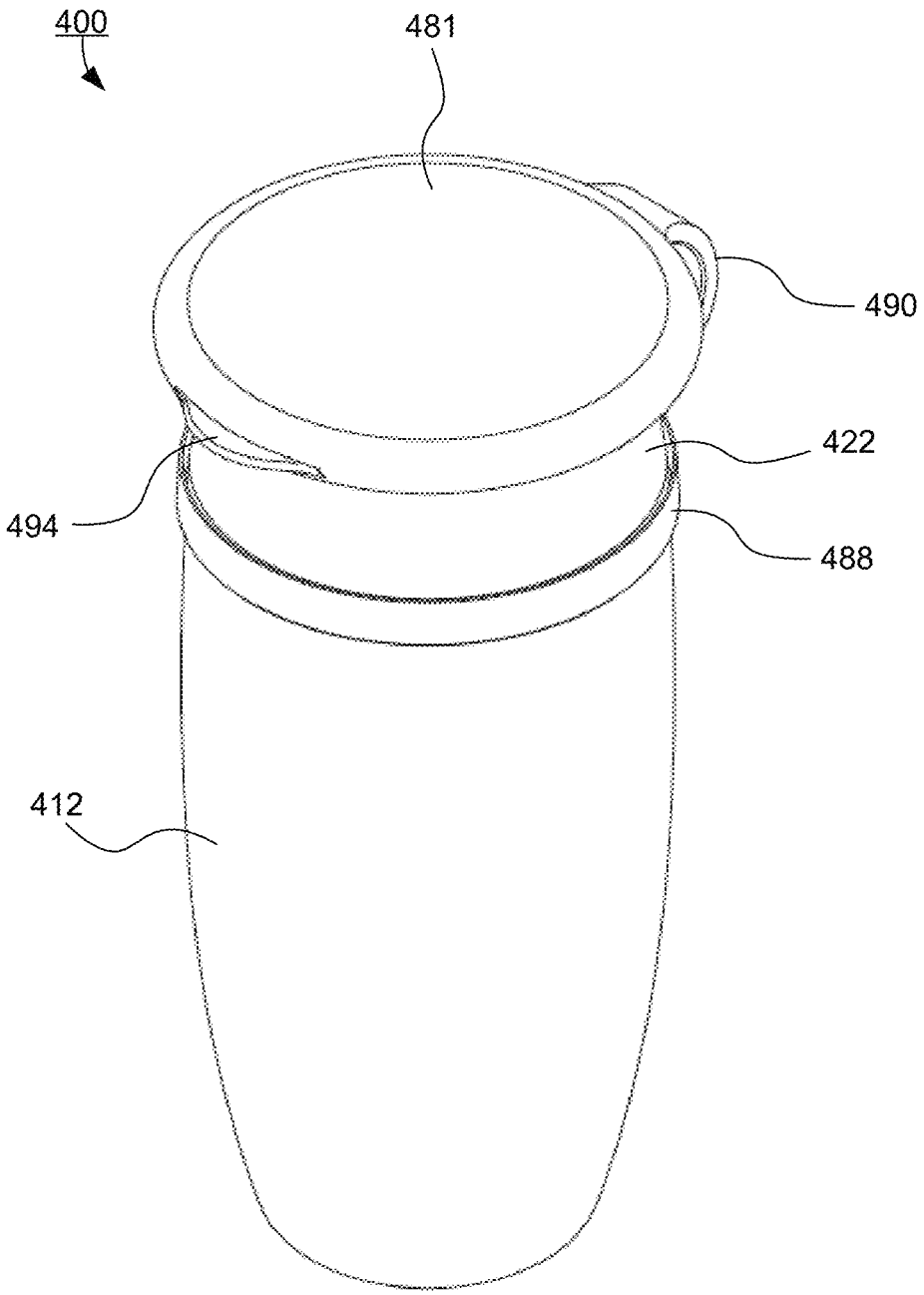
FIGS. 84-87 show various views of an example drinking container assembly in a closed position.
Figure 85:
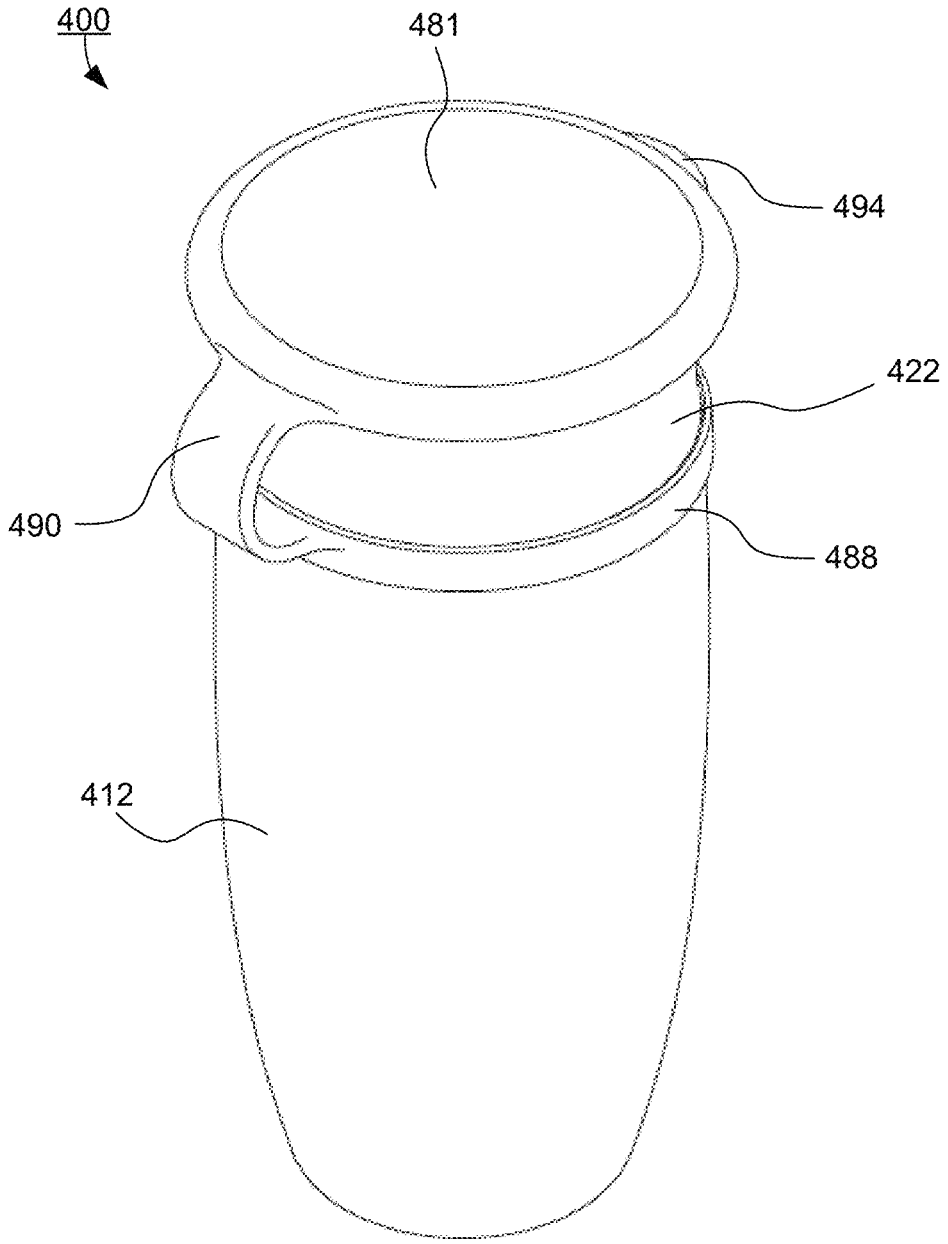
Figure 86:
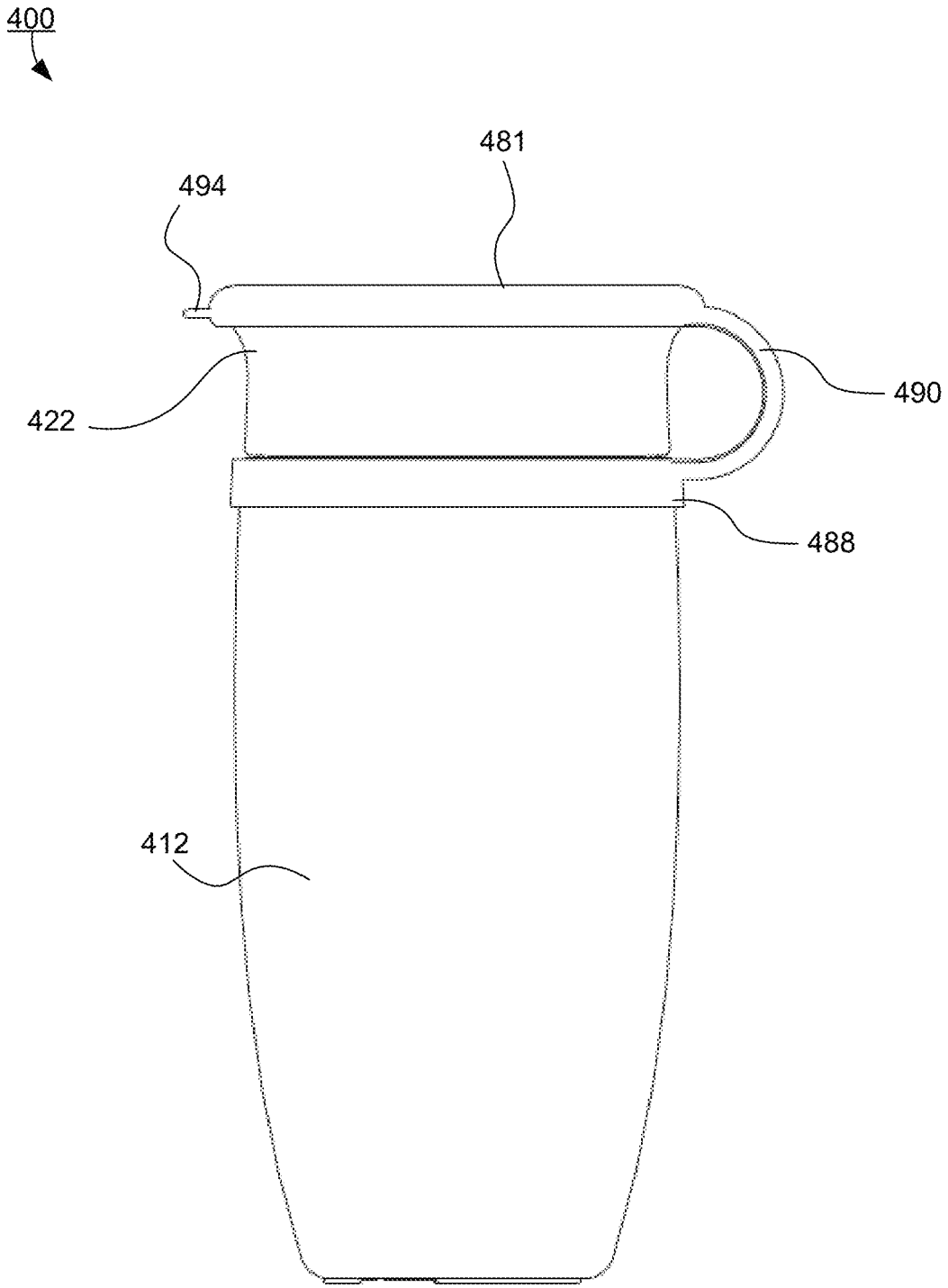
Figure 87:
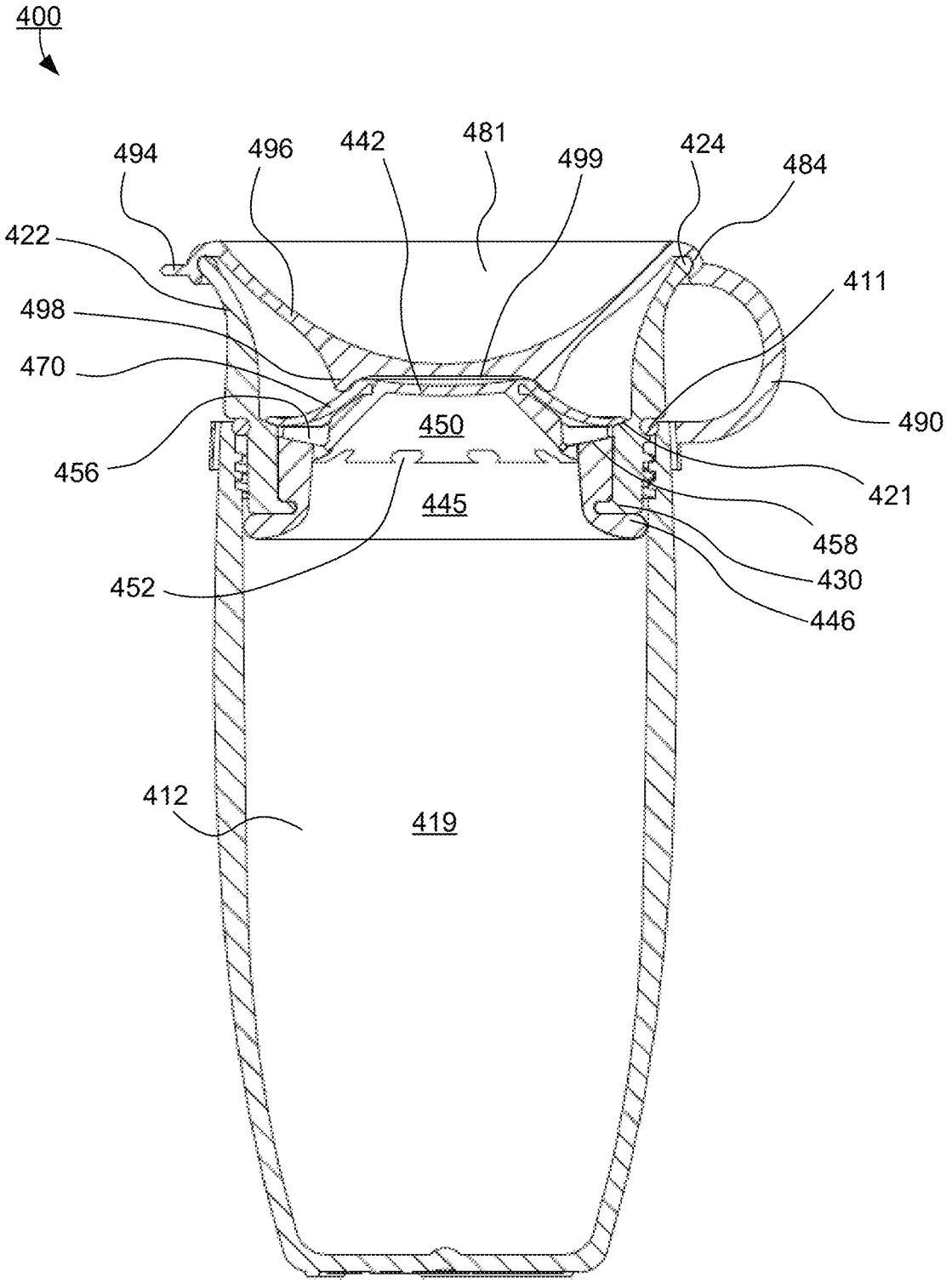

FIGS. 60-65 respectively show an upper perspective, lower perspective, top, bottom, side, and cross-sectional view of an example collar 420. As shown in FIG. 64 and FIG. 65, seal 411 can sit in a seal recess 427 disposed annularly around collar 420. For example, seal recess 427 can be at least partially defined by a shoulder 428 operable to abut against upper securing section 414 of container body 412.

As shown in FIGS. 59, 60, 62, and 65, collar 420 can have an upper opening 425*a* that allows access to cavity 419 of container body 412. Collar 420 can have an annular inner protrusion 430 disposed on and/or adjacent to lower securing portion 426. Adjacent to lower securing portion 426, an annular inner protrusion 430 can extend inwardly from lower securing portion 426 and can define a lower opening 425*b* that similarly allows access to cavity 419 of container body 412.

FIGS. 66-71 show various views of an example lid 480. Lid 480 can have an attachment structure 488 for attaching to a section of collar 420 and/or container body 412, such as an outer surface of sidewall 422 and/or upper securing section 414. For example, the collar 420 and/or container body 412 can fit into opening 483 defined by attachment structure 488 via a friction fit, thereby attaching attachment structure 488 of lid 480 to collar 420 and/or container body 412.

Lid 480 can also have a bridge 490 connecting a cover portion 481 to attachment structure 488. Bridge 490 may be constructed of a flexible material to allow flexibility of bridge 490, such that cover portion 481 can be moved on and off of collar 420 when attachment structure 488 is attached to collar 420 and/or container body 412.

Cover portion 481 can have a tab 494 to facilitate removing and/or securing cover portion 481 to collar 420. Cover portion 481 can also have a lip 484 to receive an upper end 424 of collar 420 and secure cover portion 481 to collar 420. Cover portion 481 can have a tapered structure 496 constructed to fit within collar 420. For example, collar 420 may have a curved sidewall 422 designed to accommodate a similar curvature of lips of a user to facilitate drinking by the user and tapered structure 496 may have a taper designed to fit within sidewall 422. Tapered structure 496 may have an abutment surface 498 operable to abut against a flexible valve (e.g., flexible valve 470 of valve structure 440 as will be discussed in further detail below). Abutment surface 498 may also have an abutment recess 499 operable to accommodate a raised portion of a flexible valve (e.g., a center 442 of flexible valve 470 as will be discussed in further detail below).

FIGS. 72-77 respectively show an upper perspective, lower perspective, top view, bottom view, side view, and cross-sectional view of an example valve structure 140 having flexible valve 470 in an open position. FIGS. 78-83 respectively show an upper perspective, lower perspective, top view, bottom view, side view, and cross-sectional view of an example valve structure 440 having flexible valve 470 in a closed position.

Valve structure 440 can have an annular outward protrusion 446 extending radially around a lower end of valve structure 440. Annular outward protrusion 446 is constructed to secure valve structure 440 to annular collar 420. For example, annular outward protrusion 446 and sidewall 445 can define an annular recess 448 that receives annular inner protrusion 430 of collar 420 and secures valve structure 440 within collar 420.

Valve structure 440 can have a flexible valve 470 operable to flex between an open position and a closed position. Flexible valve 470 may be constructed of a flexible material to allow flexing. For example, flexible valve 470 may be constructed of silicone. Flexible valve 470 may operate in the same or similar manner as inner valve 170 and/or inner valve 370 discussed above.

Flexible valve 470 may have a center 442 attached to a frustoconical structure 450. Center 442 may be at least partially raised from frustoconical structure 450 to allow pivoting of flexible valve 470 thereabout. For example, the partially raised portion may be the same or similar to hinge 172 discussed above. For example, center 442 may be constructed of a flexible material, such that pressing of center 442 causes flexible valve 470 to be in the open position by flexing an edge of center 442 attached to flexible valve 470 upwards and causes flexible valve 470 to flip upwards and away from frustoconical structure 450, thereby opening channels 458 and allowing fluid flow therethrough.

When the flexible valve 470 is in a closed position, flexible valve 470 is substantially adjacent to frustoconical structure 450.

Frustoconical structure 450 is disposed at an upper end of sidewall 445. Frustoconical structure 450 can have dividers 456 that define channels 458 disposed on and/or between frustoconical structure 450 and/or sidewall 445. Channels 458 control flow of fluids therethrough. Channels 458 may also have apertures 452 disposed therewithin to allow fluids to flow therethrough. Frustoconical structure 450 may also have apertures 452 disposed thereon. Flexible valve 470 is operable to pivot between a closed position and an open position, such that when flexible valve 470 is in the closed position, flexible valve 470 presses against dividers 456 and when flexible valve 470 is in the open position, flexible valve 470 flexes away from dividers 456.

FIGS. 84-87 respectively show a front perspective, rear perspective, side view, and cross-sectional view of an example drinking container assembly 400 in a closed position. In the closed position, drinking container assembly 100 has attachment structure 488 of lid 480 attached to container body 412. Collar 420 is disposed within container body 412 and secured by the mating between lower securing portion 426 of collar 420 and upper securing section 414 of container body 412. Seal 411 is disposed between container body 412 and collar 420 in seal recess 427.

Valve structure 440 is secured within collar 420 by the mating of annular recess 448 of valve structure 440 and annular inner protrusion 430 of collar 420. The securing of valve structure 440 within collar 420 may be enhanced by annular outward protrusion 446 abutting against container body 412.

Sidewall 445 of valve structure 440 can sit within lower opening 425*b* of collar 420. When flexible valve 470 is in the closed position, an edge of flexible valve 470 can abut against inner shoulder 421 disposed on an inner surface of sidewall 445, thereby blocking channels 458 and preventing fluid flow therethrough.

Lip 484 of cover portion 481 is secured to upper end 424 of collar 420, thereby further preventing fluid from leaking out of drinking container assembly 400. Tapered structure 496 of lid 480 extends inwards into opening 425*a* defined by sidewall 422 of collar 420. Inside opening 425*a*, abutment surface 498 presses against flexible valve 470 to keep flexible valve 470 in the closed position. Abutment recess 499, which is disposed in a center of abutment surface 498, accommodates center 442, which may be raised relative to flexible valve 470, and prevents flexible valve 470 from pivoting from the closed position.

Figure 88:
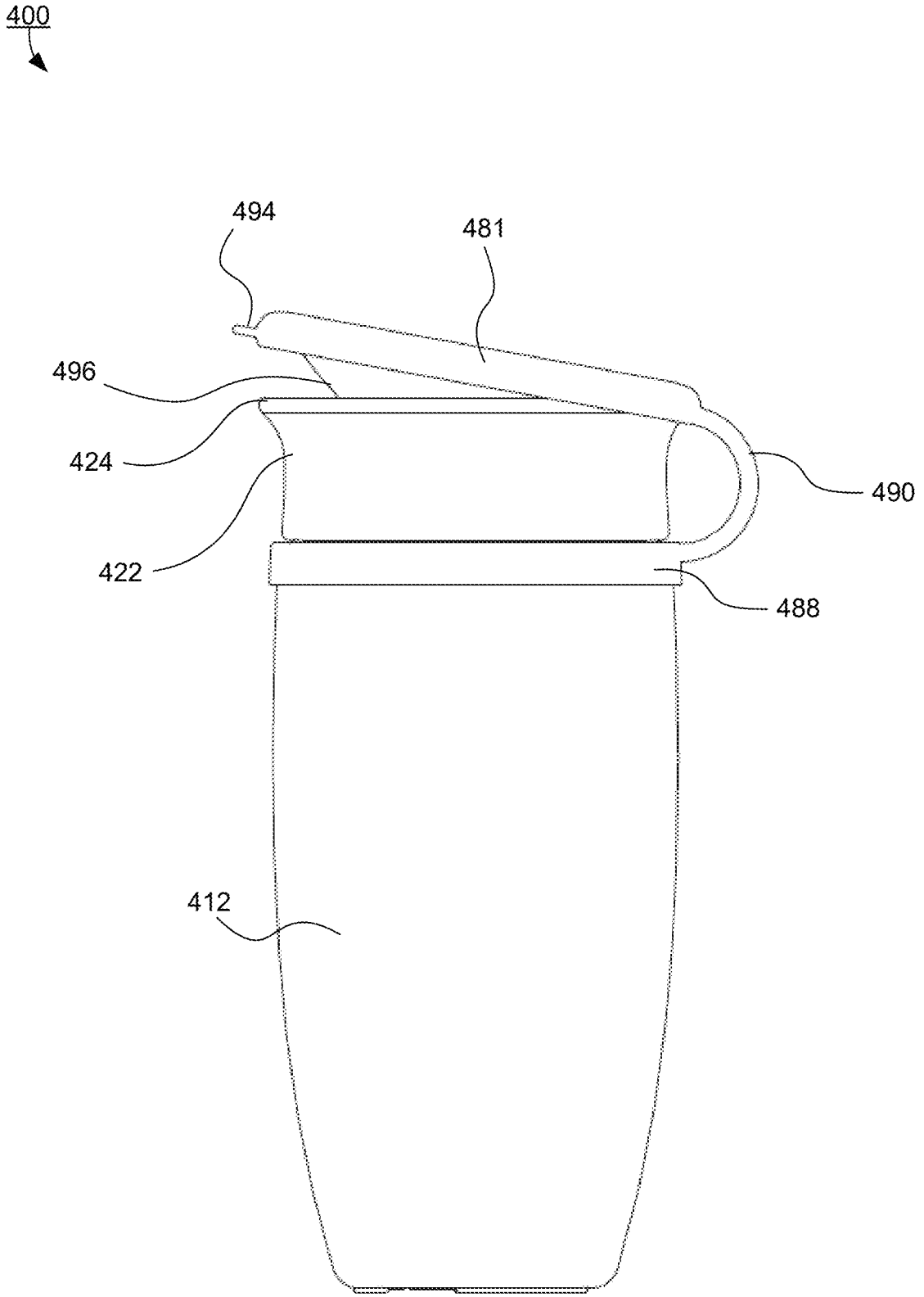
FIG. 88 and FIG. 89 show various views of an example drinking container assembly in a partially open position.

FIG. 88 and FIG. 89 show various views of an example drinking container assembly 400 in a partially open position. More specifically, FIG. 88 to FIG. 89 demonstrate an intermediate position during closing of lid 480 of drinking container assembly 400 from an open position to a closed position. As cover portion 481 is pressed downward onto collar 420, lip 484 may begin to receive upper end 424 of collar 420 starting from a section most proximate to bridge 490 and pivots downwards therefrom. Tapered structure 496 and abutment surface 498 may begin to press against flexible valve 470, which can facilitate transition of flexible valve 470 from the open position to the closed position, similar to transition of sealing flap 174 of inner valve 170 via the hinge 172 mechanism discussed above.

Figure 90:
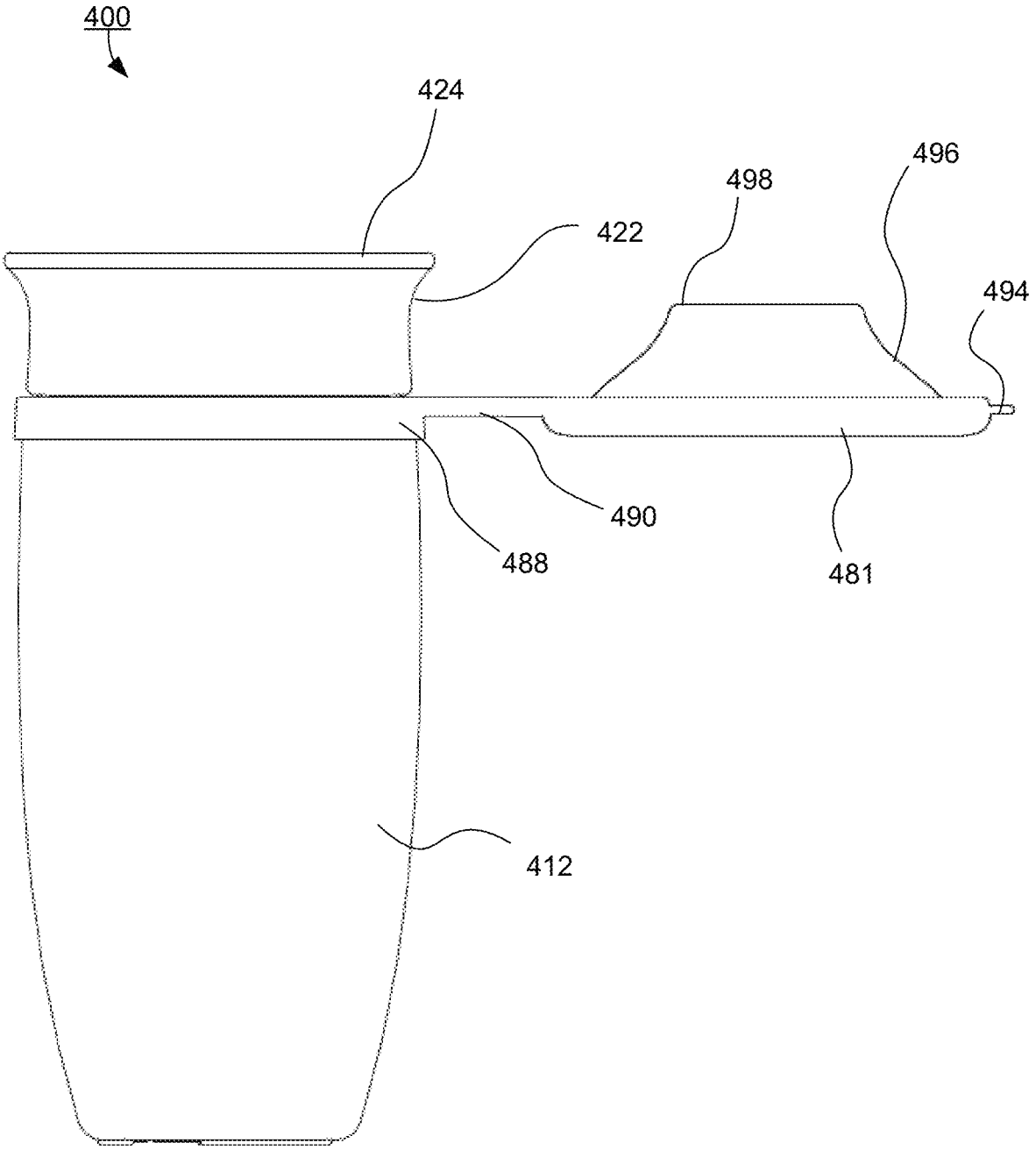
FIGS. 90-95 show various views of an example drinking container assembly in an open position.
Figure 91:
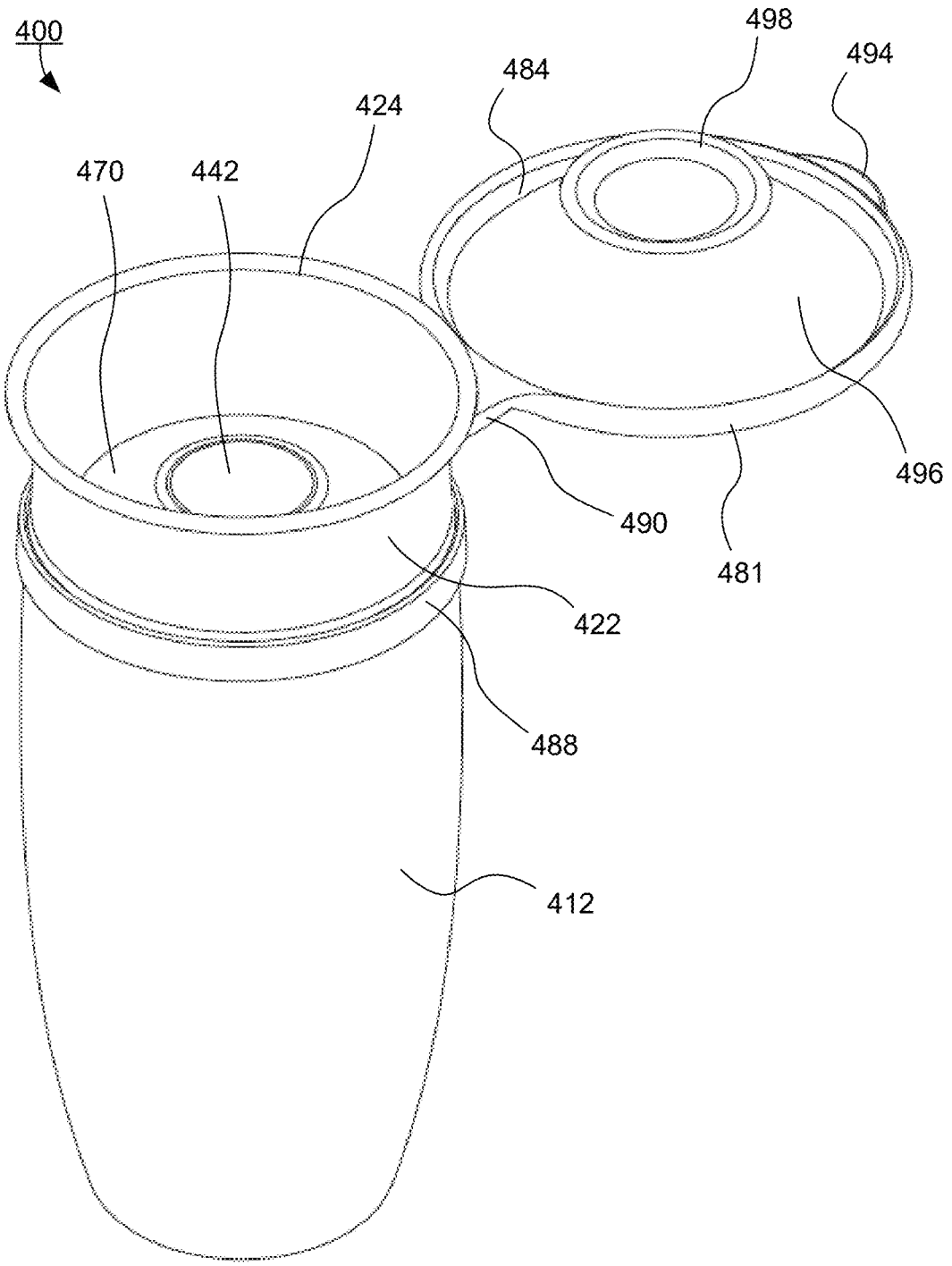
Figure 92:
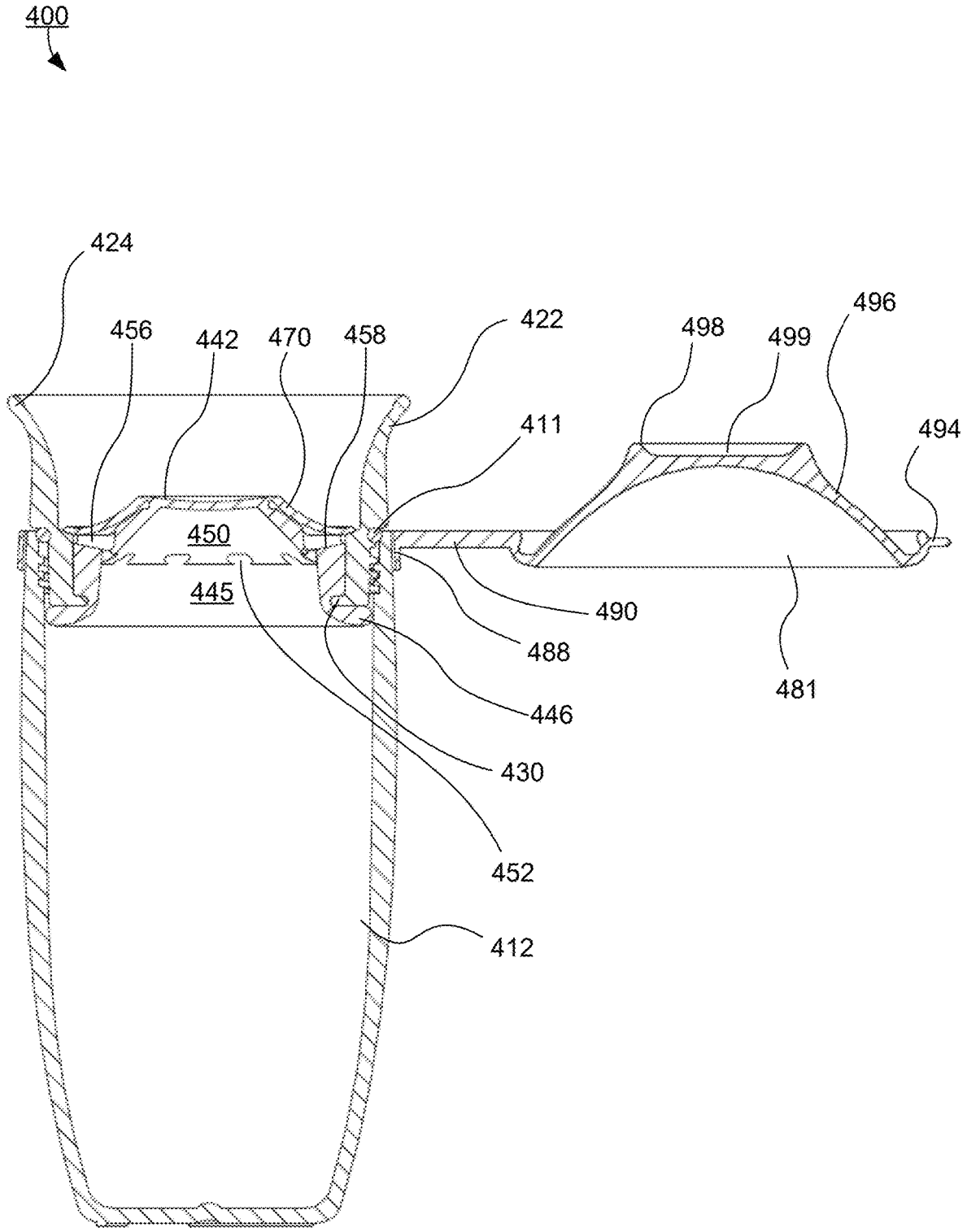
Figure 93:
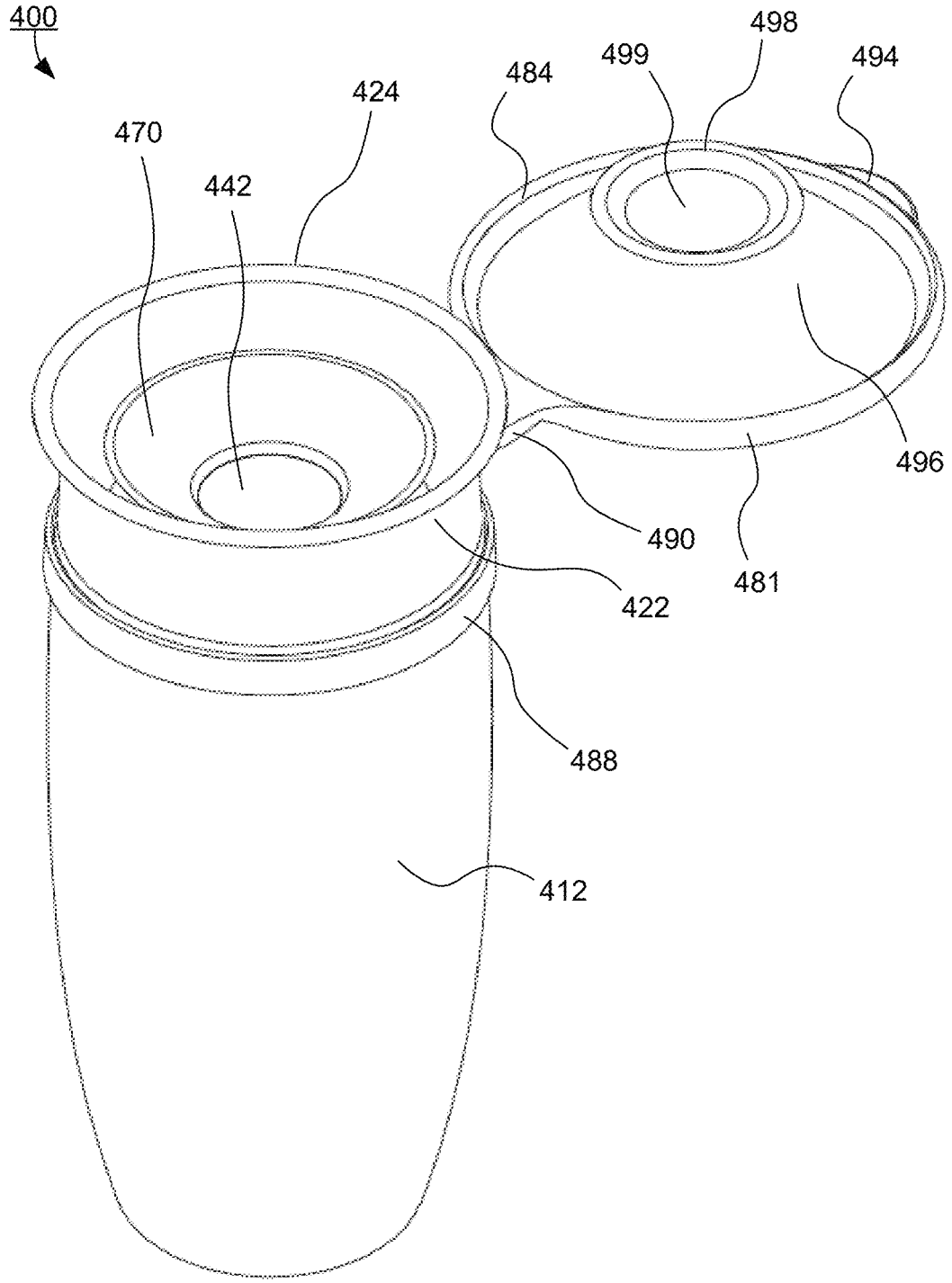
Figure 94:
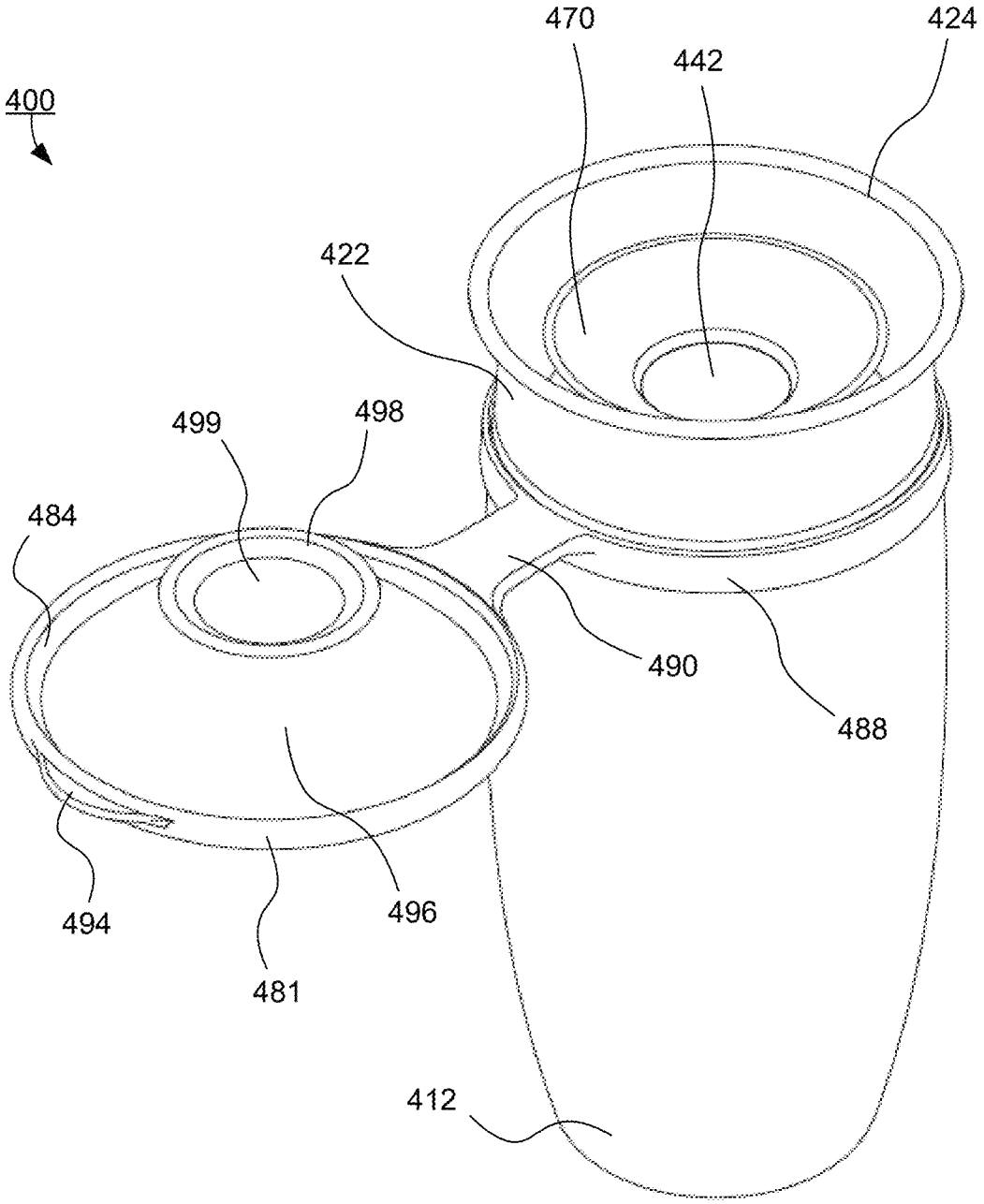
Figure 95:
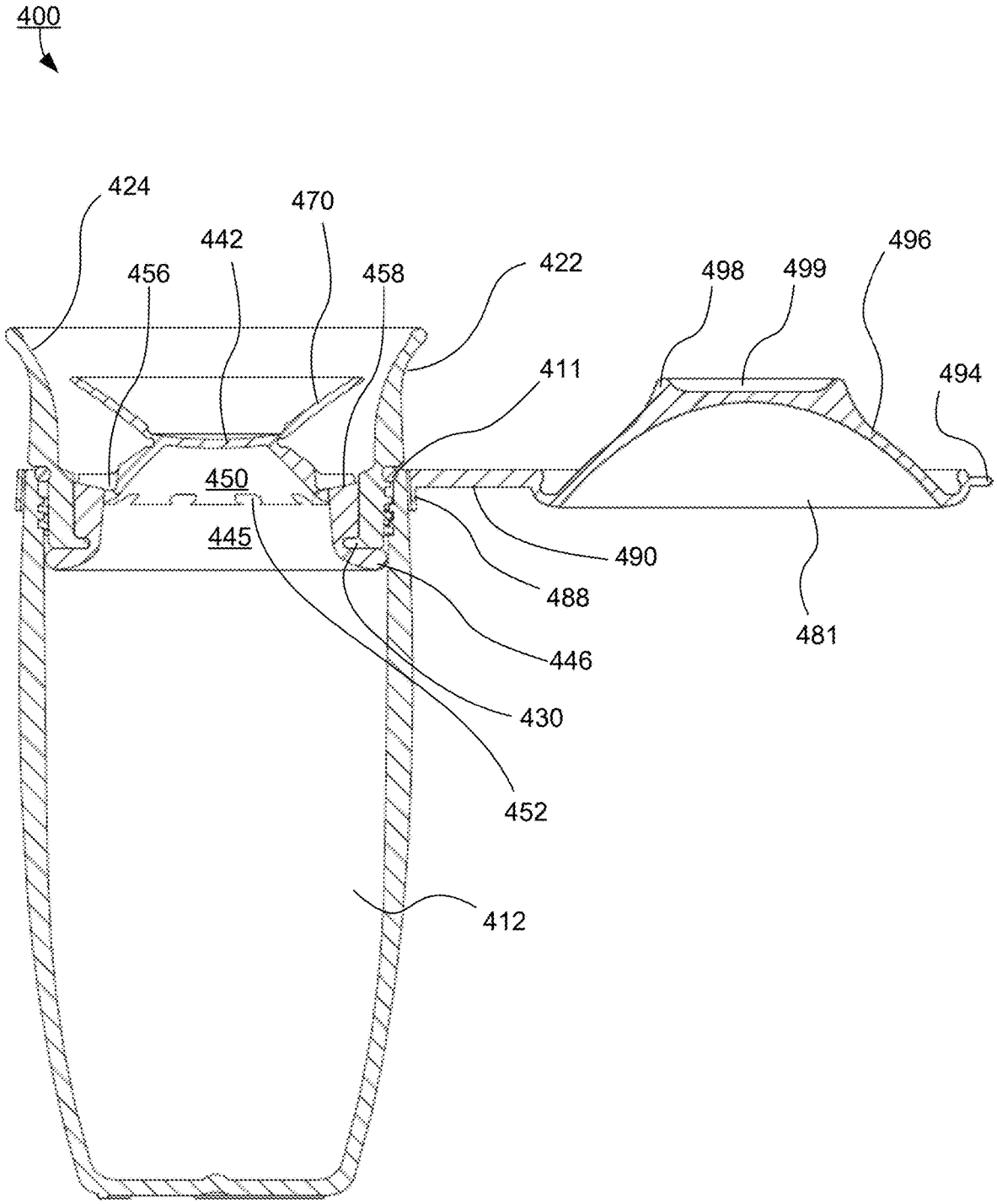

FIGS. 90-92 respectively show a side view, perspective, and a cross-sectional view of an example drinking container assembly 400 having lid 480 in an open position and flexible valve 470 in a closed position. FIGS. 93-95 respectively show a front perspective, rear perspective, and cross-sectional view of an example drinking container assembly 400 having lid 480 in an open position and flexible valve 470 in an open position. When the drinking container assembly 400 is in an open position (e.g., when cover portion 481 is not covering collar 420), flexible valve 470 can be in open or closed positions.

When flexible valve 470 is in the closed position, flexible valve 470 abuts against dividers 456 and inner shoulder 421, thereby sealing channels 458 and preventing fluid from flowing therethrough. A user can press center 442 to cause flexible valve 470 to move to the open position. For example, center 442 may be constructed of a flexible material to allow upward flexing of an edge of center 442 adjacent to flexible valve 470. The upward flexing of the edge causes flexible valve 470 to move upwards. The tapered cone structure of flexible valve 470 is constructed of a flexible material that can bend and flex. The elasticity of flexible valve 470 forces flexible valve 470 to enter either the open and closed positions. More specifically, the outer circumference and inner circumference of the flexible valve 470 are consistent in both positions. As the center 442 is pressed, the inner circumference of flexible valve 470 (e.g., adjacent to outer circumference of center 442) and similar to hinge 172 discussed above with respect to inner valve 170) moves upwards around the point of downward pressure. The outer circumference of flexible valve 470 (e.g., similar to the peripheral edge 176 discussed above with respect to inner valve 170) is similarly pulled upwards. As the outer circumference of flexible valve 470 moves upwards, the outer circumference must expand due to the tapered shape of flexible valve 470, thereby accumulating kinetic energy. Upon reaching a threshold height and/or width, the outer circumference of flexible valve 470 has stored sufficient amount of kinetic energy to cause the outer circumference to snap upwards (e.g., to the open position) to its original length.

Similarly, pressing downward on flexible valve 470 in the open position can cause the outer circumference to move downwards from the open position until the threshold height and/or width to cause the outer circumference to snap downwards (e.g., to the closed position) to regain its original width. For example, a user can use their finger to press down on flexible valve 470 to close flexible valve 470. As discussed above, abutment surface 498 can also be pressed down against flexible valve 470 to close flexible valve 470.

Figure 96:
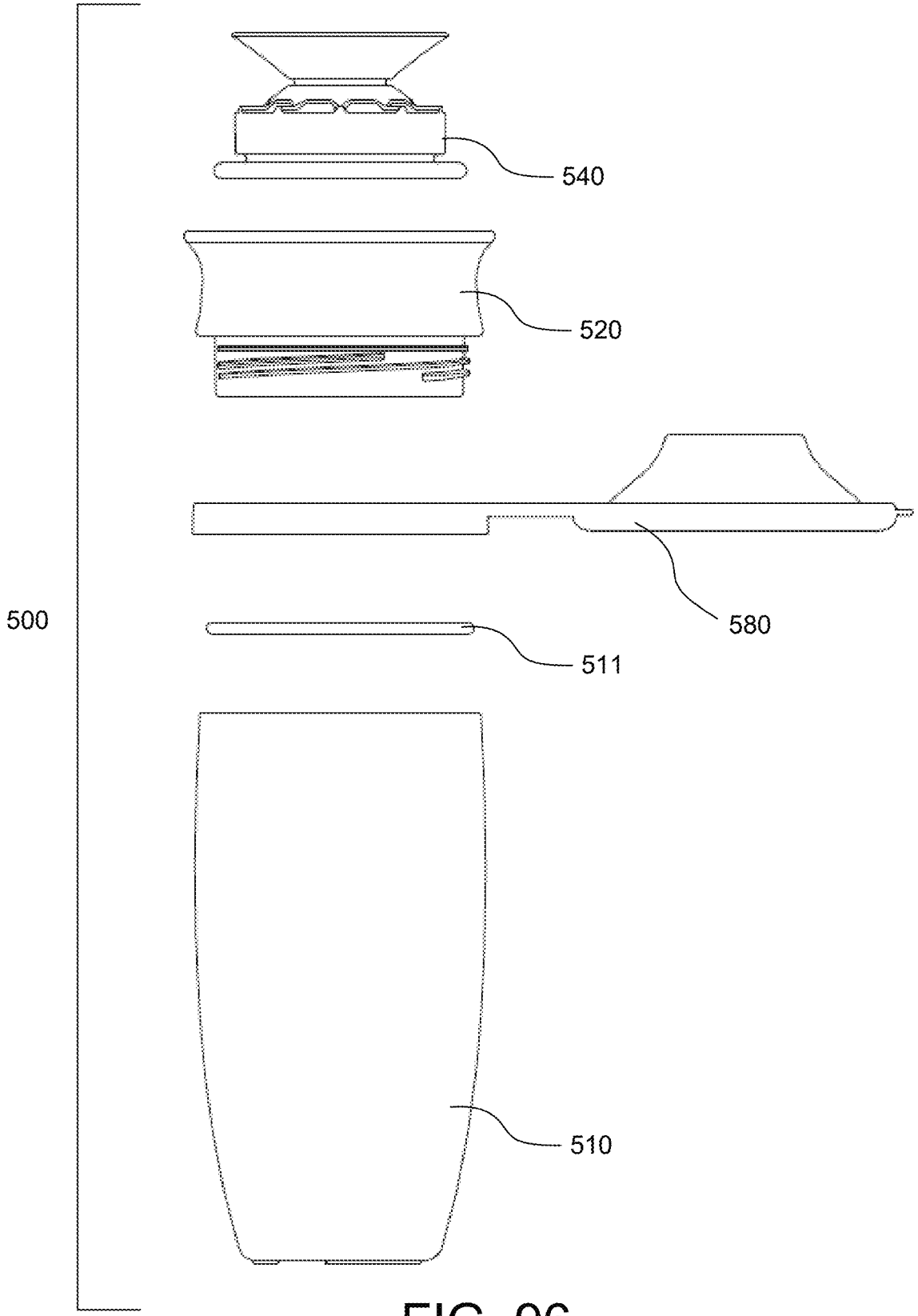
FIG. 96 is an exploded view of a drinking container assembly.

FIG. 96 is an exploded view of another exemplary drinking container assembly 500. Drinking container assembly 500 can include a container 510, a seal 511, a lid 580, a collar 520, and a valve structure 540.

Figure 97:
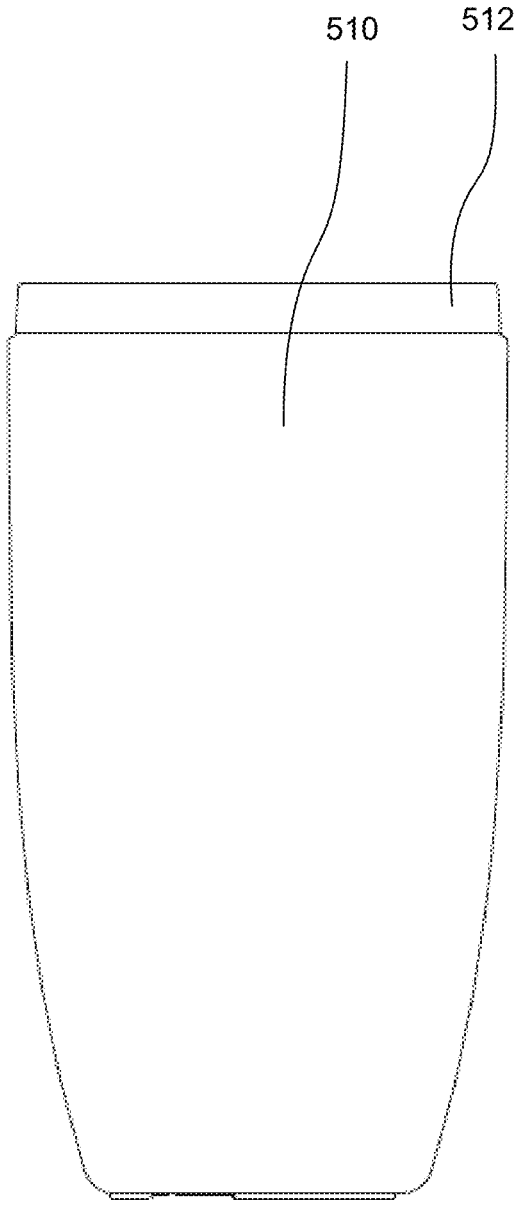
FIG. 97 and FIG. 98 show example containers.
Figure 98:
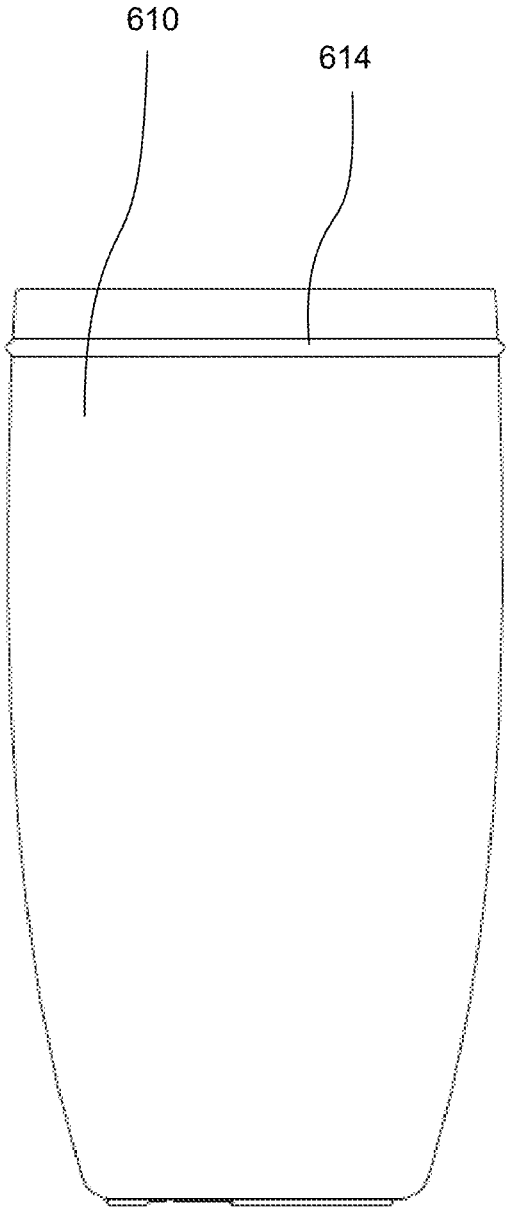

FIG. 97 and FIG. 98 show example containers 510, 610. Some containers 510 may have a recessed section 512 to accommodate an attachment structure of lid 580. Some container 610 may have a ridge 614 to facilitate positioning of an attachment structure of lid 580 on container 610.

Figure 99:
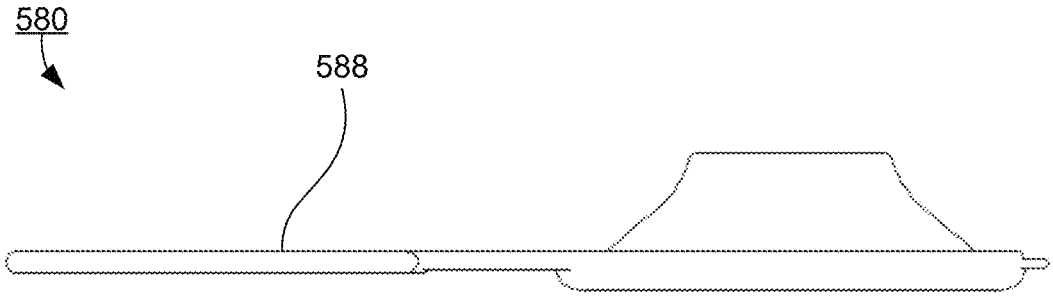
FIG. 99 and FIG. 100 show example lids.
Figure 100:
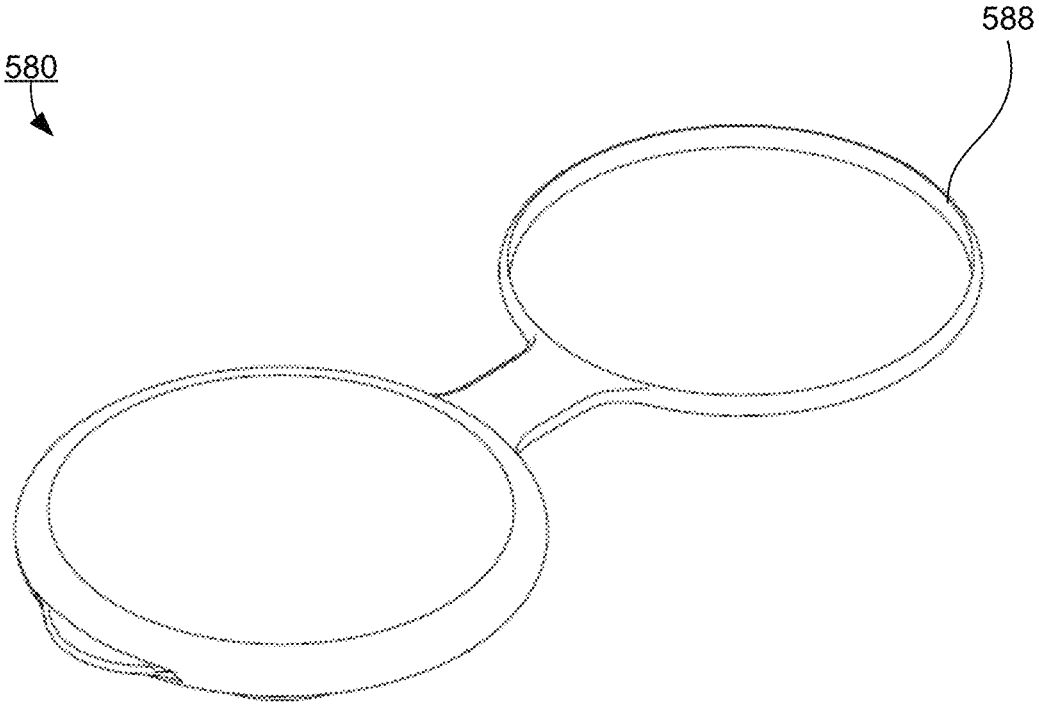

FIG. 99 and FIG. 100 show another example lid 580. Lid 580 can have a thinner attachment structure 588 that has a substantially similar thickness to the cover portion.

Figure 101:
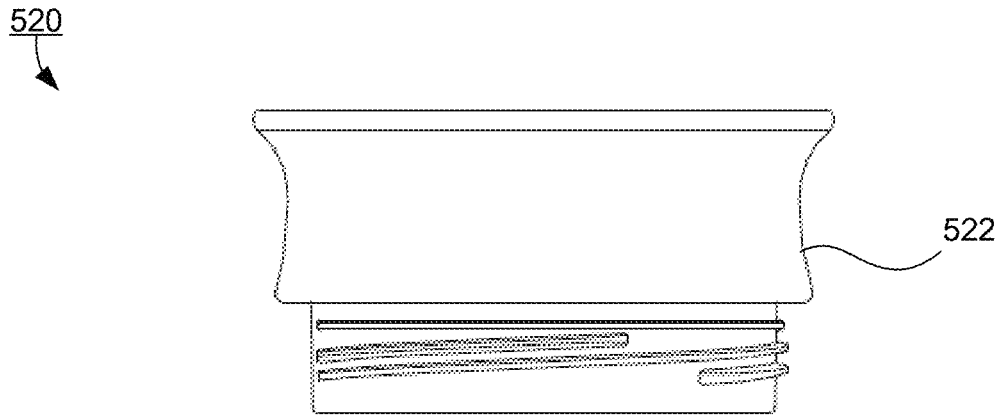
FIG. 101 and FIG. 102 show example collars.
Figure 102:
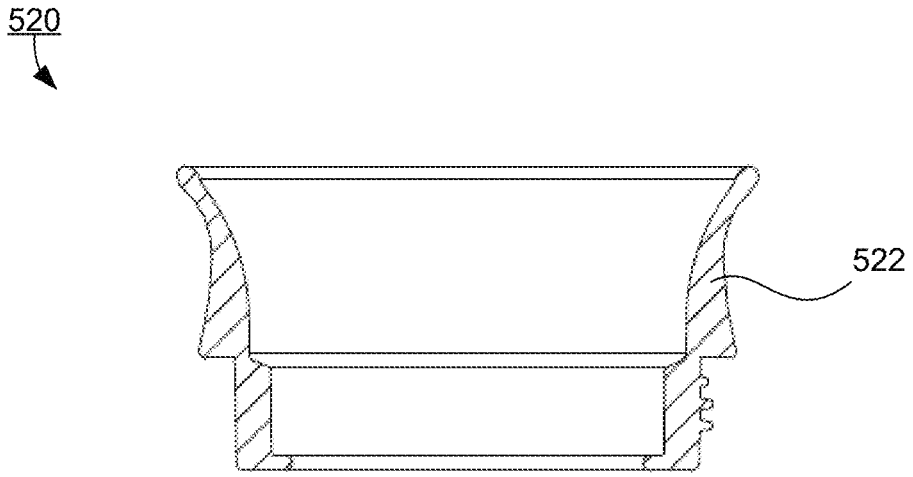

FIG. 101 and FIG. 102 shows another example collar 520. Collar 520 may have a more substantial curved sidewall 522 to more closely conform to lips of a user.

The illustrations and examples provided herein are for explanatory purposes and are not intended to limit the scope of the appended claims. It will be recognized by those skilled in the art that changes, or modifications may be made to the above-described embodiments without departing from the broad inventive concepts of the invention. It is understood therefore that the invention is not limited to the particular embodiments which are described but is intended to cover all modifications and changes within the scope and spirit of the subject disclosure.

The foregoing disclosure of the exemplary embodiments of the present subject disclosure has been presented for purposes of illustration and description. It is not intended to be exhaustive or to limit the subject disclosure to the precise forms disclosed. Many variations and modifications of the embodiments described herein will be apparent to one of ordinary skill in the art in light of the above disclosure. The scope of the subject disclosure is to be defined only by the claims appended hereto, and by their equivalents.

What is claimed is:

1. A multi-position valve, comprising:

a frustoconical structure having apertures thereon; and a concentric flap attached to the frustoconical structure by a hinge, wherein the concentric flap pivots between a first closed position to a second open position, wherein when the concentric flap is in:

the first closed position, the concentric flap abuts against the frustoconical structure and blocks fluid flow through the apertures, and the second open position, the concentric flap is pivoted upward at the hinge and away from the frustoconical structure and permits fluid flow through the apertures.

2. The multi-position valve of claim 1, wherein the frustoconical structure has a center surface, and wherein the hinge is attached to the center surface of the frustoconical structure.

3. The multi-position valve of claim 2, wherein the hinge pivots the concentric flap from the first closed position to the second open position when the center surface is pressed.

4. The multi-position valve of claim 2, wherein the hinge pivots the concentric flap from the second open position to the first closed position when the concentric flap is pressed downwards.

5. The multi-position valve of claim 1, further comprising:

dividers disposed on the frustoconical structure defining channels, wherein the apertures are disposed in the channels, and wherein the concentric flap abuts against the dividers and blocks the channels when the concentric flap is in the first closed position.

6. The multi-position valve of claim 1, further comprising:

a sidewall extending from the frustoconical structure; and an annular outward protrusion extending radially around a lower end of the sidewall.

7. The multi-position valve of claim 6, wherein the annular outward protrusion is operable to mate with an annular recess of a collar to secure the multi-position valve to the collar.

8. A multi-position valve and collar assembly comprising:

a multi-position valve comprising:

a frustoconical structure having apertures thereon, and a concentric flap attached to the frustoconical structure by a hinge, wherein the concentric flap pivots between a first closed position to a second open position, wherein when the concentric flap is in:

the first closed position, the concentric flap abuts against the frustoconical structure and blocks fluid flow through the apertures, and the second open position, the concentric flap is pivoted upward at the hinge and away from the frustoconical structure and permits fluid flow through the apertures; and a collar operable to receive and secure the multi-position valve therein.

9. The multi-position valve and collar assembly of claim 8, wherein the frustoconical structure has a center surface, and wherein the hinge is attached to the center surface of the frustoconical structure.

10. The multi-position valve and collar assembly of claim 9, wherein the hinge pivots the concentric flap from the first closed position to the second open position when the center surface is pressed.

11. The multi-position valve and collar assembly of claim 9, wherein the hinge pivots the concentric flap from the second open position to the first closed position when the concentric flap is pressed downwards.

12. The multi-position valve and collar assembly of claim 8, wherein the multi-position valve further comprises dividers disposed on the frustoconical structure defining channels, wherein the apertures are disposed in the channels, and wherein the concentric flap abuts against the dividers and blocks the channels when the concentric flap is in the first closed position.

13. The multi-position valve and collar assembly of claim 8, wherein further the multi-position valve further comprises:

a sidewall extending from the frustoconical structure; and an annular outward protrusion extending radially around a lower end of the sidewall.

14. The multi-position valve and collar assembly of claim 13, wherein the annular outward protrusion is operable to mate with an annular recess of the collar to secure the multi-position valve to the collar.

15. A drinking container comprising:

a multi-position valve comprising:

a frustoconical structure having apertures thereon, and a concentric flap attached to the frustoconical structure by a hinge, wherein the concentric flap pivots between a first closed position to a second open position, wherein when the concentric flap is in:

the first closed position, the concentric flap abuts against the frustoconical structure and blocks fluid flow through the apertures, and the second open position, the concentric flap is pivoted upward at the hinge and away from the frustoconical structure and permits fluid flow through the apertures;

a collar operable to receive and secure the multi-position valve therein; and a container body operable to receive and secure the collar thereto.

16. The drinking container of claim 15, wherein the frustoconical structure has a center surface, and wherein the hinge is attached to the center surface of the frustoconical structure.

17. The drinking container of claim 16, wherein the hinge pivots the concentric flap from the first closed position to the second open position when the center surface is pressed.

18. The drinking container of claim 16, wherein the hinge pivots the concentric flap from the second open position to the first closed position when the concentric flap is pressed downwards.

19. The drinking container of claim 15, wherein the multi-position valve further comprises dividers disposed on the frustoconical structure defining channels, wherein the apertures are disposed in the channels, and wherein the concentric flap abuts against the dividers and blocks the channels when the concentric flap is in the first closed position.

20. The drinking container of claim 15, wherein further the multi-position valve further comprises:

a sidewall extending from the frustoconical structure; and an annular outward protrusion extending radially around a lower end of the sidewall, wherein the annular outward protrusion is operable to mate with an annular recess of the collar to secure the multi-position valve to the collar.

* * * * *